US009061508B2

(12) United States Patent
Ishizawa et al.

(10) Patent No.: US 9,061,508 B2
(45) **Date of Patent: *Jun. 23, 2015**

(54) RECORDING MATERIAL DELIVERY SYSTEM FOR RECORDING MATERIAL-CONSUMING APPARATUS; CIRCUIT BOARD; STRUCTURAL BODY; AND INK CARTRIDGE

(71) Applicant: SEIKO EPSON CORPORATION, Tokyo (JP)

(72) Inventors: Taku Ishizawa, Shiojiri (JP); Satoshi Shinada, Shiojiri (JP); Izumi Nozawa, Matsumoto (JP); Yuji Aoki, Matsumoto (JP); Hiroyuki Kawate, Matsumoto (JP); Takakazu Fukano, Matsumoto (JP); Noboru Asauchi, Nagano-ken (JP); Yasuhiko Kosugi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/952,047

(22) Filed: Jul. 26, 2013

(65) Prior Publication Data

US 2013/0307906 A1 Nov. 21, 2013

Related U.S. Application Data

(63) Continuation of application No. 12/779,511, filed on May 13, 2010, now Pat. No. 8,540,347.

(30) Foreign Application Priority Data

May 15, 2009 (JP) ..... 2009-118175

(51) Int. Cl.

| | |
|---|---|
| ***B41J 2/17*** | (2006.01) |
| ***B41J 2/175*** | (2006.01) |
| ***G03G 15/08*** | (2006.01) |

(52) U.S. Cl.

CPC ..... *B41J 2/1753* (2013.01); *B41J 2/1752* (2013.01); *B41J 2/17526* (2013.01); *B41J 2/17546* (2013.01); *G03G 15/0863* (2013.01)

(58) Field of Classification Search

USPC ..... 347/5, 9, 6, 19, 49–50, 84–87

See application file for complete search history.

(56) References Cited

U.S. PATENT DOCUMENTS 6,435,676 B1 * 8/2002 Murray et al. ..... 347/87
6,502,917 B1 1/2003 Shinada et al.

(Continued)

FOREIGN PATENT DOCUMENTS

EP 1792733 A1 6/2007
EP 1800872 A1 6/2007

(Continued)

OTHER PUBLICATIONS

English translation of the International Preliminary Report on Patentability issued on Dec. 12, 2011 in International Application No. PCT/JP2010/003271.

*Primary Examiner* — Lam Nguyen

(74) *Attorney, Agent, or Firm* — Stroock & Stroock & Lavan LLP

(57) ABSTRACT

A circuit board of an ink cartridge is provided with a plurality of terminals, with the contact portions of the plurality of terminals forming a plurality of lines. The contact portions of two terminals used for detecting installation are positioned in a first line, and the contact portion of a power terminal is positioned between the two terminals. The first line may be positioned to a leading side when the ink cartridge is moved in a prescribed direction to effect installation in a printer. Alternatively, the first line may be the line closest to an opening of an ink delivery port. Alternatively, the first line may be the line closest to an ink delivery needle.

22 Claims, 32 Drawing Sheets

(56) References Cited

U.S. PATENT DOCUMENTS

| | | | | |
|---|---|---|---|---|
| 6,648,445 | B2 | 11/2003 | Ishizawa et al. | |
| 7,562,958 | B2 | 7/2009 | Asauchi | |
| 2008/0151017 | A1 | 6/2008 | Nozawa et al. | |
| 2008/0259135 | A1* | 10/2008 | Asauchi et al. | 347/84 |
| 2008/0284830 | A1 | 11/2008 | Shinada et al. | |
| 2009/0051746 | A1* | 2/2009 | Asauchi | 347/86 |
| 2009/0085939 | A1 | 4/2009 | Asauchi | |
| 2010/0289847 | A1 | 11/2010 | Ishizawa et al. | |

FOREIGN PATENT DOCUMENTS

| | | | |
|---|---|---|---|
| JP | 10-230603 | A | 9/1998 |
| JP | 11-320857 | A | 11/1999 |
| JP | 2002-198627 | A | 7/2002 |
| JP | 2005-096446 | A1 | 4/2005 |
| JP | 2006-015733 | A | 1/2006 |
| JP | 2007-196664 | A | 8/2007 |
| JP | 2009-101683 | A | 5/2009 |
| JP | 2013-241017 | A | 12/2013 |
| JP | 2014-073685 | A | 4/2014 |
| WO | 99/59823 | A1 | 11/1999 |
| WO | 2006/025578 | A1 | 3/2006 |
| WO | 2008/084699 | A1 | 7/2008 |
| WO | 2010/131480 | A1 | 11/2010 |

* cited by examiner

FS
LE
200
205
400
500
260,270
210~250
460,470
460c,470c
410c~450c
410~450
Ds1
Ds2
X
Y
Z

VDD
RST
SCK
SDA
H
L
Reset
n-bit CP1
n-bit CP2
n bits
ID2
ID1
ID0
R/W
D11
D12
D1n
D21
D22
D2n
Dk1
Dk2
Dkn
specified ID
command
Row 1 data
Row 2 data
Row k data
S41
Output Row 1 data
S42
Output Row 2 data
S4k
Output Row k data
S51
Acquire Row 1 data
S52
Acquire Row 2 data
S5k
Acquire Row k data
S51w
S5kw
Store
R
W
S30
Command ?
Yes
S20
Own ID = specified ID ?
No
S10
Acquire Row 0 data (own ID)
Standby Angle AG is same
Ra < Rb
da < db d3 < d1,d2,d4,d5,d6,d7
d2,d3,d4 < d1,d5

RECORDING MATERIAL DELIVERY SYSTEM FOR RECORDING MATERIAL-CONSUMING APPARATUS; CIRCUIT BOARD; STRUCTURAL BODY; AND INK CARTRIDGE

The present application is a continuation of U.S. patent application Ser. No. 12/779,511, filed on May 13, 2010, which claims priority based on Japanese Patent Application No. 2009-118175 filed on May 15, 2009, the disclosure each of which is hereby incorporated by reference in its entirety.

The present invention relates to a recording material delivery system for recording material-consuming apparatus, to a circuit board, to a structural body, and to an ink cartridge.

BACKGROUND

Printers are designed to accommodate detachable installation of ink cartridges or ink receptacles in the printer. Such ink cartridges or ink receptacles typically include installed devices of various kinds. An example of such a device is a memory device for storing ink-related information. High-voltage circuits (e.g. piezoelectric elements employed as remaining ink level sensors) adapted to output a response signal in response to application of higher voltage than the power supply voltage of such memory devices are also known. Devices of this kind are electrically connected to an controller of the printer (or an external device). For example, in some instances the device and the controller are electrically connected via contact terminals.

[PTL 1] JP 2002-198627A
[PTL 2] WO 2006/25578A
[PTL 3] JP 2006-15733A
[PTL 4] JP 10-230603A
[PTL 5] JP 11-320857A
[PTL 6] JP 2007-196664A
[PTL 7] U.S. Pat. No. 6,435,676B
[PTL 8] U.S. Pat. No. 6,502,917B
[PTL 9] WO 99/59823A

SUMMARY

However, where electrical connections that rely on such contact terminals are utilized, various problems may arise due to bad electrical contact, misconnections, or other connection problems. For example, there are instances in which interruption of the power supply from a printer to a device such as a memory device results in malfunction or disabling of the memory device.

Such problems are not limited to instances in which the device is a memory device, and such problems are common to instances where other kinds of devices are used as well. Nor are such problems limited to printers that consume ink, but are common to apparatuses that consume other kinds of recording materials (such as toner for example).

It is desirable to provide a technology for reducing the likelihood of problems encountered when utilizing electrical connections that rely on contact terminals that are designed to contact the terminals of a recording material-consuming apparatus.

Application examples for reducing the likelihood of such problems will be described.

Application example 1 provides a recording material delivery system installable in a recording material-consuming apparatus having a plurality of electrical contact members, comprising: a recording material receptacle portion for containing a recording material, the recording material receptacle portion having a recording material delivery port; a memory device; and a plurality of terminals that include a plurality of first terminals for connection to the memory device, and two second terminals that receive a signal used for detecting whether the recording material delivery system is installed in the recording material-consuming apparatus, wherein the plurality of first terminals include a power supply terminal for receiving a power supply potential that differs from a ground potential of the recording material-consuming apparatus, the plurality of terminals respectively include contact portions that, with the recording material delivery system in an installed state having been correctly installed in the recording material-consuming apparatus, contact corresponding electrical contact members among the plurality of electrical contact members of the recording material-consuming apparatus, the contact portions of the plurality of terminals are arranged so as to form a plurality of lines, the contact portions of the two second terminals are situated in a first line among the plurality of lines, and the contact portion of the power terminal is situated between the contact portions of the two second terminals on the first line.

According to this arrangement, the two contact portions of the second terminals which are employed for the purpose of detecting installation are situated in the first line with the contact portion of the power terminal being situated therebetween, thereby affording a high probability that, under conditions in which the installation detection is verified, electrical connection of the power terminal is in fact successfully achieved. The probability of a defective connection of the power terminal is lower as a result, so the probability of problems that may arise with the use of electrical connections that rely on terminals is reduced.

Application example 2 provides the recording material delivery system according to Application example 1, wherein the contact portions of the two second terminals are situated at one end and the other end of the first line.

According to this arrangement, because the contact portions of the second terminals are situated at either end of the first line, the probability of detection errors relating to installation status in the recording material-consuming apparatus is reduced.

Application example 3 provides the recording material delivery system according to Application example 1 or 2, wherein the memory device is adapted to carry out transmission of data signals to an external circuit and/or reception of data signals from the external circuit in sync with a clock signal, the plurality of first terminals include a data terminal for carrying out transmission and/or reception of the data signals, a clock terminal for receiving the clock signal, and a ground terminal for receiving the ground potential, and the first line is positioned to a leading side with respect to the other lines among the plurality of lines when the recording material delivery system is moved in a prescribed direction to effect installation thereof into the recording material-consuming apparatus.

According to this arrangement, because the probability of a defective connection of the data terminal etc. is reduced, the likelihood of problems that may arise with the use of electrical connections that rely on terminals is reduced as well. Additionally, because the electrical contact member that corresponds to the power terminal is prevented from coming into inadvertent contact with a terminal of a line other than the first line, the probability of problems that may arise when using electrical connections that rely on terminals is reduced.

Application example 4 provides the recording material delivery system according to any one of Application examples 1-3, wherein the memory device is adapted to carry out transmission of data signals to an external circuit and/or reception of data signals from the external circuit in sync with a clock signal, the plurality of first terminals include a data terminal for carrying out transmission and/or reception of the data signals, a clock terminal for receiving the clock signal, and a ground terminal for receiving the ground potential, the recording material delivery port includes an opening, and the first line is situated closest to the opening among the plurality of lines.

According to this arrangement, because the probability of a defective connection of the data terminal etc. is reduced, the likelihood of problems that may arise with the use of electrical connections that rely on terminals is reduced as well. Additionally, because the electrical contact member that corresponds to the power terminal is prevented from coming into inadvertent contact with a terminal of a line other than the first line, the probability of problems that may arise when using electrical connections that rely on terminals is reduced.

Application example 5 provides the recording material delivery system according to any one of Application examples 1 to 4, wherein the memory device operates upon receiving a reset signal of a level different from the ground potential, the plurality of first terminals include a reset terminal for receiving the reset signal, and the reset terminal is situated in a different line from the first line.

According to this arrangement, the likelihood of operating errors of the memory device is reduced.

Application example 6 provides the recording material delivery system according to any one of Application examples 1 to 5, further comprising: a side wall; and a base wall, wherein the plurality of terminals are disposed on the side wall, the recording material delivery port is disposed on the base wall, the recording material delivery port on the base wall is situated at a location eccentric towards the side wall, and an installation direction of the recording material delivery system onto the recording material-consuming apparatus is downward in a direction of gravity.

According to this arrangement, the probability of defective connections of the plurality of terminals is reduced, so the probability of problems that may arise when using electrical connections that rely on terminals is reduced.

Application example 7 provides the recording material delivery system according to any one of Application examples 1 to 6, wherein a total number of the contact portions of the first line exceeds a total number of the contact portions in any one of the other lines among the plurality of lines.

According to this arrangement, the likelihood that an electrical contact member of the recording material-consuming apparatus comes into inadvertent contact with the wrong terminal is reduced.

It is possible for the present invention to be reduced to practice in various modes, for example, a recording material delivery system; a circuit board adapted for utilization in a recording material delivery system; a structural body adapted for utilization in a recording material delivery system; a recording material delivery system that includes at least one of such a circuit board and structural body; or an ink cartridge.

DESCRIPTION OF THE EMBODIMENTS

The description turns next to the embodiments of the invention, which will be discussed in the following order.

A. Embodiment 1:

B. Configuration of the Embodiment:

C. Embodiment 2:

D. Embodiment 3:

E. Embodiment 4:

F. Embodiment 5:

G. Embodiment 6:

H. Embodiment 7:
I. Circuit Board Modification Example
J. Modification Examples

A. Embodiment 1

A1. Apparatus Configuration

Figure 1:
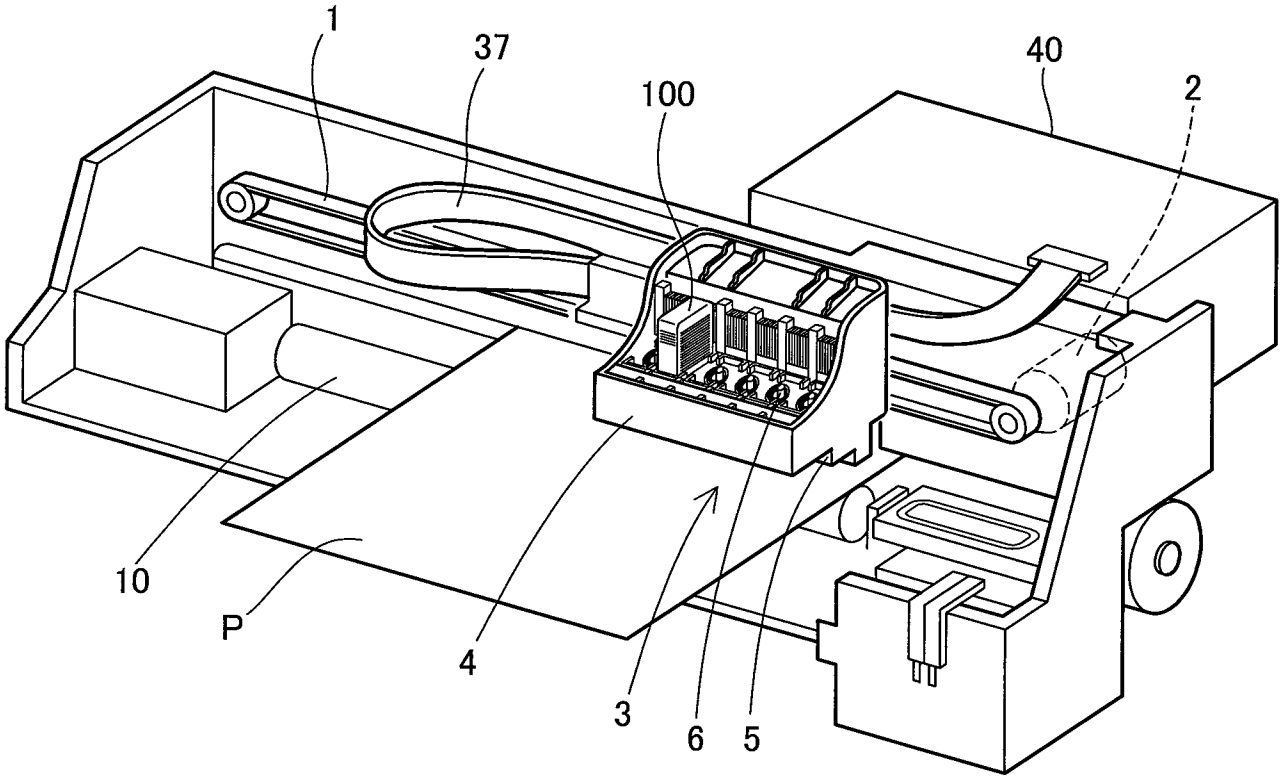
FIG. 1 is an illustration depicting a printer according to an embodiment of the present invention.

FIG. 1 is an illustration depicting a printer according to an embodiment of the present invention. The printer is one example of a recording material-consuming apparatus. A recording material-consuming apparatus consumes a recording material in the course of carrying out recording. The printer 1000 has a sub-scan feed mechanism, a main scan feed mechanism, and a head driving mechanism. The sub-scan feed mechanism includes a paper feed motor (not shown) and a paper feed roller 10 that is driven by the paper feed motor. The sub-scan feed mechanism is adapted to convey a sheet of printer paper P in the sub-scanning direction using the paper feed roller 10. The main scan feed mechanism is adapted to use the power of a carriage motor 2 to produce reciprocating motion in the main scanning direction by a carriage 3 which is connected to a drive belt 1. The carriage 3 includes a holder 4 and a print head 5. The head driving mechanism is adapted to drive the print head 5 and eject ink therefrom. The ejected ink produces dots on the printer paper P. The printer 1000 is further equipped with a main control circuit 40 for controlling the mechanisms discussed above. The main control circuit 40 is connected to the carriage 3 by a flexible cable 37.

The holder 4 is designed to accommodate installation of a plurality of ink cartridges, discussed later, and is situated on the print head 5. For normal service (printing) of the printer 1000, ink cartridges are installed in the holder 4 in order to provide the printer 1000 with ink cartridges. In the example depicted in FIG. 1, six ink cartridges can be installed in the holder 4. For example, one ink cartridge for each of the six colors black, cyan, magenta, yellow, light cyan, and light magenta would be installed. Additionally, ink delivery needles 6 for delivering ink from the ink cartridges to the print head 5 is provided on the upper face of the print head 5. In FIG. 1, a single ink cartridge 100 is shown installed in the holder 4.

Figure 2:
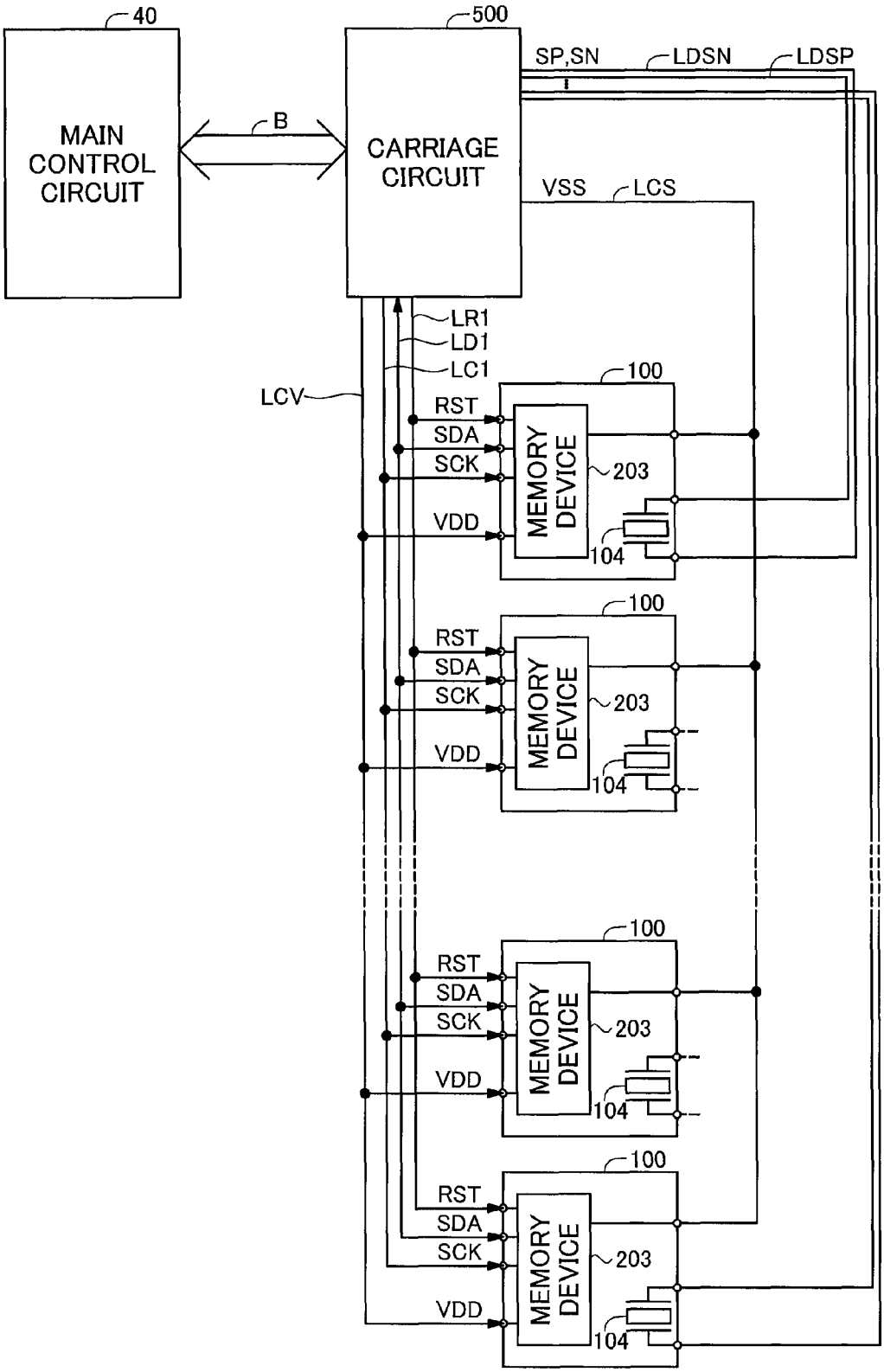
FIG. 2 is an illustration depicting the electrical configuration of a printer and an ink cartridge.
Figure 3:
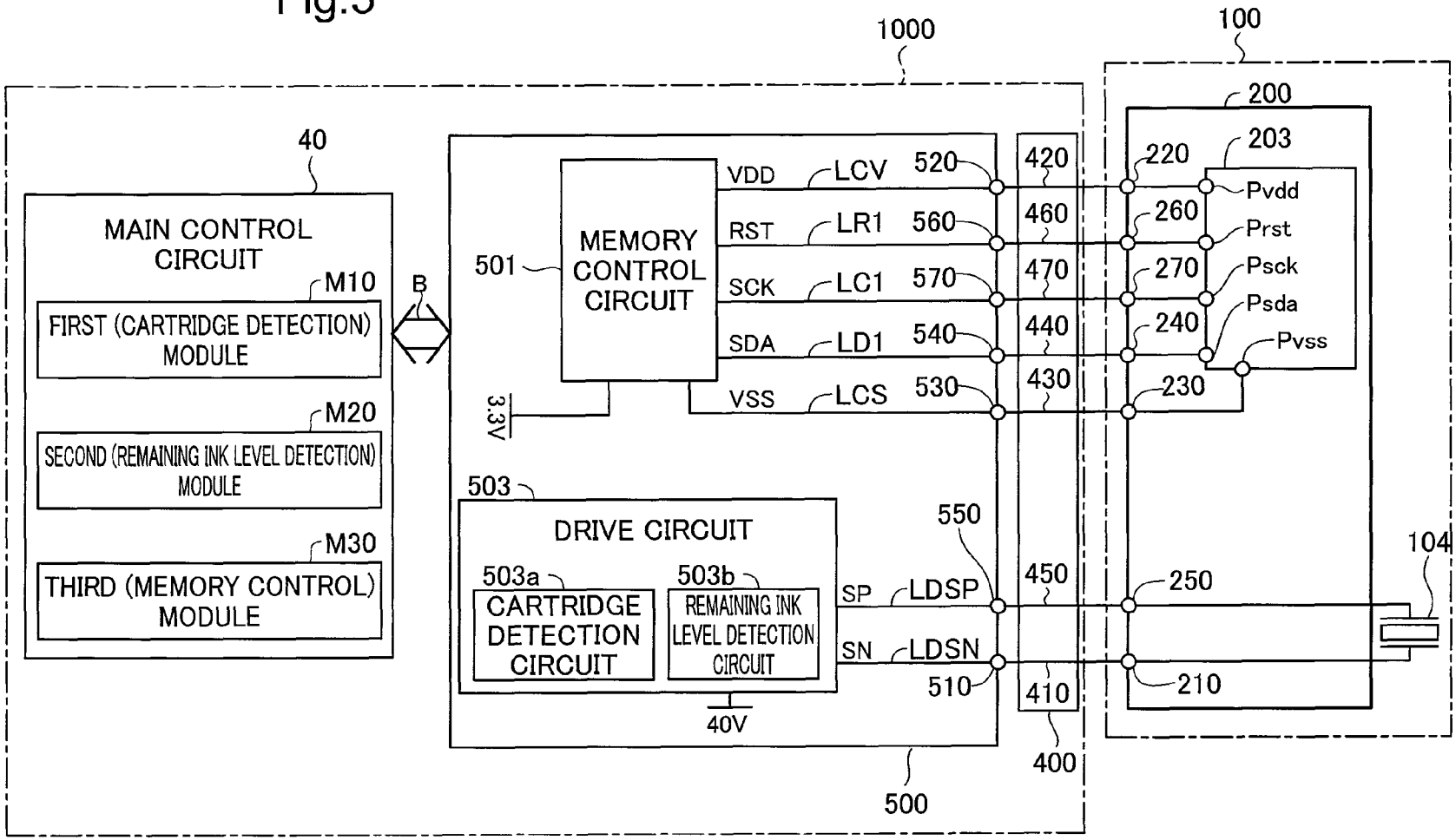
FIG. 3 is an illustration depicting the electrical configuration of a printer and an ink cartridge.

FIGS. 2 and 3 are illustrations depicting the electrical configuration of the printer 1000 and the ink cartridge 100. The illustration in FIG. 2 focuses on the main control circuit 40, a carriage circuit 500, and the ink cartridge 100 in their entirety. FIG. 3 shows the configuration relating to the single ink cartridge 100 which is representative of the plurality of ink cartridges. This electrical configuration is shared by the other ink cartridges as well. The main control circuit 40 and the carriage circuit 500 are control circuits that are provided internally to the printer 1000 and are used to control various mechanisms of the printer 1000 in order to carry out printing; herein, these two circuits will be referred to collectively as the control section of the printer 1000. Because the control section can be considered an external device of a device provided to the ink cartridges 100, it will sometimes be referred to as an external device of a device when describing operations of the control section and the device.

As shown in FIG. 2, the carriage circuit 500 and the ink cartridge 100 are connected by a plurality of wirelines. The wirelines include a reset signal line LR1, a data signal line LD1, a clock signal line LC1, a power line LCV, a ground line LCS, a first sensor drive signal line LDSN, and a second sensor drive signal line LDSP. The five types of lines LR1, LD1, LC1, LCV, LCS respectively branch and connect to all of the ink cartridges 100 (i.e. a bus connection). The sensor drive signal lines LDSN, LDSP are provided individually for each of the ink cartridges 100.

As shown in FIG. 3, the ink cartridge 100 has a circuit board 200 and a sensor 104. The circuit board 200 has as a device a semiconductor memory device 203 (hereinafter simply "memory device 203") and seven terminals 210 to 270. The circuit board 200 serves as a connector arranged with terminals for electrical connection to the control section of the printer 1000, and is adapted to provide electrical connections between the control section of the printer 1000 and device(s) and sensor(s) provided to the ink cartridge 100. A power terminal 220, a reset terminal 260, a clock terminal 270, a data terminal 240, and a ground terminal 230 are designed to electrically connect respectively to a power terminal pad Pvdd (hereinafter termed the power pad), a reset terminal pad Prst (hereinafter termed the reset pad), a clock terminal pad Psck (hereinafter termed the clock pad), a data terminal pad Psda (hereinafter termed the data pad), and a ground terminal pad Pvss (hereinafter termed the ground pad) which are provided to the memory device 203. Various types of memory could be used for the memory device 203. In the present embodiment there is employed a memory designed so that memory cells targeted for access (read and write operations) in word units may be selected on the basis of addresses generated in accordance with an internal clock signal of the memory device 203 (for example, EEPROM, or a memory that uses a ferroelectric memory cell array). The memory device 203 stores information relating to ink contained in the ink cartridge 100. Any device provided at a minimum with memory functionality for storing data (or information) may be employed as the memory device 203; and a CPU or the like could be provided in addition to memory functionality. For example, the device could include a CPU and a program storage section.

The sensor 104 is used to detect the remaining ink level. In the present embodiment, a piezoelectric element composed of a piezoelectric body sandwiched between two electrodes is employed as the sensor 104. The piezoelectric element (sensor 104) is secured to the housing of the ink cartridge 100. When a driving voltage is applied to the piezoelectric element, the piezoelectric element deforms. This phenomenon is called the inverse piezoelectric effect. This inverse piezoelectric effect can be utilized to forcibly induce oscillation of the piezoelectric element. Oscillations of the piezoelectric element may remain after application of driving voltage has ceased. The frequency of the residual oscillations represents the natural frequency of surrounding structural body that oscillates together with the piezoelectric element (e.g. the ink cartridge 100 housing and the ink). The frequency of the residual oscillations varies according to the level of ink remaining in the ink cartridge 100 (i.e. whether there is remaining ink in the ink channel in proximity to the sensor 104). Accordingly, whether or not the remaining ink level is at or above a certain prescribed level can be determined from the residual oscillation frequency. The residual oscillation frequency can be acquired by measuring the oscillation frequency of voltage produced by the piezoelectric effect. A first sensor terminal 210 and a second sensor terminal 250 are electrically connected respectively to one electrode and the other electrode of the sensor 104 (piezoelectric element). The residual oscillation amplitude varies according to the remaining ink level as well. Consequently, whether or not the remaining ink level is at or above a certain prescribed level can be determined from the variable amplitude of voltage produced by the piezoelectric effect.

The printer 1000 also includes a contact mechanism 400 and a carriage circuit 500. The contact mechanism 400 and the carriage circuit 500 are disposed on the carriage 3 (FIG. 1). The carriage circuit 500 is mounted on a control board provided on the carriage 3. The control board is electrically connected to the main control circuit 40 by the flexible cable 37.

The carriage circuit 500 has a memory control circuit 501, a sensor drive circuit 503, and seven terminals 510 to 570. A power terminal 520, a reset terminal 560, a clock terminal 570, a data terminal 540, and a ground terminal 530 are electrically connected to the memory control circuit 501. The ground terminal 530 is grounded (i.e. connected to the Ground of the printer 1000) via the memory control circuit 501 and the main control circuit 40. These terminals 520, 530, 540, 560, 570 are respectively connected to the terminals 220, 230, 240, 260, 270 of the ink cartridge 100 via the contact mechanism 400 (contact members 420, 430, 440, 460, 470). That is, when the user installs the circuit board 200 in the printer 1000, the printer 1000 is electrically connected to the terminals of the circuit board 200. The contact member 420 corresponds to part of the power line LCV of FIG. 2; the contact member 460 corresponds to part of the reset signal line LR1; the contact member 470 corresponds to part of the clock signal line LC1; the contact member 440 corresponds to part of the data signal line LD1; and the contact member 430 corresponds to part of the ground line LCS.

The memory control circuit 501 controls the memory device 203, and reads and writes data from and to the memory device 203, via these terminals. Specifically, power supply potential (power supply voltage) VDD is supplied from the memory control circuit 501 to the memory device 203 through the power supply terminal 520. A reset signal RST is supplied from the memory control circuit 501 to the memory device 203 through the reset terminal 560. A clock signal SCK is supplied from the memory control circuit 501 to the memory device 203 through the clock terminal 570. The data terminal 540 is utilized for transmission (sending and receiving) of data signals SDA between the memory control circuit 501 and the memory device 203. Ground potential VSS is supplied from the memory control circuit 501 to the memory device 203 through the ground terminal 530 (the ground terminal 230 of the ink cartridge 100 is a terminal designed to have continuity with the Ground of the printer 1000 provided that the ink cartridge 100 is installed correctly (i.e. with no position gap) in the printer 1000 (specifically, the holder 4)). The power supply voltage VDD is different from the ground potential (Ground) of the printer 1000.

In the present embodiment, the memory devices 203 of the ink cartridges 100 are assigned mutually different ID numbers (identification numbers) beforehand. These ID numbers are identification numbers that allow the memory control circuit 501 to identify a plurality of bus-connected memory devices 203. The memory control circuit 501 sends to the data signal line LD1 data representing the ID number of a memory device 203 targeted for control, followed by data representing a command. The memory device 203 that corresponds to the ID number then executes a process according to the command (e.g. a data read or data write operation). Memory devices 203 whose ID number differs from the designated ID number do not respond to the command, but instead await their own ID number to be designated (discussed in detail later).

In the present embodiment, the memory control circuit 501 and the memory device 203 are low-voltage circuits that operate at lower voltage (in the present embodiment, a maximum of 3.3 V) than the voltage applied to the piezoelectric element when detecting a remaining ink level. Any of various configurations appropriate for the memory devices 203 may be adopted as the configuration of the memory control circuit 501.

The first sensor terminal 510 and second sensor terminal 550 of the carriage circuit 500 are electrically connected to the sensor drive circuit 503. These terminals 510, 550 are connected respectively to terminals 210, 250 of the ink cartridge 100 via the contact mechanism 400 (specifically the contact members 410, 450); the contact member 450 of FIG. 3 corresponds to part of the second sensor drive signal line LDSP, and the contact member 410 corresponds to part of the first sensor drive signal line LDSN. The sensor drive circuit 503 applies voltage to the sensor 104 or receives an output signal (response) from the sensor 104 through these terminals. The sensor drive circuit 503 includes a cartridge detection circuit 503*a* and a remaining ink level detection circuit 503*b*.

The cartridge detection circuit 503*a* is adapted to output a prescribed signal (voltage) via the terminals 510, 550 during the process of detecting whether an ink cartridge is installed in the holder 4. By then acquiring via the terminals 510, 550 a response to the output signal (voltage), the cartridge detection circuit 503*a* detects whether the circuit board 200 is currently connected to the printer, that is, whether the ink cartridge 100 is currently installed in the printer. The remaining ink level detection circuit 503*b* is adapted to output a driving voltage via these terminals 510, 550. The remaining ink level detection circuit 503*b* then detects the remaining ink level by acquiring via the terminals 510, 550 the frequency or amplitude of the waveform represented by voltage across the electrodes of the piezoelectric element. The details of these processes are discussed later. In the present embodiment, the sensor 104 is a high-voltage circuit designed to receive higher voltage (in the present embodiment, a maximum of about 40 V) as compared with the memory devices 203. Any of various configurations may be adopted as the configuration of the cartridge detection circuit 503*a* and the remaining ink level detection circuit 503*b*. For example, a configuration obtained through a combination of logic circuits could be employed. Alternatively, a sensor drive circuit 503 could be devised using a computer. In the present embodiment, the carriage circuit 500 (inclusive of the sensor drive circuit 503) is devised using an ASIC.

The carriage circuit 500 is connected to the main control circuit 40 via a bus B that includes the flexible cable 37 (FIG. 1). The carriage circuit 500 operates in accordance with instructions from the main control circuit 40. In the present embodiment, the printer 1000 is provided with contact mechanisms 400 corresponding in number to the plurality of ink cartridges. Specifically, because six ink cartridges 100 are installed in the carriage 3 (FIG. 1), the carriage 3 is furnished with six contact mechanisms 400. Also, in the present embodiment, a single carriage circuit 500 is shared by the six ink cartridges 100. The carriage circuit 500 processes each of the plurality of ink cartridges 100 one at a time. Using the ID number (identification number), the memory control circuit 501 selects one memory device 203 to target for processing (described in detail later). Through a switching circuit (not shown) that is provided to the carriage circuit 500, the sensor drive circuit 503 selects one sensor 104 to target for processing.

The main control circuit 40 is a computer that includes a CPU and memory (ROM, RAM, etc.). The memory stores a cartridge detection module M10, a remaining ink level detection module M20, and a memory control module M30. Herein, these modules M10 to M30 will be referred to respectively as the first module M10, the second module M20, and the third module M30. These modules M10 to M30 are computer programs designed to be executed by the CPU. Execution of processes by the CPU in accordance with these modules will herein be expressed simply as "modules executing processes". The process of these modules M10 to M30 will be described in detail later.

As depicted in FIGS. 2 and 3, the main control circuit 40 is connected to the carriage circuit 500 via a bus B. Via the bus B, the main control circuit 40 supplies the carriage circuit 500 with power supply potential, ground potential, and data (e.g. commands indicating process requests from the main control circuit to the carriage circuit, data required for such processes, ID numbers etc.). The carriage circuit 500 sends data to the main control circuit 40 via the bus B.

Figure 4:
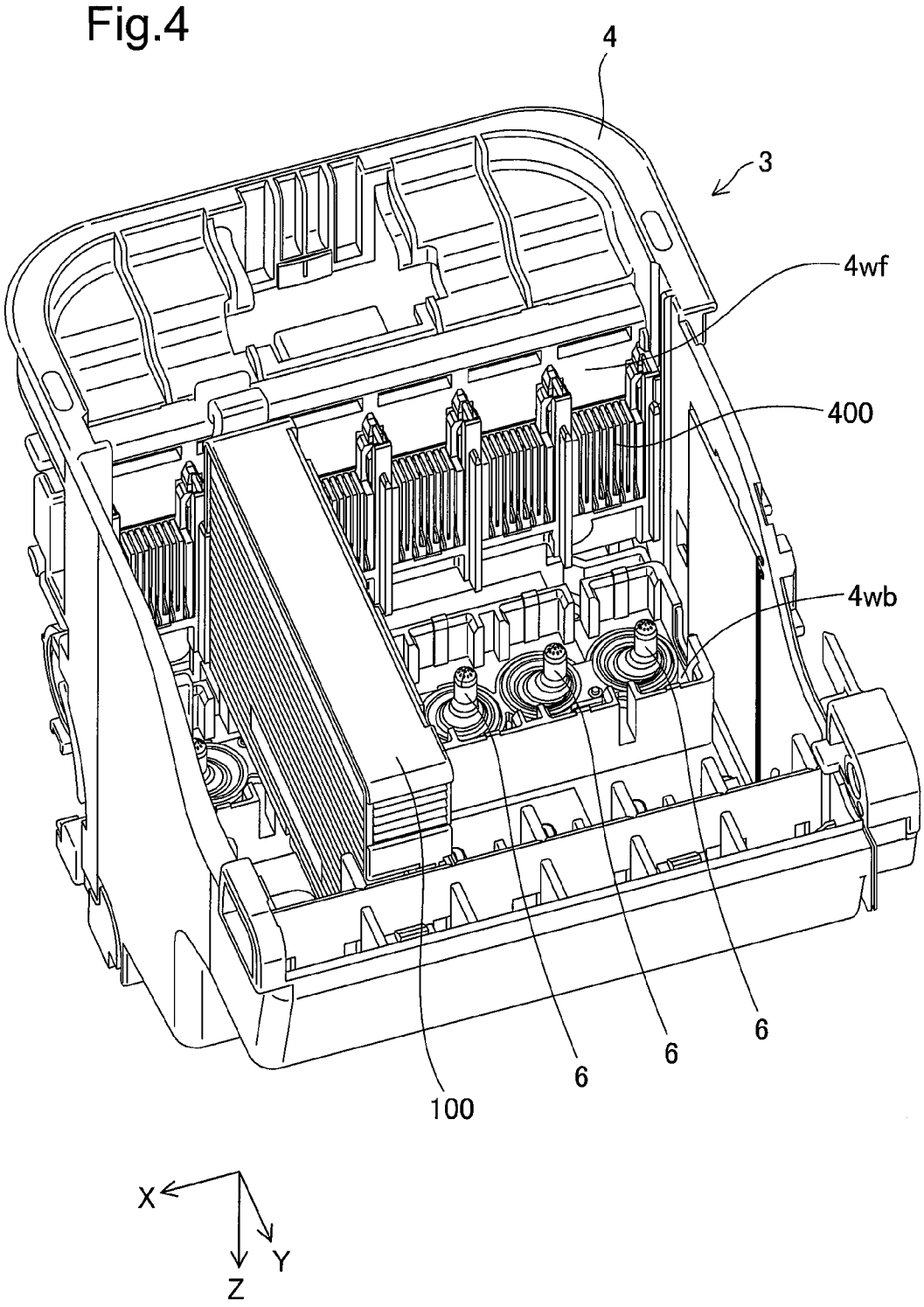
FIG. 4 is a perspective view of a carriage.
Figure 5:
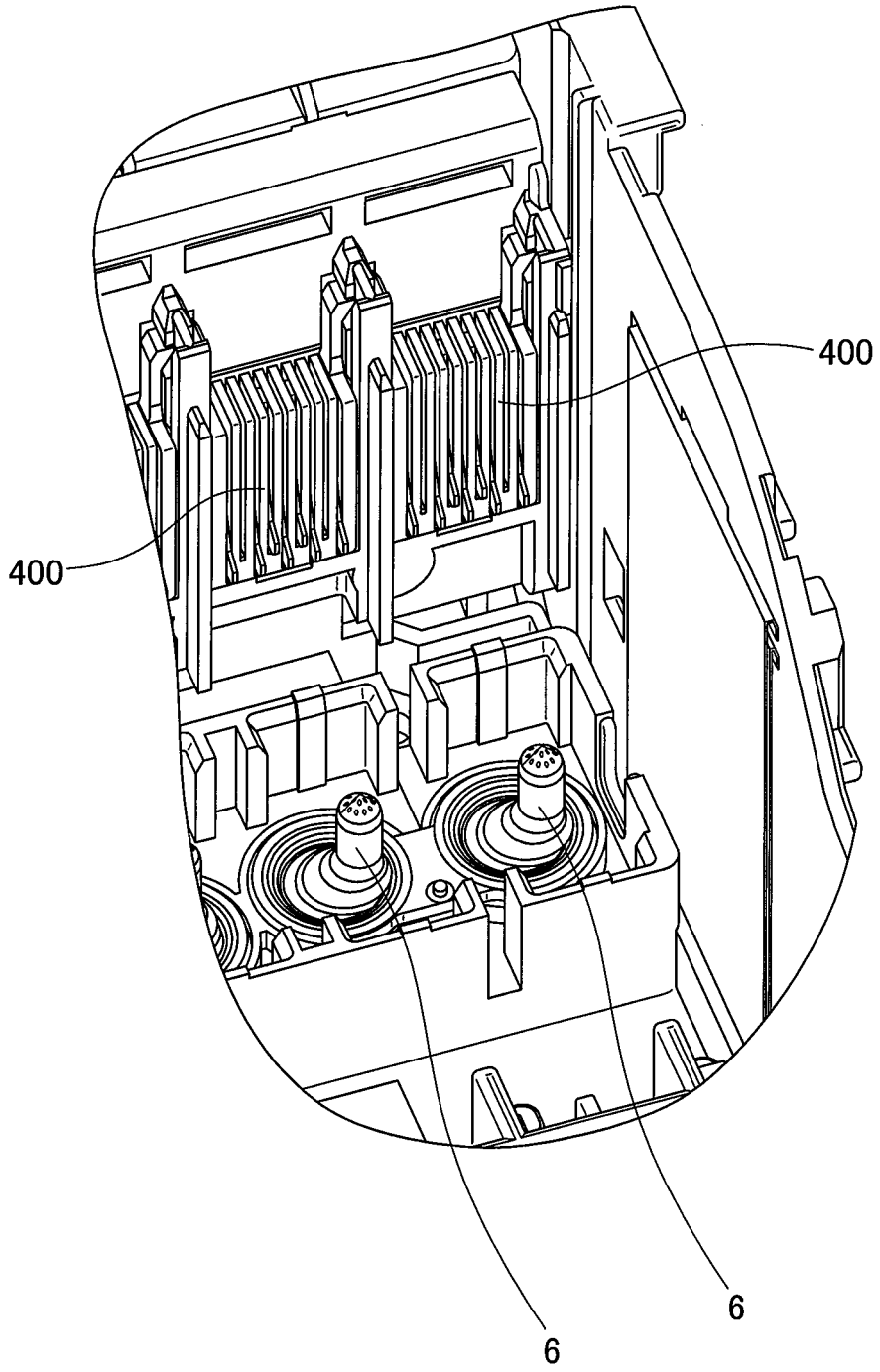
FIG. 5 is an enlarged partial view of a carriage.

FIG. 4 is a perspective view of the carriage 3. FIG. 5 is an enlarged partial view of the carriage 3 shown in FIG. 4. In FIG. 4, a single ink cartridge 100 is installed on the carriage 3. X, Y, and Z directions are indicated in the drawing. The X direction will also be referred to as the "+X direction", and the direction opposite the X direction will be referred to as the "−X direction". This convention will be employed for the Y and Z directions as well.

The Z direction in the drawing indicates the ink cartridge 100 installation direction. The ink cartridge 100 is installed in the carriage 3 by moving the ink cartridge 100 in the Z direction. The ink delivery needles 6 are arranged along the base wall 4*wb* (the wall extending in the +Z direction) of the holder 4. The ink delivery needles 6 project out in the −Z direction. The contact mechanisms 400 are arranged along the front wall 4*wf* (the wall extending in the −Y direction) of the holder 4. The Y direction indicates a direction perpendicular to the installation direction Z. In the present embodiment, six ink delivery needles 6 and six contact mechanisms 400, respectively, are juxtaposed in the X direction (from −X towards +X). The X direction is perpendicular to both the Z direction and the Y direction. Six cartridges are installed side by side in the X direction (not shown).

Figure 6A:
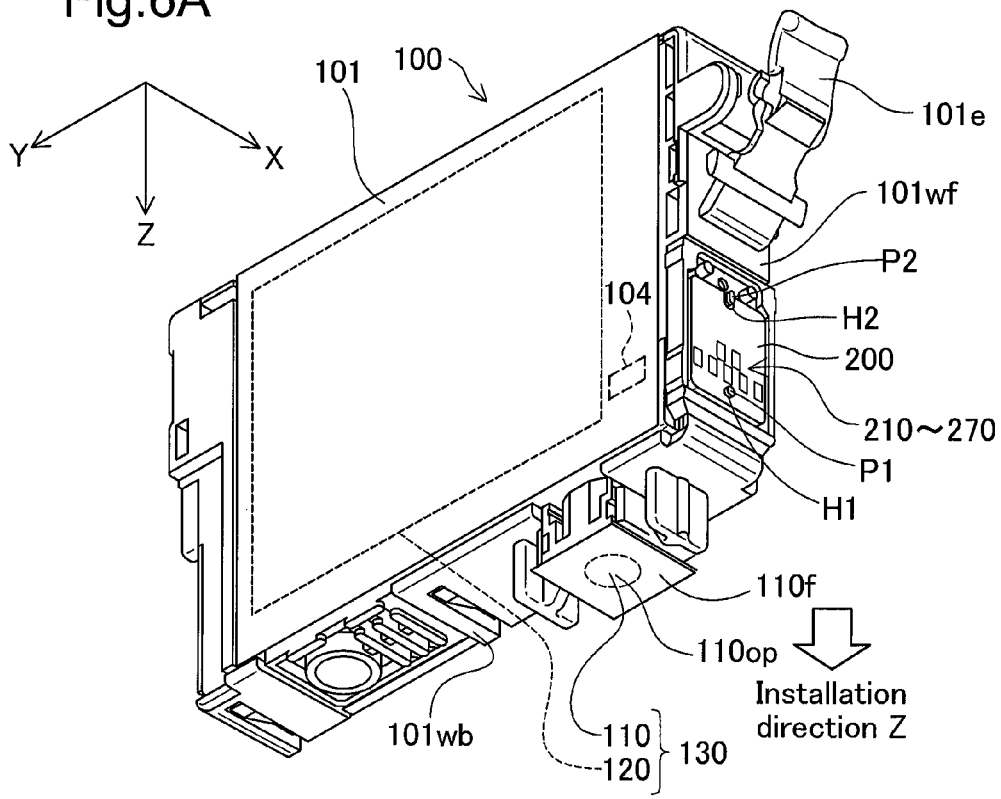
FIGS. 6A and 6B are perspective views of an ink cartridge.
Figure 6B:
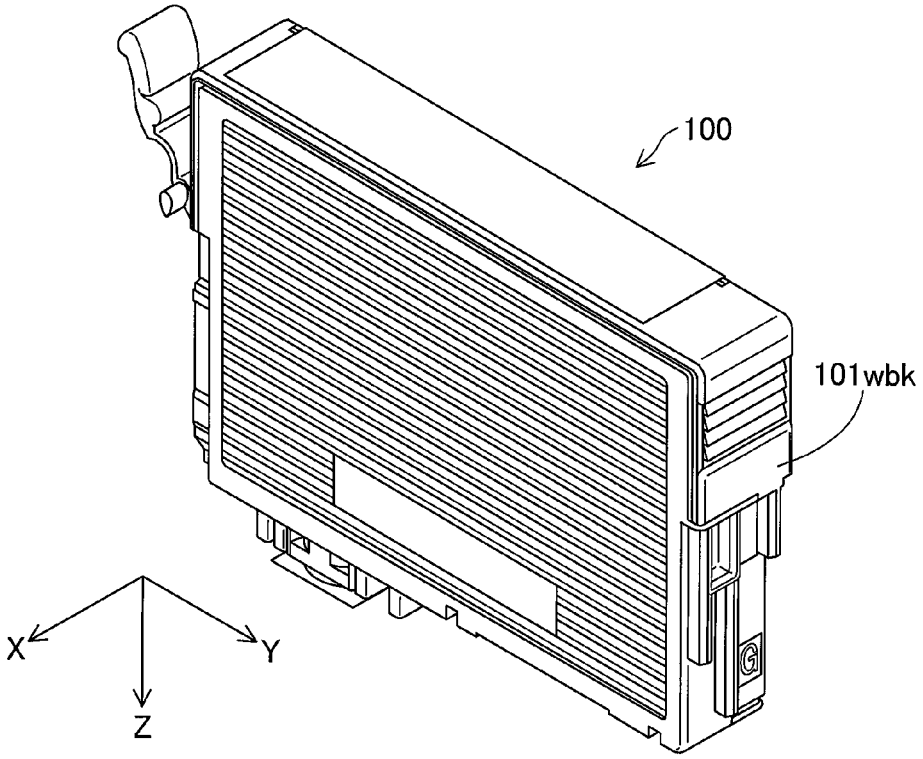
Figure 7A:
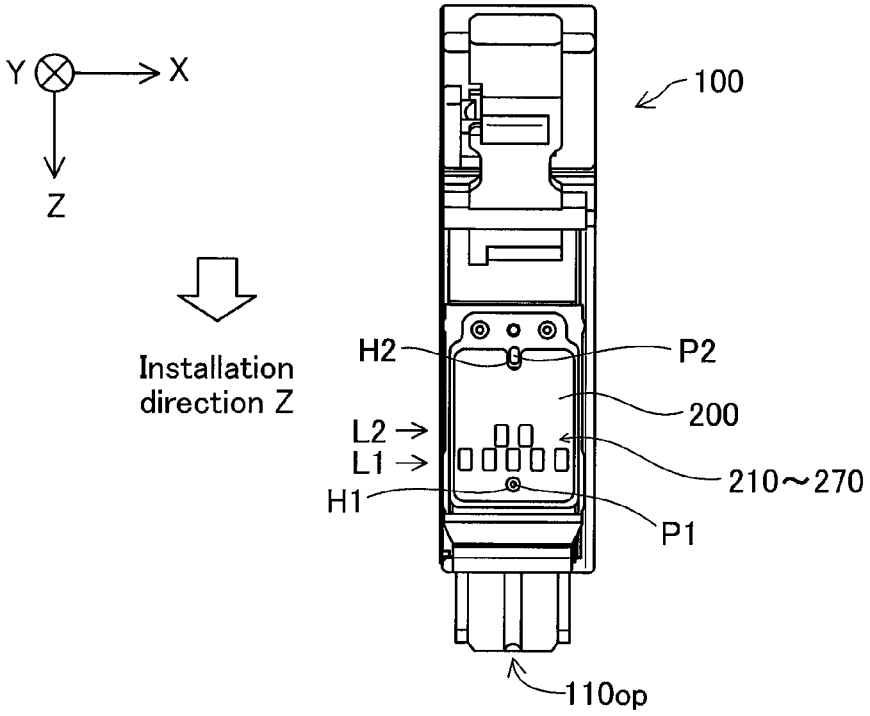
FIGS. 7A and 7B depict front views of an ink cartridge.
Figure 7B:
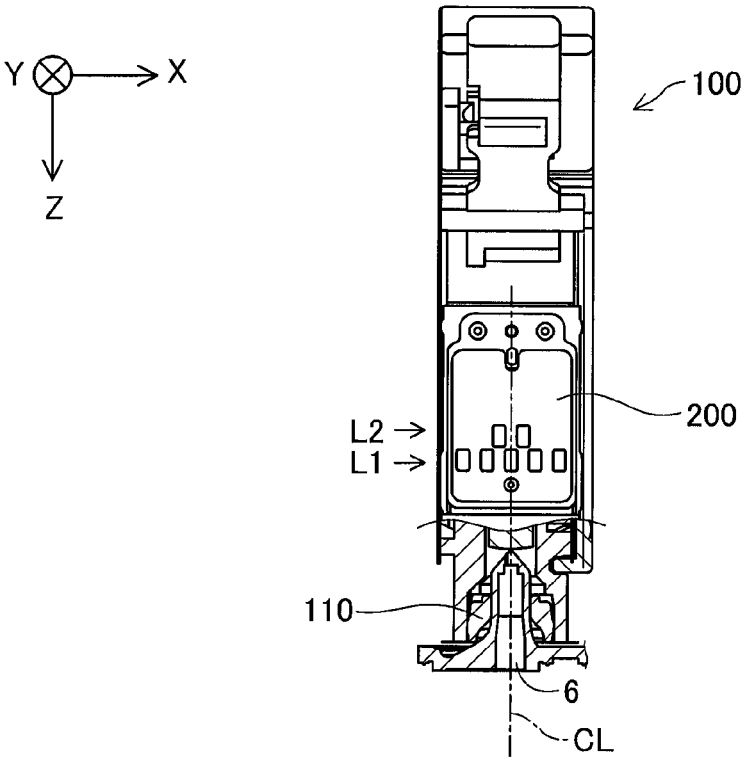

FIGS. 6A and 6B depict perspective views of the ink cartridge 100, and FIGS. 7A and 7B depict front views of the ink cartridge 100. The X, Y, and Z directions in the drawing indicate directions of the ink cartridge 100 installed on the carriage 3 (FIG. 4). The +Z direction face of the ink cartridge 100 (the face perpendicular to the Z direction, which is also the base wall 101*wb* in FIG. 6A) faces the base wall 4*wb* of the carriage 3. The −Y direction face of the ink cartridge 100 (the face perpendicular to the Y direction, which is also the front wall 101*wf* in FIG. 6A) faces the contact mechanism 400 of the carriage 3.

The ink cartridge 100 includes a housing 101, a sensor 104, and a circuit board 200. An ink chamber 120 for holding ink is formed in the interior of the housing 101. The sensor 104 is secured to the inside of the housing 101. The housing 101 includes a front wall 101*wf* (−Y direction wall), a base wall 101*wb* (+Z direction wall), and a back wall 101*wbk* (+Y direction wall). The front wall 101*wf* intersects (in the present embodiment, at a substantially right angle) the base wall 101*wb*. The circuit board 200 is secured to the front wall 101*wf*. Terminals 210 to 270 are disposed on the outside surface of the circuit board 200 (the face that faces the contact mechanism 400 (FIG. 4) of the printer 1000). An ink delivery port 110 is positioned at a location in the base wall 101*wb* that is closer to the front wall 101*wf* than to the back wall 101*wbk* (i.e., the +Y direction wall), which faces the front wall 101*wf*.

Two projections P1, P2 are formed on the front wall 101*wf*. These projections P1, P2 project out in the −Y direction. A hole H1 and a notch H2 adapted to respectively receive these projections P1, P2 are formed in the circuit board 200. The projections P1, P2, the hole H1, and the notch H2 function as mispositioning preventive portions for preventing mispositioning during the process of mounting the circuit board onto the ink cartridge. The hole H1 is located in the center of the bottom edge (the +Z direction edge) of the circuit board 200, and the notch H2 is located in the center of the top edge (the −Z direction edge) of the circuit board 200. The projections P1, P2 pass respectively through the hole H1 and the notch H2 when the circuit board 200 is in a mounted state on the front wall 101*wf*. Mispositioning of the circuit board 200 on the front wall 101*wf* is limited through contact of the hole H1 with the projection P1 and contact of the notch H2 with the projection P2. After the circuit board 200 is mounted on the front wall 101*wf*, the tips of these projections P1, P2 are collapsed. Specifically, the tips of these projections P1, P2 are collapsed by applying heat so that the projections P1, P2 and the circuit board become intimately attached through thermal swaging. The circuit board 200 is thereby secured to the front wall 101*wf*.

Additionally, a mating projection 101*e* is disposed on the front wall 101*wf*. Through mating of the mating projection 101*e* and the holder 4 (FIG. 4), the ink cartridge 100 is prevented from inadvertently detaching from the holder 4.

An ink delivery port 110 which functions as the recording material delivery port is formed in the base wall 101*wb*. The ink delivery port 110 communicates with the ink chamber 120. The ink delivery port 110 and the ink chamber 120 as a whole will be termed the "ink receptacle section 130". The opening 110*op* of the ink delivery port 110 is sealed by a film 110*f*. This prevents ink from leaking out from the ink delivery port 110. By installing the ink cartridge 100 on the carriage 3 (FIG. 4), the seal (film 110*f*) is punctured and the ink delivery needle 6 is inserted through the ink delivery port 110. The ink which is contained in the ink chamber 120 (FIG. 6A) is delivered to the printer 100 through the ink delivery needle 6. The centerline CL depicted in FIG. 7B indicates the center axis of the ink delivery port 110. With the ink cartridge 100 correctly installed (i.e. not mispositioned) on the carriage 3, the centerline CL aligns with the center axis of the ink delivery needle 6. The ink cartridge 100 corresponds to an ink delivery system (or more generally, to a recording material delivery system).

Figure 8:
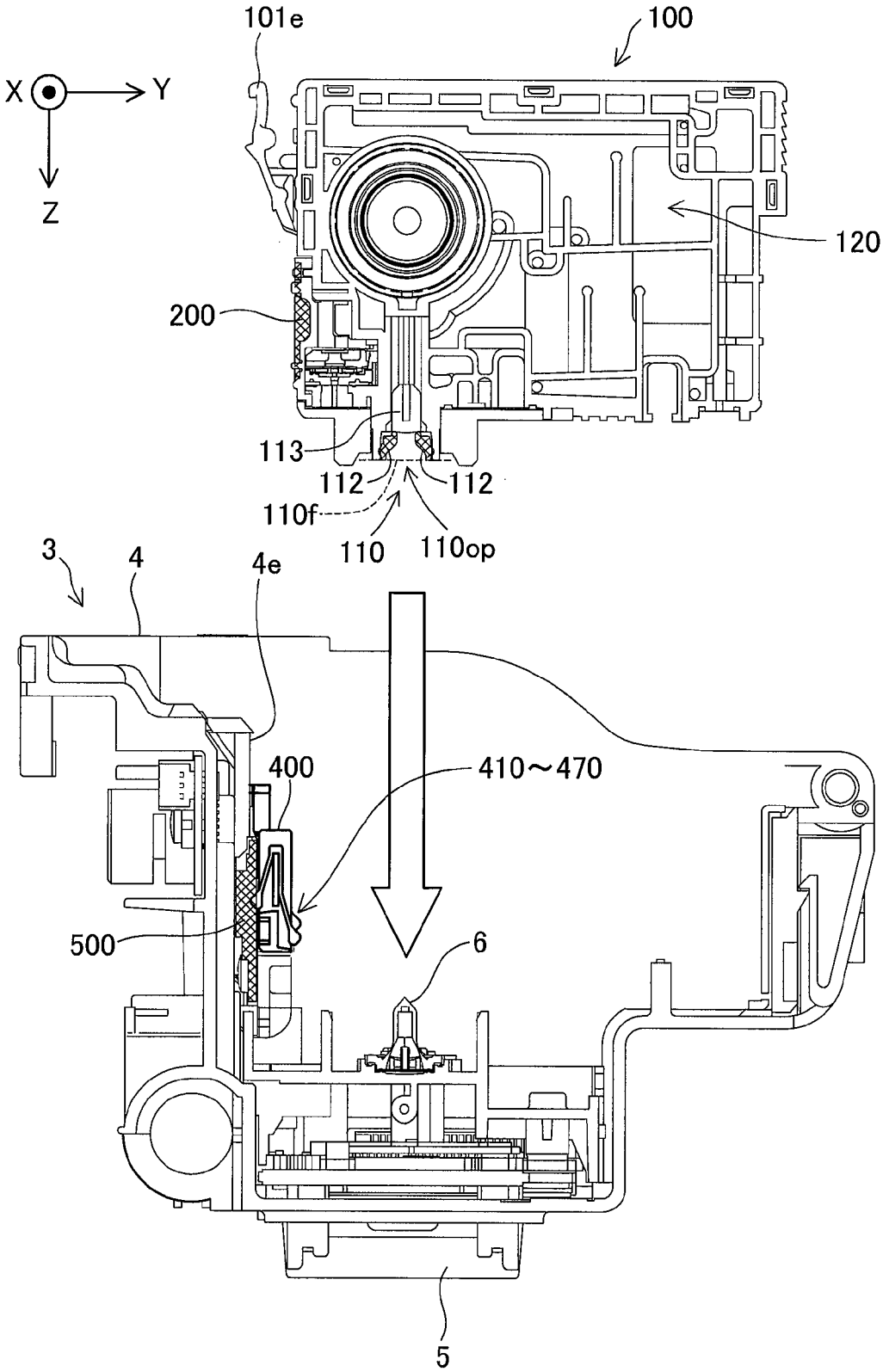
FIG. 8 is an illustration depicting installation of an ink cartridge into a carriage.
Figure 9:
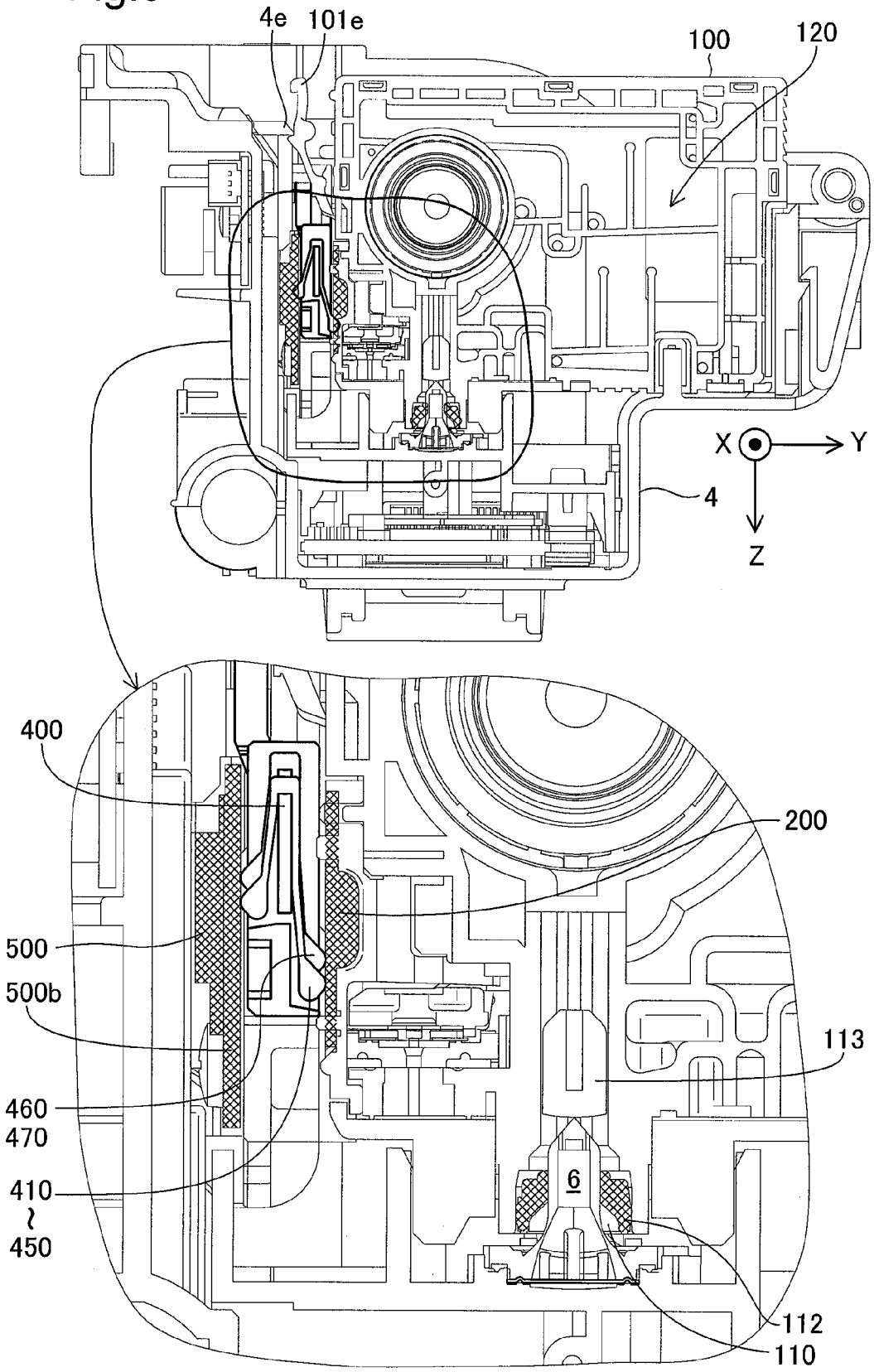
FIG. 9 is an illustration depicting the ink cartridge installed in the carriage.

FIG. 8 is an illustration depicting installation of the ink cartridge 100 into the carriage 3. FIG. 9 is an illustration depicting the ink cartridge 100 installed in the carriage 3. In these drawings, the ink cartridge 100 and the carriage 3 are depicted in cross section. This cross section is perpendicular to the X direction.

During installation of the ink cartridge 100, first, the ink cartridge 100 is oriented in the upward direction of the holder 4 (the −Z direction) so that the ink delivery port 110 faces the ink delivery needle 6. The ink cartridge 100 is then installed in the holder 4 by moving the ink cartridge 100 in the installation direction Z. By so doing, the mating projection 101*e* of the ink cartridge 100 mates with a mating projection 4*e* of the holder 4. The ink delivery needle 6 inserts into the ink delivery port 110. A ring-shaped seal member 112 is disposed in the opening 110*op* of the ink delivery port 110. The seal member 112 is made of elastic material such as rubber, and is designed to contact the ink delivery needle 6 and prevent ink leakage. In this way, the seal member 112 defines a contact section between the ink delivery port 110 (opening Hoop) and the ink delivery needle 6.

As depicted in FIG. 8, a valve element 113 is situated to the upstream side of the seal member 112. This valve element 113 is urged towards the seal member 112 by a spring, not shown. When the ink cartridge 100 is detached from the holder 4, the valve element 113 comes into contact with the seal member 112 and provide closure to the ink delivery port 110. Thus, there is reduced likelihood of ink leaking from the ink delivery port 110, even if the ink cartridge 100 is detached from the holder 4 after the ink cartridge 100 is installed in the holder 4 and the film 110*f* ruptured.

With the ink cartridge 100 installed in the holder 4 as depicted in FIG. 9, the contact mechanism 400 is situated in the forward direction (−Y direction) of the circuit board 200. A board 500*b* is positioned in the −Y direction of the contact mechanism 400. The carriage circuit 500 is mounted onto the board 500*b*. The terminals 210 to 270 of the circuit board 200 are electrically connected respectively to the terminals 510 to 570 of the carriage circuit 500 by the contact mechanism 400 (discussed in detail later). The installation direction Z corresponds to the installation direction during installation (connection) of the circuit board 200 in the printer 1000.

When the ink cartridge 100 is installed in the holder 4, the ink delivery needle 6 pushes the valve element 113 upward so that the valve element 113 separates from the seal member 112. The ink chamber 120 and the ink delivery needle 6 thereby communicate, making it possible for the ink inside the ink chamber 120 to be delivered to the printer 1000.

Figure 10A:
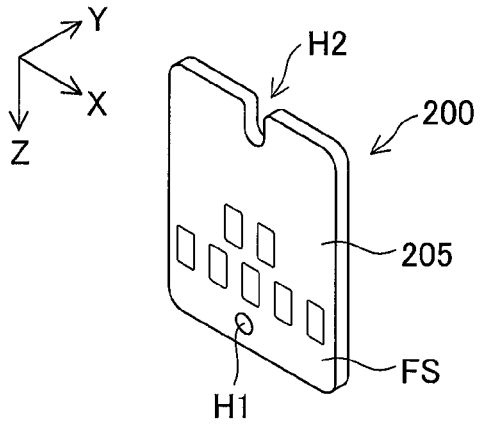
FIGS. 10A-10E are perspective views of a circuit board.
Figure 10B:
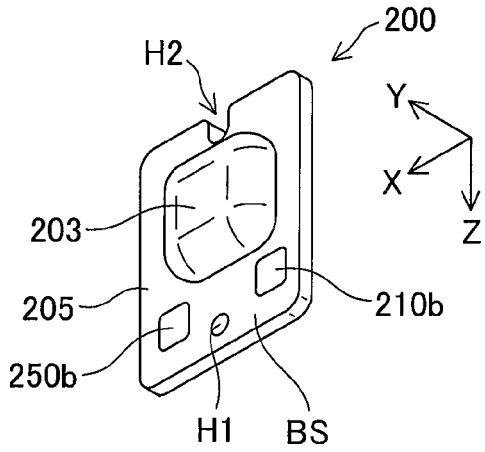
Figures 10C, 10D, 10E:
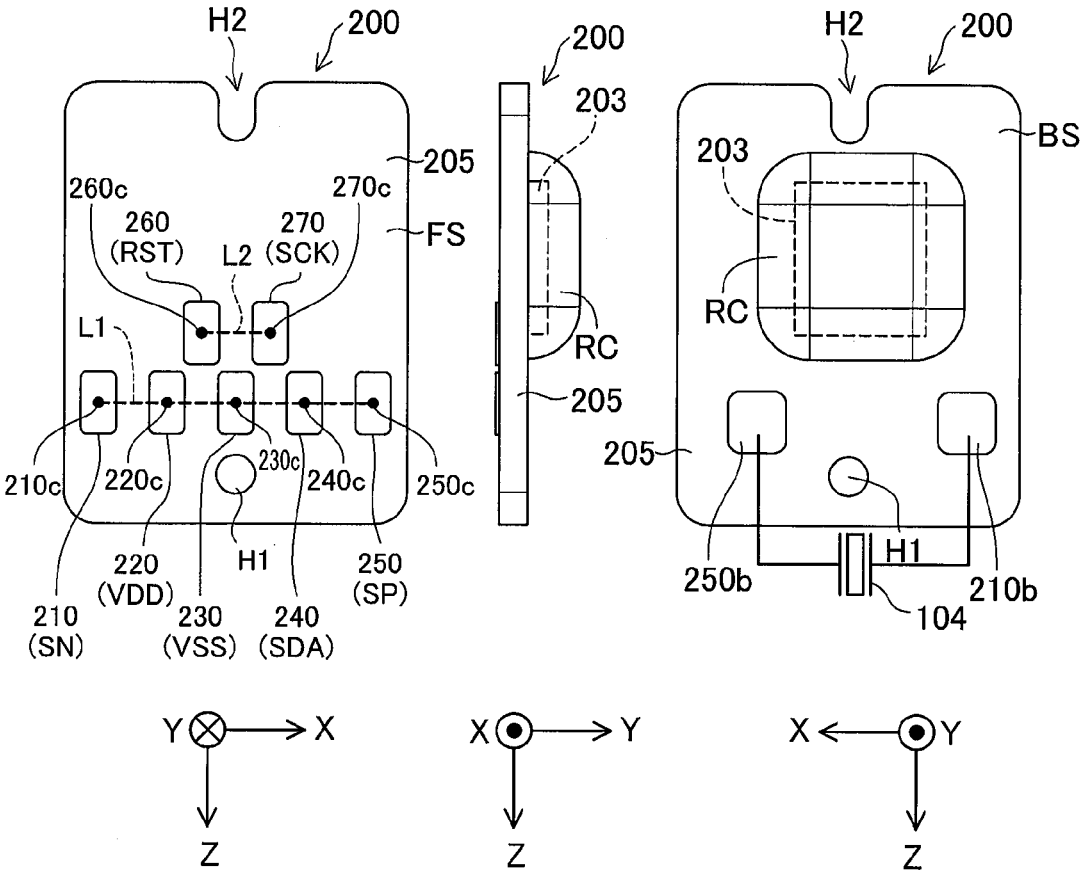

FIGS. 10A and 10B are perspective views of the circuit board 200. FIG. 10C shows a front view of the circuit board 200 looking along the Y direction (from −Y towards +Y); FIG. 10D shows a side view of the circuit board 200 looking along the −X direction (from +X towards −X); and FIG. 10E shows a back view of the circuit board 200 looking along the −Y direction (from +Y towards −Y). The X, Y, and Z directions in the drawing indicate directions with the ink cartridge 100 installed in the carriage 3 (FIG. 4).

In the circuit board 200, the terminals 210 to 270 and the memory device 203 are arranged on a board 205 which is an insulator. The board 205 includes the memory device 203 disposed on the back side BS of the board 205, and the terminals 210 to 270 disposed on the front side FS of the board 205. The board 205 is a flat board perpendicular to the Y direction, the shape thereof being generally rectangular with sides parallel to the X direction and sides parallel to the Z direction. The front side FS indicates the surface lying toward the front direction (the −Y direction), while the back side BS indicates the surface lying toward the rear direction (the +Y direction). The hole H1 and the notch H2 are formed in the board 205. The terminals 220, 230, 240, 250, 260, 270 are respectively connected to the pads Pvdd, Pvss, Psda, Prst, Psck (FIG. 3) of the memory device 203 by electrically conducting paths, not shown. The electrically conducting paths may include, for example, a through-hole bored through board 205, an electrically conducting pattern formed on the surface or interior of the board 205, and a bonding wire that connects the conducting pattern with the pad of the memory device 203. In the present embodiment, the surface of the memory device 203 on the board 205 is coated with a resin RC.

FIG. 10C depicts the front side FS of the circuit board 200. The seven terminals 210 to 270 are respectively formed to have generally rectangular shape. These terminals 210 to 270 are arranged so as to form two straight lines L1, L2 that extend along the X direction (from −X towards +X) perpendicular to the installation direction Z of the ink cartridge into the holder 4. The first line L1 represents a hypothetical straight line (segment) substantially perpendicular to the installation direction Z and formed or defined by a plurality of contact portions 210*c* to 250*c* that include a contact portion 210*c* whereby the first sensor 210 contacts the contact member 410, and a contact portion 250*c* whereby the second sensor 250 contacts the contact member 450. The second line L2 represents a hypothetical straight line (segment) substantially perpendicular to the installation direction Z and formed or defined by a contact portion 260*c* whereby the reset terminal 260 contacts the contact member 460, and a contact portion 270*c* whereby the clock terminal 270 contacts the contact member 470. The first line L1 is positioned to the leading side, or front side, in relation to the installation direction Z (i.e. the leading side with respect to the other line (here, the second line L2) in the direction of movement during installation). With the ink cartridge 100 (FIGS. 8, 9) installed correctly (i.e. with no position gap) in the holder 4, the straight line that, of this plurality of straight lines is the one lying closest towards the ink delivery port 110 (the opening 110*op*) is the first line L1. The terminals having the contact portions that form the first line L1 are, in order from the left in the drawing (the edge in the −X direction), the first sensor terminal 210, the power terminal 220, the ground terminal 230, the data terminal 240, and the second sensor terminal 250. The terminals that form the second line L2 are, order from the left in the drawing, the reset terminal 260 and the clock terminal 270. The two terminals 210, 250 may be omitted. In this case, the terminals of the contact portions that make up the first line L1 would include three of the terminals that connect with the memory device 203, namely, the power terminal 220, the ground terminal 230, and the data terminal 240. As in this example, the first line L1 may be formed by the terminal contact portions of some or all the terminals that connect with the memory device 203.

FIG. 10E depicts the back side BS of the circuit board 200. Two terminals 210*b*, 250*b* are formed on the back side BS. These terminals 210*b*, 250*b* respectively have electrical continuity with the terminals 210, 250 on the front side FS. One of the electrodes of the sensor 104 is connected to the terminal 210*b*, and the other electrode of the sensor 104 is connected to the terminal 250*b*.

Figure 11B:
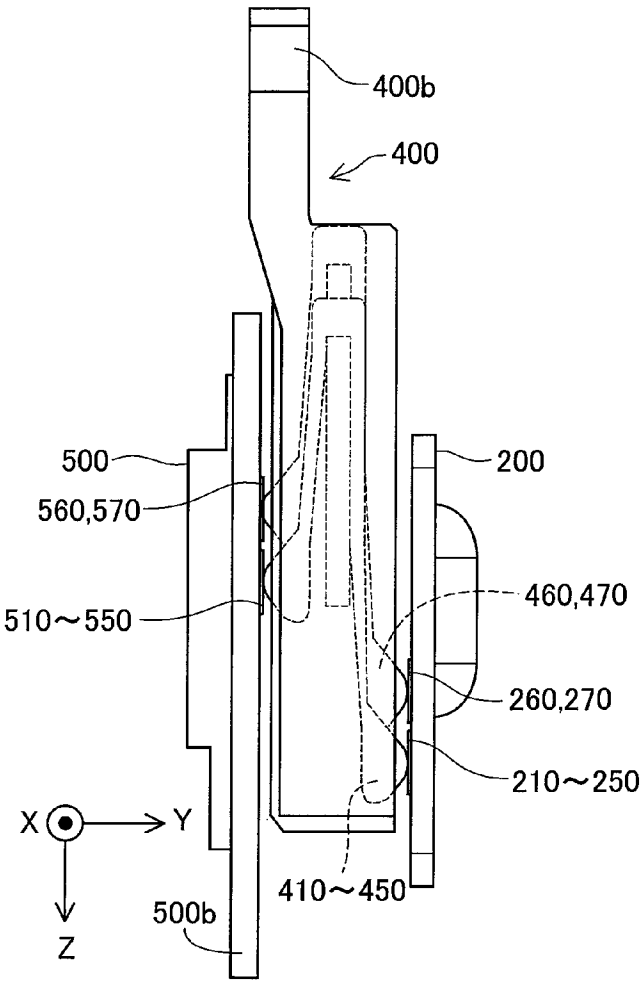
FIGS. 11A and 11B illustrate a contact mechanism.
Figure 11A:
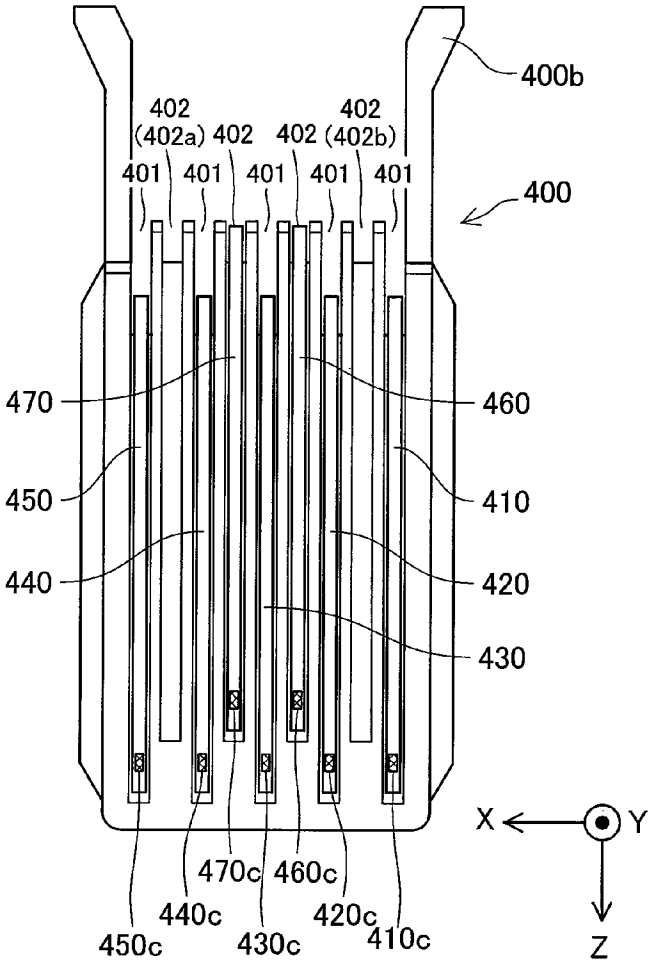
Figure 12:
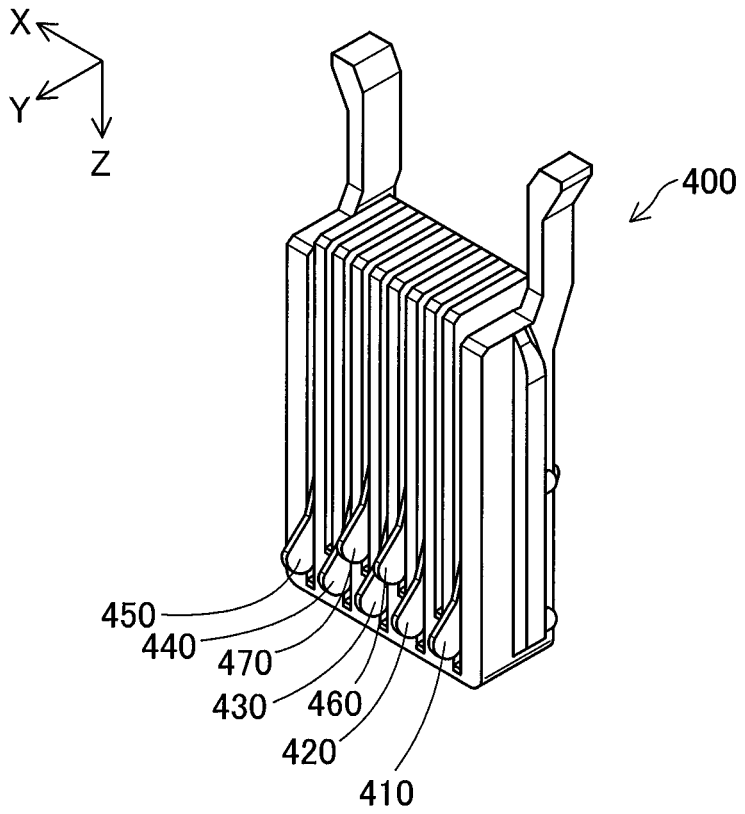
FIG. 12 is a perspective view of a contact mechanism.

FIG. 11A is a rear view of the contact mechanism 400 looking along the −Y direction (from +Y towards −Y); and FIG. 11B is a side view of the contact mechanism 400 looking along the −X direction (from +X towards −X). FIG. 12 is a perspective view of the contact mechanism 400. The contact mechanism 400 includes a support member 400*b* and seven contact members 410 to 470. In the support member 400*b* there are formed first slits 401 and second slits 402 lying side by side along the X direction (from −X towards +X). The second slits 402 are shifted towards the −Z direction with respect to the first slits 401. The contact members 410 to 470 respectively lie recessed within these slits 401, 402 so as to correspond with the terminals 210 to 270 of the circuit board 200 (FIG. 10C). The contact members 410 to 470 each possess electrical conductivity and resilience. The second slit 402*a* on the +X side and the second slit 402*b* on the −X side are not used and may be omitted.

As shown in FIG. 11B, the contact members 410 to 470 at a one end thereof project out towards the +Y direction from the support member 400*b*. This projecting first end is urged towards the circuit board 200 so as to contact a corresponding terminal among the terminals 210 to 270 of the circuit board 200. FIG. 11A depicts the portions 410*c* to 470*c* in the contact members 410 to 470, that contact the terminals 210 to 270. These contact portions 410*c* to 470*c* function as device-side terminals providing electrical connections between the printer 1000 and the terminals 210 to 270 of the circuit board 200. Herein, these contact portions 410*c* to 470*c* will also be referred to as the device-side terminals 410*c* to 470*c*.

Meanwhile, as shown in FIG. 11B, the contact members 410 to 470 at the other end thereof project out towards the −Y direction from the support member 400*b*. This projecting other end is urged towards the board 500*b* so as to contact a corresponding terminal among the terminals 510 to 570 on the board 500*b* (the terminals 510 to 570 of the carriage circuit 500). While omitted from the drawing, the terminals 510 to 570 of the carriage circuit 500 are arranged similarly to the terminals 210 to 270 shown in FIG. 10C. These terminals 510 to 570 are formed on the carriage circuit 500*b* on the face thereof facing towards the contact mechanism 400.

FIGS. 13A-13E illustrate contact between the contact members 410 to 470 and the terminals 210 to 270 with the ink cartridge 100 (FIG. 8) in the installed state. FIGS. 13A to 13E show the contact mechanism 400 and the circuit board 200 looking along the −X direction (from +X towards −X). During installation, the circuit board 200 moves in the installation direction Z. The positional relationship of the circuit board 200 and the contact mechanism 400 changes in the sequence illustrated in FIGS. 13A to 13E.

Figures 13A, 13B, 13C, 13D, 13E:
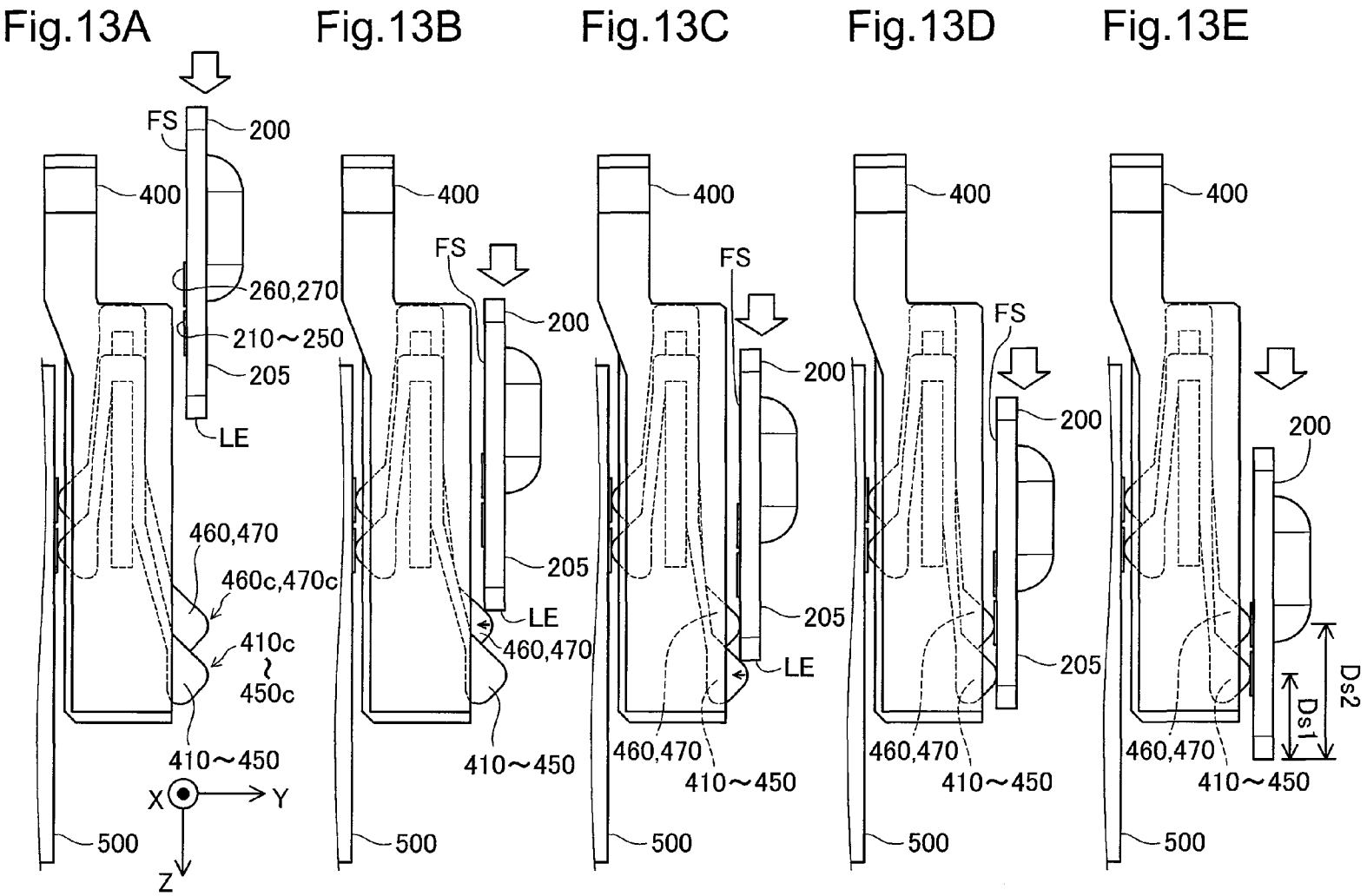
FIGS. 13A-13E illustrate contact between contact members and terminals.

First, as shown in FIG. 13B, the lower edge LE (+Z direction edge) of the board 205 of the circuit board 200 comes into contact with the two contact members 460, 470 which are positioned shifted to the −Z direction with respect to the contact members 410 to 450. Then, through movement of the board 205 in the +Z direction, the contact members 460, 470 are pushed in the −Y direction. The contact members 460, 470 have resilience, and the contact portions 460*c*, 470*c* are urged in the +Y direction. Consequently, with the contact members 460, 470 (contact portions 460*c*, 470*c*) in a state of contact with the front side FS of the board 205, the board 205 moves in the +Z direction.

Next, as shown in FIG. 13C, the lower edge LE of the board 205 comes into contact with the five contact members 410 to 450 which are positioned shifted to the +Z direction. These contact members 410 to 450 also have resilience, and the contact portions 410*c* to 450*c* are urged towards the +Y direction. Consequently, with the contact members 410 to 450 (contact portions 410*c* to 450*c*) in a state of contact with the front side FS of the board 205, the board 205 moves in the +Z direction. FIG. 13D depicts the board 205 having moved further in the +Z direction from the state shown in FIG. 13C. In the state shown in FIG. 13D, the terminal 230 has moved between the contact member 460 and the contact member 470.

Finally, as shown in FIG. 13E, installation of the ink cartridge 100 is complete. In this state, the contact members 410 to 470 (contact portions 410*c* to 470*c*) is disposed in respective contact with the terminals 210 to 270 of the circuit board 200.

In FIG. 13E, two distances Ds1, Ds2 are depicted. The first distance Ds1 indicates the distance for which the contact members 410 to 450 slide over the front sided FS of the board 205. The second distance Ds2 indicates the distance for which the contact members 460 and 470 slide over the front sided FS of the board 205. As illustrated, the first distance Ds1 is less than the second distance Ds2. Thus, for the contact members 410 to 450 that correspond to the first line L1 (FIG. 10C) which is situated at the lead position (leading side) in the installation direction Z, the distance of slide over the front side FS is shorter in comparison to the other contact members 460, 470. Consequently, in comparison to the other contact members 460, 470, foreign matter such as dust on the front side FS is less likely to become deposited on the contact members 410 to 450. That is, the likelihood of defective connections between the contact members 410 to 450 and the terminals 210 to 250 is lower as compared with the other contact members 460, 470.

The configuration described above is shared by all of the ink cartridges.

A2. Cartridge Detection

Figure 14:
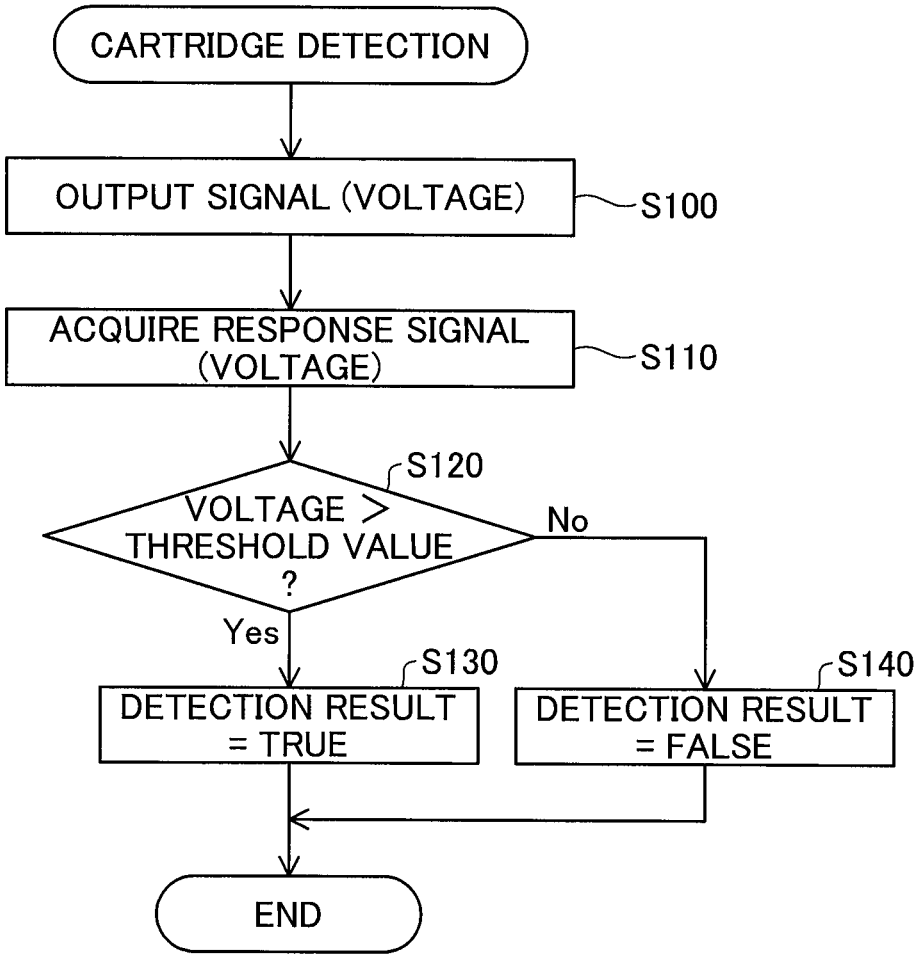
FIG. 14 is a flowchart showing the procedure of a cartridge detection process.

FIG. 14 is a flowchart showing the procedure of a cartridge detection process. This process is one by which the printer 1000 verifies whether an ink cartridge is installed. The process is executed by a cartridge detection (first) module M10 and the carriage circuit 500 (the sensor drive circuit 503, FIG. 3). The procedure of FIG. 14 is a process relating to a single ink cartridge. The first module M10 and the carriage circuit 500 executes this process respectively for all of the ink cartridges which are supposed to be installed in the holder 4 (FIG. 4). By so doing, the first module M10 verifies installation of all (six) ink cartridges. The first module M10 may carry out this process with any of various timing schemes. For example, the process may be executed on a periodic basis or when a prescribed condition is met (e.g. when the power supply of the printer 1000 is turned on, when an ink cartridge 100 is replaced, or when printing is initiated); or the process may be executed in response to a user instruction.

In the initial Step S100, the first module M10 outputs a signal (voltage) from the sensor terminals 510, 550 of the ink cartridge targeted for detection. Specifically, the first module M10 presents the cartridge detection circuit 503*a* with a signal output instruction. This instruction includes the ID number of the ink cartridge. In accordance with this instruction, the cartridge detection circuit 503*a* switches the switching circuit so that the sensor terminals 510, 550 that are associated with the ID number are selected, whereupon the selected sensor terminals 510, 550 outputs a signal (voltage). If the ink cartridge 100 is installed, voltage is applied across the two electrodes of the sensor 104. The sensor 104 is charged thereby.

In the next Step S110, the first module M10 uses the sensor terminals 510, 550 to acquire a response signal (voltage). Specifically, the first module M10 presents the cartridge detection circuit 503*a* with an instruction to acquire the signal (voltage). In accordance with this instruction, the cartridge detection circuit 503*a* ceases applying voltage and then measures the voltage across the two sensor terminals 510, 550. The cartridge detection circuit 503*a* then nitifies the first module M10 of the measured voltage.

In the next Step S120, the first module M10 decides whether the measured voltage is higher than a prescribed threshold value. If the ink cartridge 100 is installed, the voltage of the charged sensor 104 is measured. The absolute value of this measured voltage (termed the first voltage) is greater than zero. If the ink cartridge 100 is not installed, the measured voltage is substantially zero. A threshold value of between zero and the first voltage is established empirically beforehand. Consequently, if the absolute value of measured voltage is greater than the threshold value, the first module M10 decides that the ink cartridge 100 is installed (Step S130). If the absolute value of measured voltage is equal to or less than the threshold value, the first module M10 decides that the ink cartridge 100 is not installed (Step S140). The first module M10 then terminates the process.

In preferred practice, if an ink cartridge is not installed at one or more installation locations, the first module M10 executes a process relating to the uninstalled cartridge(s). Such a process could be a process of suspending printing, or a process to alert the user of the uninstalled cartridge, for example.

A3. Memory Control

Figure 15:
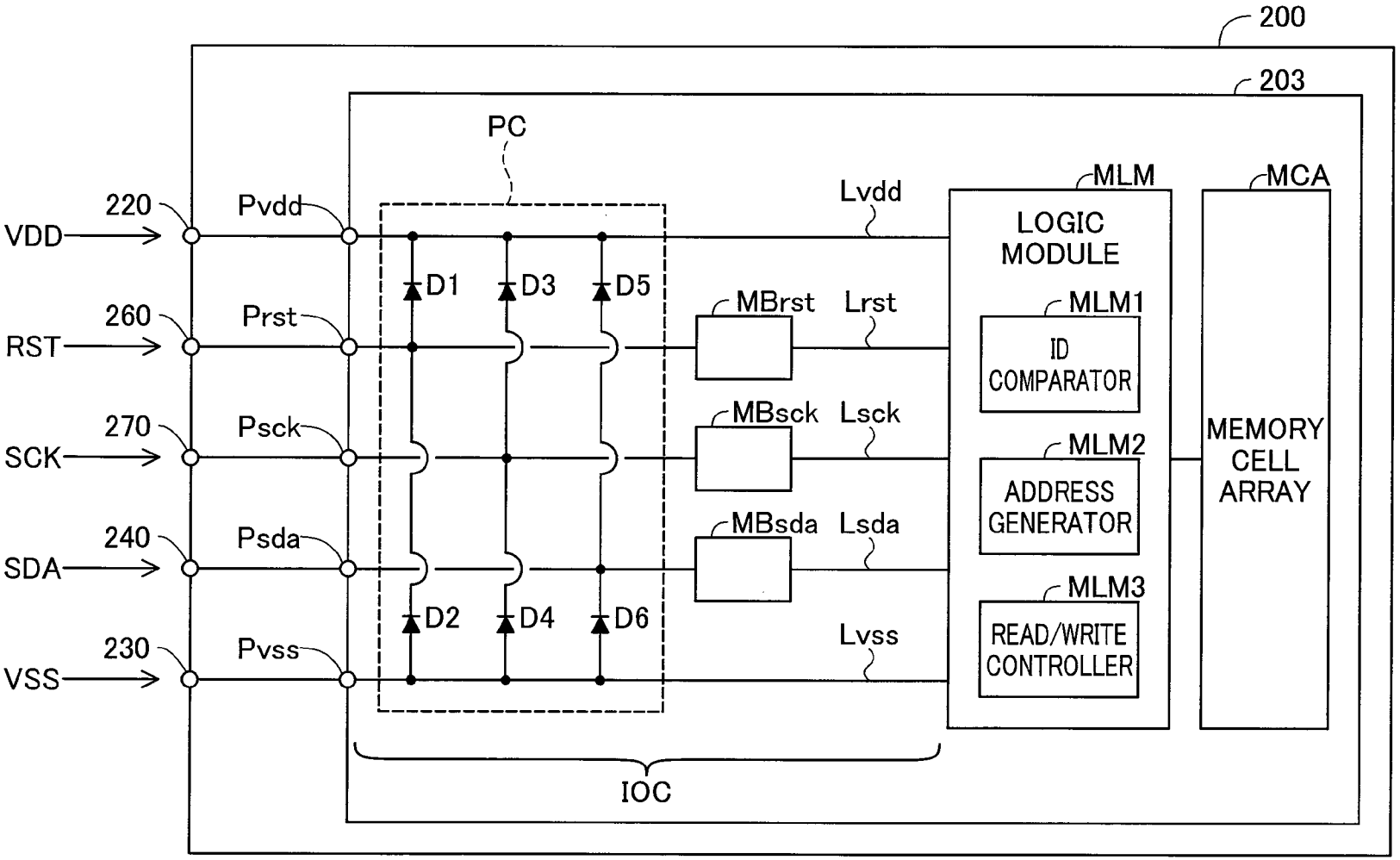
FIG. 15 is an illustration depicting the configuration of a memory device.

FIG. 15 is an illustration depicting the configuration of the memory device 203 in the present embodiment. The memory device 203 is a semiconductor chip that includes an input/output circuit IOC; a logic module MLM; a nonvolatile memory cell array MCA; and five pads (input/output terminals) Pvdd, Prst, Psck, Psda, and Pvss. The logic module MLM includes an ID comparator MLM1, an address generator MLM2, and a read/write controller MLM3. In response to an instruction from an external device (for example, the controller of the printer 1000 of FIG. 3; the main control circuit 40 and the carriage circuit 500 in their entirety), the logic module MLM carries out writing of data to the memory cell array MCA, or reading of data from the memory cell array MCA (discussed in detail later). The input/output circuit IOC includes five lines Lvdd, Lrst, Lsck, Lsda, Lvss; three buffer circuits MBrst, MBsck, MBsd; and a protection circuit PC. The pads Pvdd, Prst, Psck, Psda, Pvss are respectively connected to the logic module MLM by the lines Lvdd, Lrst, Lsck, Lsda, Lvss. The power line Lvdd is a line for receiving power supply potential VDD. The reset line Lrst is a line for receiving a reset signal RST. The reset line Lrst is provided with a first buffer circuit MBrst. The clock line Lsck is a line for receiving a clock signal SCK. The clock line Lsck is provided with a second buffer circuit MBsck. The data line Lsda is a line for sending and receiving data signals SDA. The data line Lsda is provided with a third buffer circuit MBsda. The ground line Lvss is a line for receiving ground potential VSS. The pads Pvdd, Prst, Psck, Psda, Pvss are respectively connected electrically to the terminals 220, 260, 270, 240, 230 of the circuit board 200.

The protection circuit PC protects the internal circuitry of the memory device 203 (including the logic module MLM and the memory cell array MCA) from abnormal input, such as static electricity, to the pads. In the present embodiment, the protection circuit PC includes protection diodes D1 to D6. Three of these diodes D1, D3, D5 connect at the cathode to the power pad Pvdd (power line Lvdd). These diodes D1, D3, D5 connect at the anode to the pads Prst, Psck, Psda (lines Lrst, Lsk, Lsda) respectively. Three other diodes D2, D4, D6 connect at the anode to the ground pad Pvss (ground line Lvss). These diodes D2, D4, D6 connect at the cathode to the pads Prst, Psck, Psda (lines Lrst, Lsk, Lsda) respectively.

Figure 16:
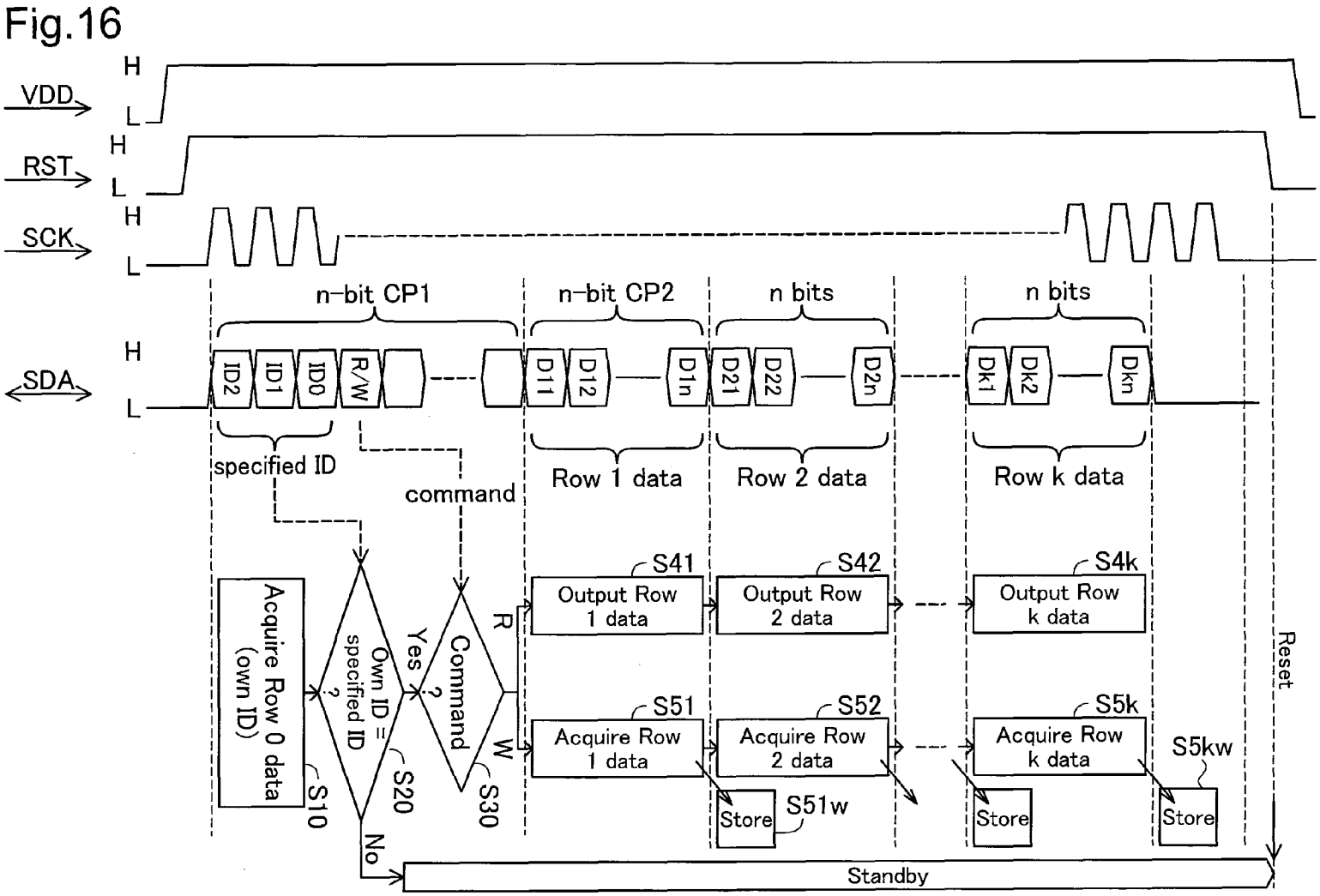
FIG. 16 is a timing chart depicting operation of a memory device.

FIG. 16 is a timing chart depicting operation of the memory device 203. In the drawing, signals (power supply potential VDD, reset signal RST, clock signal SCK, data signal SDA) appearing on the pads of the memory device 203 (FIG. 15) are shown, as are the operations of the memory device 203. In the present embodiment, both reading of data from the memory cell array MCA of the memory device 203 and writing of data to the memory cell array MCA is carried out as shown by the chart in FIG. 16. In the drawing, H level indicates high potential (about 3.3 V), while L level represents low potential (zero V); the reference for these potentials is ground potential VSS. The arrows shown below the symbols that denote the signals indicate the direction of signal (data) flow. A right-pointing arrow indicates flow from the memory control circuit 501 (FIG. 3) towards the memory device 203, while a left-pointing arrow indicates flow from the memory device 203 towards the memory control circuit 501. Data signals SDA can flow in both directions.

In the present embodiment, access to the memory device 203 (FIG. 15: memory cell array MCA) takes place by sequential access. The memory address targeted for access is updated in prescribed order from a prescribed initial address, based on the clock signal SCK. In the present embodiment, because write operations to the memory cell array and read operations from the memory cell array are carried out en bloc in row units, the memory address is an address that specifies a row. Memory cells are accessed one at a time in order starting from Row 0 of the memory cell array MCA. The data size of a single row (corresponding to one word) is n bits (n is a integer equal to 1 or greater, e.g., n=32). The address generator MLM2 updates the memory address targeted for access in the order Row 0, Row 1, Row 2 . . . , doing so each time that n pulses of the clock signal SCK are received. The ID number of the memory device 203 is stored in advance in Row 0. In the present embodiment, the ID number is represented on three bits. Physical locations on the memory array of the rows need not have the same order as the access sequence of the rows.

When the memory device 203 (FIG. 15) is to be accessed, the memory control circuit 501 (FIG. 3) first sets the power supply potential VDD to H level. Next, the control circuit 501 sets the reset signal RST to H level. In the present embodiment, under conditions with the reset signal RST at H level (a prescribed level different from ground potential VSS), the memory device 203 operates in sync with the clock signal SCK. If the reset signal RST is at a level other than H level (e.g., at the same potential as ground potential VSS), the memory device 203 suspends operation. The memory control circuit 501 can reset all memory device operations by subsequently changing the reset signal RST from H level to L level (discussed in detail later).

Next, the memory control circuit 501 (FIG. 3) presents the clock signal SCK to the clock terminal 270 of the circuit board 200 (FIG. 15). In sync with the clock signal SCK, the memory control circuit 501 presents a data signal SDA of n bits to the data terminal 240. The first three bits of this n-bit data represent the ID number of the memory device 203 targeted for access. The next one bit represents a command. The command is either data read (R) or a data write (W); for example, L level represents R and H level represents W. The remaining bits are dummy data.

During the interval that the initial n clock pulses CP1 are received, the logic module MLM (FIG. 15) executes the following process. The address generator MLM2 (FIG. 15) generates a memory address representing Row 0. The read/write controller MLM3 reads the generated address data (Row 0 data) from the memory cell array MCA (FIG. 16: Step 10). Next, the ID comparator MLM1 decides whether its own ID number which is read out from the memory cell array MCA is the same as the ID number that is specified by the memory control circuit 501 (FIG. 3) (Step S20). If its own ID number is different from the specified ID number, the logic module MLM suspends processing and transition to an operating mode (standby mode) in which the reset signal is monitored. If its own ID number is the same as the specified ID number, the logic module MLM proceeds with processing. By switching processes depending on ID number, the memory device 203 that is specified by the memory control circuit 501 executes processes according to the instruction of the memory control circuit 501. In the next Step S30, the read/write controller MLM3 decides whether the command that is specified by the data signal SDA is a data read (R) or a data write (W). After having received the initial n clock pulses, the logic module MLM initiates a process according to the command.

In the case of a data read command, the logic module MLM (FIG. 15) executes the process of Steps S41 to S4*k* in sync with the clock signal SCK. As noted previously, the address generator MLM2 (FIG. 15) increments the memory address one row at a time starting from Row 0, each time that n clock pulses are received. The read/write controller MLM3 then reads from the memory cell array MCA the address data that is specified by the address generator MLM2. The read/write controller MLM3, using a data signal SDA, then outputs the read data one bit at a time in sync with the clock signal SCK. For example, in accordance with the second n clock pulses CP2, the read/write controller MLM3 outputs the data of Row 1 (S41). In more detail, at the time of the initial clock pulse of the second n clock pulses CP2, the read/write controller MLM3 reads Row 1 of the memory cell array, and in sync with each clock pulse of the n clock pulses CP2 outputs the data of the read n bits to the memory control circuit 501. The memory control circuit 501 (FIG. 3), operating in sync with the clock signal SCK, receives one bit at a time the data of Row 1 to Row k (k is an integer equal to or greater than 1) that is stored in the memory cell array MCA. In the embodiment of FIG. 16, after having received the data of Row k, the memory control circuit 501 ceases to present the clock signal SCK.

In the case of a data write (W) command, the logic module MLM (FIG. 15) executes the process of Steps S51 to S5*k* in sync with the clock signal SCK. The memory control circuit 501 (FIG. 3), utilizing a data signal SDA and operating in sync with the clock signal SCK, presents the logic module MLM one bit at a time with data to be stored in the memory array MCA. The read/write controller MLM3 then stores the received data in the memory cell array MCA, at the address that is specified by the address generator MLM2. For example, in sync with the second n clock pulses CP2, the read/write controller MLM3 stores the received data in Row 1 of the memory cell array MCA (S51, S51*w*). In the embodiment of FIG. 16, after having stored the data in the memory cells of Row k (S5*kw*), the memory control circuit 501 ceases to present the clock signal SCK.

As will be discussed later, there is a possibility that the position of an ink cartridge 100 may deviate from the correct position inside the holder 4. Such mispositioning could theoretically lead to the data terminal 240 of the circuit board 200 (FIG. 2) becoming separated from the contact member 440 of the contact mechanism 400. At this point, if the power supply potential VDD, the reset signal RST, and the clock signal SCK are being presented in normal fashion to the memory device 203 (FIG. 15), the logic module MLM might write data according to the potential of the data line Lsda (i.e. erroneous data) to the memory cell array MCA (the potential of the data line Lsda might be the same as that of the ground line Lvss, for example) The memory device 203 may also malfunction or become inoperable for various other reasons not limited to the above (discussed in detail later).

After suspending presentation of the clock signal SCK, the memory control circuit 501 (FIG. 3) changes the reset signal RST from H level to L level. By so doing, all of the memory devices 203 resets their own operations. Specifically, the address generator MLM2 resets the memory address to Row 0. When the logic module MLM receives the next reset signal RST (H level), clock signal SCK, and data signal SDA, it executes the process beginning from Step S10 of FIG. 16. After the memory control circuit 501 sets the reset signal RST to L level the power supply potential VDD is set to L level. By so doing, all of the memory devices 203 suspends operations.

The memory control circuit 501 (FIG. 3) operates according to instructions of the memory control (third) module M30. The third module M30 accesses the memory device 203 of each of the six ink cartridges 100 which are installed in the holder 4 (FIG. 4). As the information which is stored in the memory devices 203, it is possible to employ information of various kinds relating to the inks contained in the ink cartridges 100. For example, the information may represent type of ink. The third module M30 may also read out the ink type information from the memory devices 203 and verify that the proper ink cartridges are installed. Ink consumption level (e.g. the number of dots) since an ink cartridge is installed in the printer 1000 may also be used. The third module M30 may also periodically update the ink consumption level stored in the memory device 203, doing so during printing, after carrying out nozzle cleaning, when the user instructs power-down of the printer 1000, etc. By so doing the third module M30 is able to estimate remaining ink level by reading the ink consumption level from the memory device 203. The third module M30 may access the memory devices 203 under various timing schemes.

B. Features of the Embodiment

Embodiment 1 described above has various features. These features are discussed below.

B1. Feature 1

The present embodiment has the following feature; the contact portion 220*c* of the power supply terminal 220 that presents the power supply potential VDD to the memory device 203 is situated in the first straight line L1 (FIG. 10C). The memory device 203 receives the power supply potential VDD via the contact portion 220*c* of the power supply terminal 220.

The first straight line L1 is positioned at the leading position (the leading side) with respect to the other straight line (in the present embodiment, the second straight line L2). The leading position indicates the leading position with the ink cartridge 100 oriented for installation in the printer 1000. That is, the leading position (the leading side) represents the leading position (the leading side) in the installation direction Z.

Figure 17B:
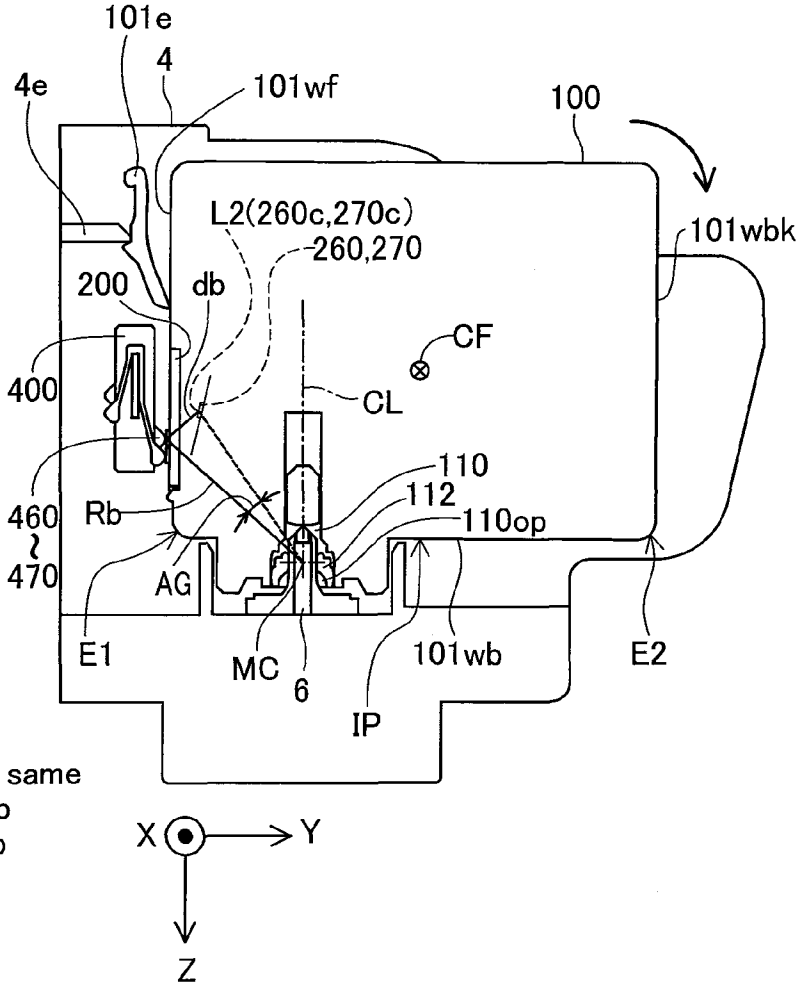
FIGS. 17A and 17B illustrate movement of an installed ink cartridge within a holder.
Figure 17A:
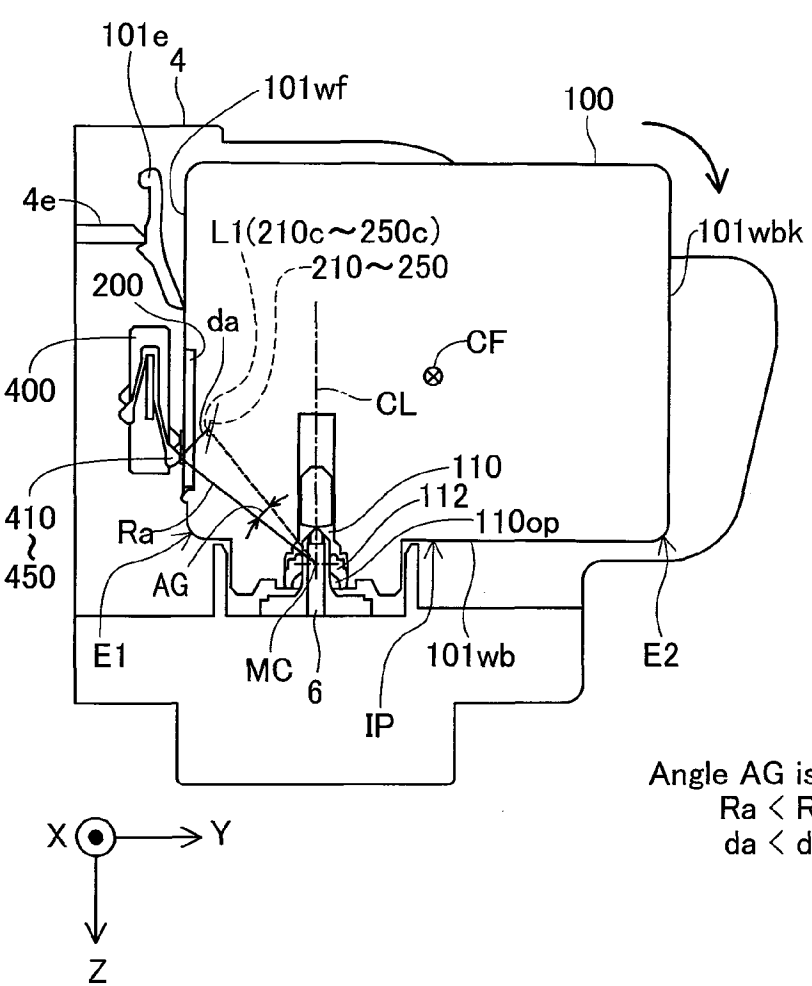

The advantages of this will be discussed next. FIGS. 17A and 17B illustrate mispositioning of an installed ink cartridge 100 within the holder 4. FIG. 17A and FIG. 17B depict the ink cartridge 100 and the holder 4 in cross section (cross section perpendicular to the X direction). The ink delivery needle 6 of the holder 4 is inserted into the ink delivery port 110 of the ink cartridge 100. Consequently, the ink delivery port 110 of the ink cartridge 100 is secured to the ink delivery needle 6 of the holder 4. As a result, the ink cartridge 100 may experience rocking motion about the ink delivery port 110. At the opening 110*op* of the ink delivery port 110, the seal member 112 is in contact with the ink delivery needle 6. Consequently, the center of motion MC of the ink cartridge 100 is situated on the centerline CL, in proximity to the section of contact between the seal member 112 and the ink delivery needle 6.

FIG. 17A and FIG. 17B depict the ink cartridge 100 inclined towards the +Y direction with respect to the Z axis. Such an inclined condition could arise for various reasons. For example, during installation of the ink cartridge 100 in the holder 4 (printer 1000), the user may inadvertently install the ink cartridge 100 in the holder 4 in an inclined condition. Also, because the centroid CF of the ink cartridge is situated to the +Y side with reference to the centerline CL, the terminals 210 to 270 of the ink cartridge are prone to incline in the direction away from the contact members 410 to 470.

FIG. 17A depicts the travel distance da of the contact portions 210*c* to 250*c* of the first line L1. The angle AG in the drawing indicates incline (angle of rotation) of the ink cartridge 100 centered about the ink delivery port 110. The first distance Ra indicates the distance between the ink delivery port 110 (the center of rotation MC) and the contact portions 210*c* to 250*c*.

FIG. 17B depicts the travel distance db of the contact portions 260*c*, 270*c* of the second line L2. The second distance Rb indicates the distance between the ink delivery port 110 (the center of rotation MC) and the contact portions 260*c*, 270*c*. The angle of rotation of the ink cartridge 100 is the angle AG, the same as in FIG. 17A.

If the angle AG is large, the contact portions 210*c* to 270*c* may separate from the contact members 410 to 470. Here, the first line L1 is less likely to separate from the contact members than is the second line L2. The reason is as follows. In the present embodiment, the opening 110*op* is situated further towards the installation direction Z side as compared with the plurality of contact portions 210*c* to 270*c* of the plurality of terminals 210 to 270 (FIGS. 7, 17). The first line L1 is positioned to the leading side in the installation direction Z with respect to the other line (in the present embodiment, the second line L2; it can also be stated that in the present embodiment, of the plurality of lines, the first line L1 is the line that is closest to the opening 110*op* (FIG. 7). That is, the first distance Ra is shorter than the second distance Rb. Here, for a given angle AG, the distance between the first line L1 and the contact members 410 to 450 (the first distance da) is shorter than the distance between the second line L2 and the contact members 460, 470 (the second distance db). The feature of the opening 110*op* being situated further towards the installation direction Z side as compared with the contact portions 210*c* to 270*c* means that, in relation to locations in the direction parallel to the installation direction Z, the location of the opening 110*op* lies further towards the installation direction Z side as compared with the respective locations of the contact portions 210*c* to 270*c*.

Figure 18:
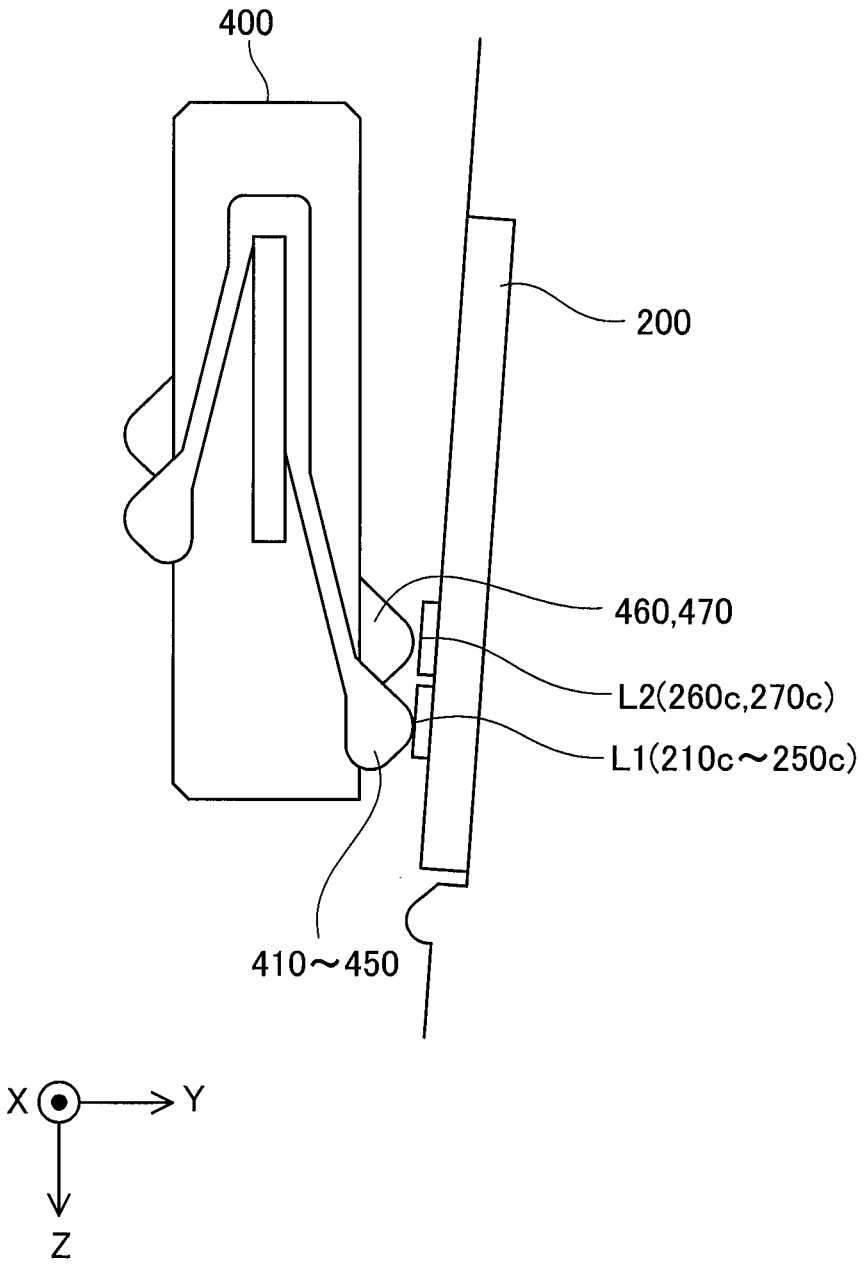
FIG. 18 is an enlarged view of the vicinity of the contact portions.

FIG. 18 is an enlarged view of the vicinity of the contact portions 210*c* to 270*c*. FIG. 18 depicts an ink cartridge 100 in an inclined condition similar to FIG. 17A and FIG. 17B. As shown, as the angle AG increases, the second line L2 separates from the contact members before the first line L1 does.

In this way, of the plurality of lines L1, L2 of the circuit board 200, the line that is least likely to experience defective connections with contact members is the first line L1. Consequently, in preferred practice, of the plurality of contact portions provided to the circuit board 200, those contact portions having the potential to cause severe problems due to defective connections are situated in the first line L1. Accordingly, in the present embodiment, the contact portion 220*c* for power supply potential VDD is situated in the first line L1 (FIG. 10C).

Figure 19:
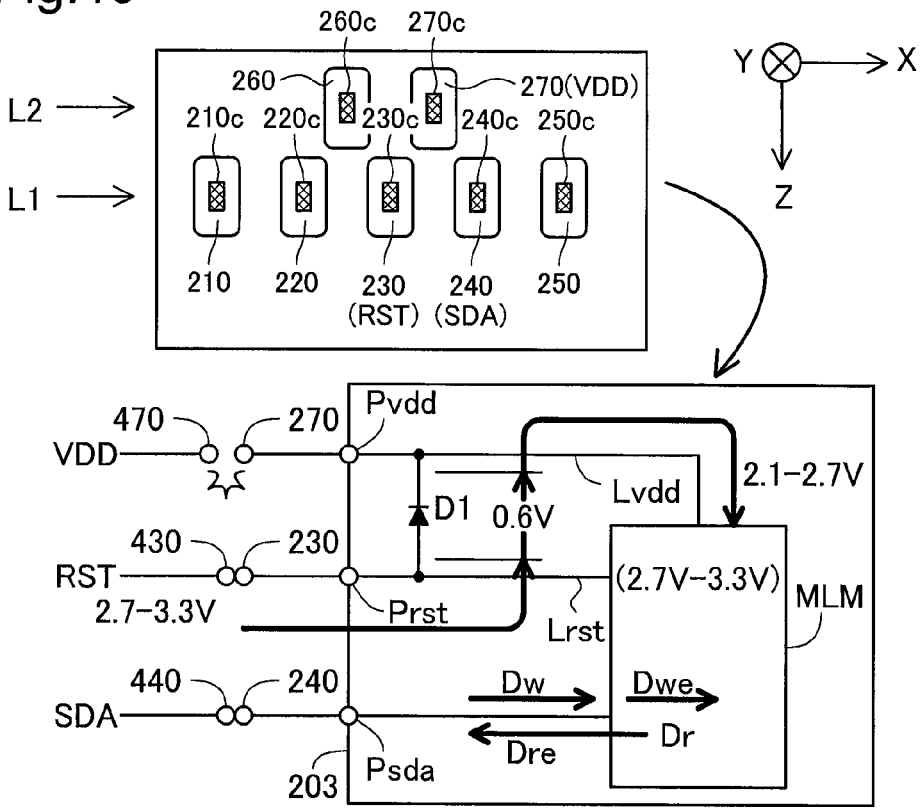
FIG. 19 is an illustration depicting a comparative example.

FIG. 19 is an illustration depicting a comparative example. In the drawing, the terminals 210 to 270 of the circuit board and the memory device 203 are shown. In the configuration depicted in FIG. 19, the contact portion for power supply potential VDD is situated in the second line L2 (contact portion 270*c*), while the contact portion for the reset signal RST and the contact portion for the data signal SDA are situated in the first line L1 (contact portions 230*c*, 240*c*). Specifically, the power supply pad Pvdd is connected to the terminal 270, and the reset pad Prst and the data pad Psda are respectively connected to the terminals 230, 240.

In the configuration of FIG. 19, let it be supposed that the ink cartridge is inclined so that contact is lost between the second line L2 and the contact members 460, 470 (FIG. 18). Let it further be supposed that, under these conditions, the memory control circuit 501 (FIG. 3) attempts to access the memory device 203 (FIG. 16). In this case, supply of power supply potential to the memory device 203 through the terminal 270 is interrupted. Instead, the power supply line Lvdd of the memory device 203 is presented with the reset signal RST through the protective diode D1. However, as compared with the reset signal RST, the voltage supplied thereto is lower by the equivalent of the forward voltage of the protective diode D1 (e.g. by about 0.6 V).

Here, let it be supposed that the acceptable range for operating voltage of the memory device 203 is between 2.7 V and 3.3 V. In this case, the voltage of the reset signal RST that is presented to the terminal 230 by the memory control circuit 501 may also lie between 2.7 V and 3.3 V. If the reset signal RST voltage is 3.3 V, the power supply line Lvdd is supplied with voltage of 2.7 V. Under this condition, the memory device 203 is able to operate. However, because the voltage on the power supply line Lvdd is close to the lower limit of the acceptable range, operation of the memory device 203 may become unstable. Also, if the reset signal RST voltage is even lower (e.g. 2.7 V), the memory device 203 may become inoperable in some instances. Under such conditions, there is a possibility that the logic module MLM is not be able to generate the correct control signal for the memory cell array MCA.

For example, in response to a write request, it is possible that the logic module MLM saves erroneous data Dwe that differs from the correct write data Dw to the memory cell array MCA. It is also possible that in response to a read request, the logic module MLM outputs erroneous data Dre that differs from the correct read data Dr. Thus, seemingly normal operation may in fact be erroneous operation.

In view of this, according the present embodiment, the contact portion for supplying power supply potential VDD to the memory device 203 is situated in the first line L1 (contact portion 220*c*). As a result, the likelihood of erroneous operation caused by unstable operating voltage as described above may be minimized.

As depicted in FIG. 13E, in the present embodiment, the contact members 410 to 450 that correspond to the first line L1 (FIG. 10C) situated at the leading position in the installation direction Z slides for shorter distances over the front side FS, as compared to the other contact members 460, 470 (Ds1<Ds2). Consequently, the likelihood of a defective connection is lower for the first line L1 than for the other line. From this standpoint as well, it is preferable for those contact portions having the potential to cause serious malfunction owing to a defective connection (e.g. the contact portion that receives power supply potential VDD) to be situated in the first line L1.

In the event that a defective connection of either the reset terminal 260 or the clock terminal 270 occurs, the memory device 203 is reset, or memory device 203 operation is suspended, so there is minimal likelihood of erroneous data being written, as compared to the case where a defective connection of the power supply terminal 220 occurs. Thus, in the present embodiment, the contact portions 260*c*, 270*c* of these terminals 260, 270 are situated in the other line which is not the leading line (in the present embodiment, the second line L2).

As depicted in FIGS. 17A and 17B, in the present embodiment, the contact portions 210*c* to 270*c* (terminals 210 to 270) are disposed on one side wall (the front wall 101*wf*) of the ink cartridge 100. The ink delivery port 110 is disposed on the base wall 101*wb* of the ink cartridge 100. Here, the ink delivery port 110 is situated at a location eccentric or offset towards the front wall 101*wf* side of the base wall 101*wb*. Specifically, in the present embodiment, the ink delivery port 110 in the base wall 101*wb* is situated towards the front wall 101*wf* side thereof as viewed from an intermediate position IP lying between a first edge E1 that is closest to the front wall 101*wf* (the location of connection to the front wall 101*wf*) and a second edge E2 located on the opposite side from the first edge E1 (the location of connection to the back wall 101*wbk*).

The installation direction Z is coincident with down in the direction of gravity. As a result, the centroid CF of the ink cartridge 100 is situated to the +Y side (the side opposite that where the connection mechanism 400 lies) with reference to the centerline CL (center MC). The centroid CF is the centroid of the profile of the ink cartridge 100 when the ink cartridge 100 is viewed towards −X from +X. The intermediate position IP is substantially identical to the position of the centroid CF projected onto the base wall 101*wb* along the installation direction Z. Owing to the above configuration, the ink cartridge 100 tends to incline in the direction such that the contact portions 210*c* to 270*c* separate from the contact members 410 to 470. Under these conditions, employing Feature 1 described above affords significant advantages. Also, because the ink supply port 110 is closer to the first edge E1 (terminals 210 to 270) than to the second edge E2 (the back wall 101*wbk*), the travel distances da, db are smaller for a given angle AG, as compared to if the ink delivery port 110 are closer to the second edge E2 than to the first edge E1. Consequently, there is reduced likelihood of defective contact between the terminals 210 to 270 (contact portions 210*c* to 270*c*) and the contact members 210*c* to 270*c* in the event that the ink cartridge 100 inclines.

B2. Feature 2

The present embodiment may have the following additional feature; the contact portion 240*c* of the data terminal 240, which is adapted to receive data signals SDA from an external device (the control section (the main control circuit 40 and the carriage circuit 500 in their entirety) of the printer 1000) and to send data signals SDA to the external device (the control section of the printer 1000), is situated in the first line L1 (FIG. 10C). The memory device 203 receives data signals SDA and sends data signals SDA via the contact portion 240*c* of this data terminal 240.

Figure 20:
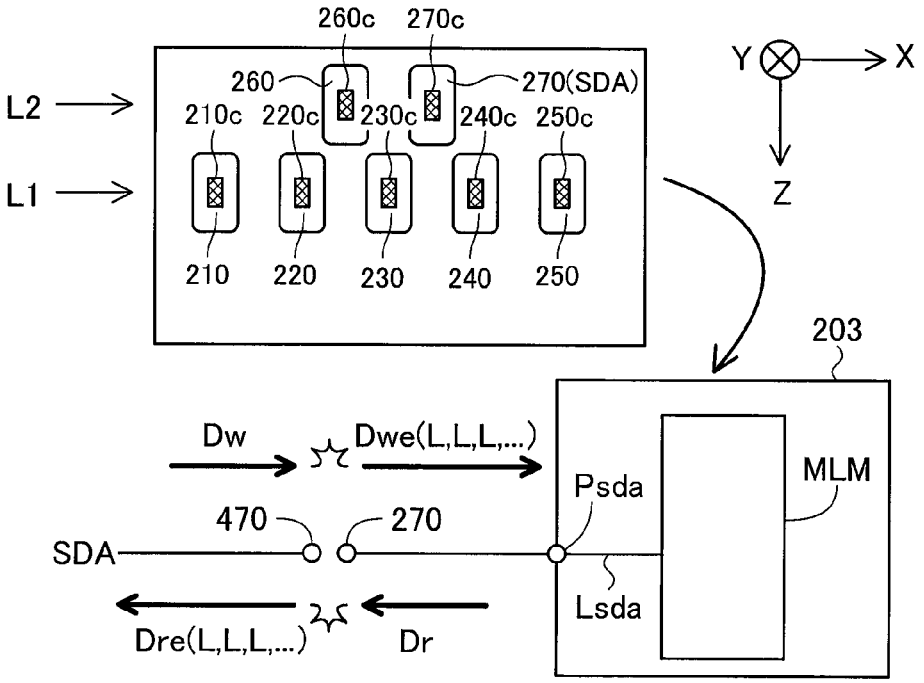
FIG. 20 is an illustration depicting another feature.

FIG. 20 is an illustration depicting a structure different from Feature 2. The drawing shows the terminals 210 to 270 of a circuit board and a memory device 203. In the structure depicted in FIG. 20, the contact portion for the data signal SDA (contact portion 270*c*) is situated in the second line L2. Specifically, the data pad Psda is connected to the terminal 270.

In the structure shown in FIG. 20, let it be supposed that the ink cartridge is inclined so that contact is lost between the terminal 270 and the contact member 470 (FIG. 18). Let it further be supposed that, under these conditions, the memory control circuit 501 (FIG. 3) attempts to access the memory device 203 (FIG. 16). Under these conditions, bidirectional transmission (sending and receiving) of data signals SDA through the terminal 270 is interrupted. Consequently, if the memory device 203 receives power supply potential VDD, a reset signal RST, and the clock signal SCK it is able to operate, but cannot operate normally. For example, in response to a write request, it is possible that the memory device 203 saves erroneous data Dwe that differs from the correct write data Dw. In the absence of electrical connection with the contact member 470 of the printer 1000, the memory device 203 operates on the basis of data (erroneous data) according to the potential on the data pad Psda (FIG. 15: data line Lsda) which is separated from the contact member. The potential on the data line Lsda could be L level for example. In this case, the erroneous data Dwe would be data in which all bits are set to L level. Similarly, in response to a read request, it is possible that data received by the memory control circuit 501 is erroneous data Dre that differs from the correct read data Dr (e.g. data in which all bits are set to L level). Thus, seemingly normal operation may in fact be erroneous operation.

In the present embodiment, the contact portion of the data terminal for sending and receiving data signals SDA (contact portion 240*c*) may be situated on the first line L1. As a result, the likelihood of malfunction as described above is lower.

B3. Feature 3

The present embodiment may have the following additional feature; the contact portion 270*c* of the clock terminal 270 for receiving the clock signal SCK is situated in a line different from the first line L1 (in the present embodiment, in the second line L2; FIG. 10C).

The memory device 203 of the present embodiment suspends operation if presentation of the clock signal SCK is interrupted. Consequently, the likelihood of erroneous data being written to the memory device 203 is smaller in the event that a defective connection of the clock terminal 270 occurs, as compared to the case where defective connection of the power supply terminal 220 or the data terminal 240 occurs. Accordingly, by situating the contact portion 270*c* of the clock terminal 270 in a different line from the first line L1 (e.g. the second line L2) as taught in the present embodiment, the plurality of contact portions can be distributed among a plurality of lines, without increasing the likelihood of erroneous data being written to the memory device 203. Thus, as compared to the case where all of the plurality of contact portions are arranged in a single line, the lines can be shorter in length (i.e. the device can be more compact).

B4. Feature 4

The present embodiment may have the following additional feature; the contact portion 260*c* of the reset terminal 260 that receives the reset signal RST is situated in a different line from the first line L1 (in the present embodiment, the second line L2; FIG. 10C).

The memory device 203 of the present embodiment is designed so that if presentation of the reset signal RST is interrupted, the signal that is input to the memory device 203 from the reset pad assumes lower potential than High level, and the memory device 203 either suspends operation, or the memory device 203 resets itself. Consequently, the likelihood of erroneous data being written to the memory device 203 is lower in the event that a defective connection of the reset terminal 260 occurs, as compared to the case where defective connection of the power supply terminal 220 or the data terminal 240 occurs. Accordingly, by situating the contact portion 260*c* of the reset terminal 260 in a different line from the first line L1 (e.g. the second line L2) as taught in the present embodiment, the plurality of contact portions can be distributed among a plurality of lines, without increasing the likelihood of erroneous data being written to the memory device 203. Thus, as compared to the case where all of the plurality of contact portions are arranged in a single line, the lines can be shorter in length (i.e. the device can be more compact).

B5. Feature 5

The present embodiment may have the following additional feature; the plurality of contact portions 210*c* to 270*c* are situated on the same plane (FIG. 10C), and when the center axis of the ink delivery port 110 (center line CL) along the direction (the Y direction) perpendicular to this plane (from +Y towards −Y) is projected onto this plane, the contact portions that are situated furthest away from the center axis CL are the contact portions 210*c*, 250*c* of the sensor terminals 210, 250.

Figure 21:
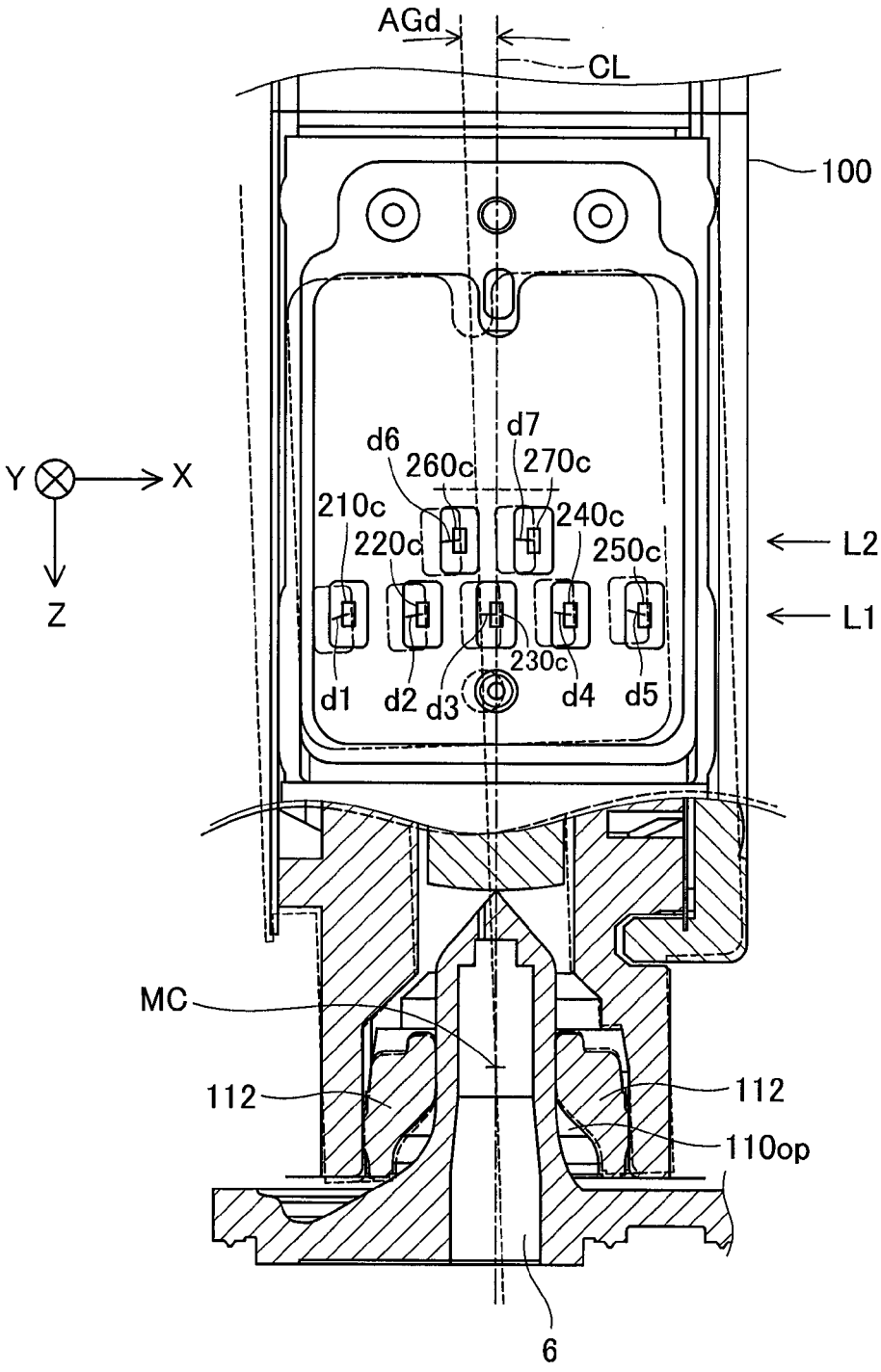
FIG. 21 is an illustration depicting positional relationships among contact portions and the center axis (centerline CL) of an ink delivery port.

The sensor terminals 210, 250 are terminals whereby the main control circuit 40 and carriage circuit 500 of the printer 1000 present the circuit board 200 with a signal to detect whether an ink cartridge 100 is installed (FIG. 3). As shown in FIG. 21, where the ink cartridge 100 is mispositioned, the position gaps (d1, d5) at locations further away from the centerline CL are greater than the position gaps (d2, d3, d4) at locations closer to the centerline CL. Consequently, even if the terminal 230, which is close to the centerline CL, is in correct contact (i.e. with no position gap) with the corresponding contact portion 430*c*, the terminals 210, 250 which are further away from the centerline CL may not be in contact with the corresponding contact portions 410*c*, 450*c*. Accordingly, by situating the contact portions 210*c*, 250*c* of the terminals 210, 250 at locations furthest away from the centerline CL, the likelihood of erroneous detection in relation to ink cartridge 100 installation is reduced. For example, the likelihood that "installation" is detected in error in the event that the ink cartridge 100 is mispositioned and is not installed correctly may be reduced. The sensor terminals 210, 250 have functionality whereby the printer control section (the main control circuit 40 and the carriage circuit 500) is able to detect whether the ink cartridge 100 is correctly installed in the printer 1000, or whereby the printer control section is able to detect whether the terminals of the circuit board are correctly connected with itself, and thus may also be called cartridge installation detection terminals.

Because the contact portion 230*c* of the power supply terminal 230 is situated between the two contact portions 210*c*, 250*c* for detecting installation, with installation detection having been confirmed, there is a high probability that the electrical connection of the power supply terminal 230 is achieved as well. As a result, the likelihood of defective connection of the power supply terminal 230 is lower, and the likelihood of problems occurring when electrical connections that rely on terminals is reduced.

The sensor terminals 210, 250 are designed to receive higher voltage (higher applied voltage) as compared with the other terminals 220-240, 260, and 270 (FIG. 3). Where the contact portions 210*c*, 250*c* of these terminals 210, 250 are situated at locations furthest away from the centerline CL, their contact portions 210*c*, 250*c* are situated at the ends, thereby reducing the number of other contact portions situated in proximity to the contact portions 210*c*, 250*c*. Consequently, the likelihood that the contact members 410, 450 designed to output high voltage come into unintentional contact with other terminals (e.g. the terminals connected to the memory device 203) is reduced. Such unintentional contact may occur during installation (or detachment) of the ink cartridge 100. Unintentional contact may also result from ink or dust adhering to the circuit board 200.

It is not essential that the plurality of contact portions 210*c* to 270*c* be arranged on the same plane, and they may instead be arranged approximately on a plane.

B6. Feature 6

The present embodiment may have the following additional feature; the line that includes the contact portions 210*c*, 250*c* of the sensor terminals 210, 250 (the first line L1) is the longest line among the plurality of lines (FIG. 10C). Here, the length of a line refers to the length between the two contact portions whose locations are furthest towards the ends in each line. In the example depicted in FIG. 10C, this is the length of line L1 and line L2.

This feature indicates that the distance between the contact portions 210*c*, 250*c* of the sensor terminals 210, 250 is greater than the distance between the two ends of other lines. Thus, if the position gap of the circuit board 200 (the position gap of the ink cartridge 100 with respect to the holder 4 (FIG. 4)) is large, the position gap of at least one of the two contact portions 210*c*, 250*c* with respect to the contact mechanism 400 is large as well. Also, by situating the contact portions 210*c*, 250*c* at the two ends of one line, it is possible to reduce either the number of other contact portions in proximity to the contact portion 210*c*, and/or the number of other contact portions in proximity to the contact portion 250*c*. This feature 6 has the same effects as the feature 5 described before. More specifically, the likelihood of erroneous detection in relation to ink cartridge 100 installation is reduced. Further, the likelihood of problems occurring when electrical connections that rely on terminals is reduced. Moreover, the likelihood that the contact members 410, 450 designed to output high voltage come into unintentional contact with other terminals (e.g. the terminals connected to the memory device 203) is reduced.

B7. Feature 7

There is a possibility that the contact members (460, 470) for the contact portions (260*c*, 270*c*) of the second line L2 may come into contact with terminals of the leading line (the first line L1) of the circuit board 200 during installation (or detachment) of the ink cartridge 100. Consequently, if the total number of contact portions of the other line(s) other than the first line L1 is smaller than the total number of contact portions of the first line L1, the likelihood that contact members of the printer 1000 come into unintentional contact with terminals of the circuit board 200 is reduced. As a result, the likelihood of damage to the circuit board 200 is reduced. Here, the total number of other lines could also be two or more. In this case, it is preferable for the total number of contact portions of the leading line to exceed the total number of contact portions in all of the other lines.

As described in Feature 1 with reference to FIGS. 17A, 17B, and 18, the leading first line L1 has a lower probability of defective connection in comparison with other lines. Consequently, by increasing the total number of contact portions in the first line L1, the probability of defective connections is reduced in relation to the plurality of contact portions overall.

C. Embodiment 2

Figure 22:
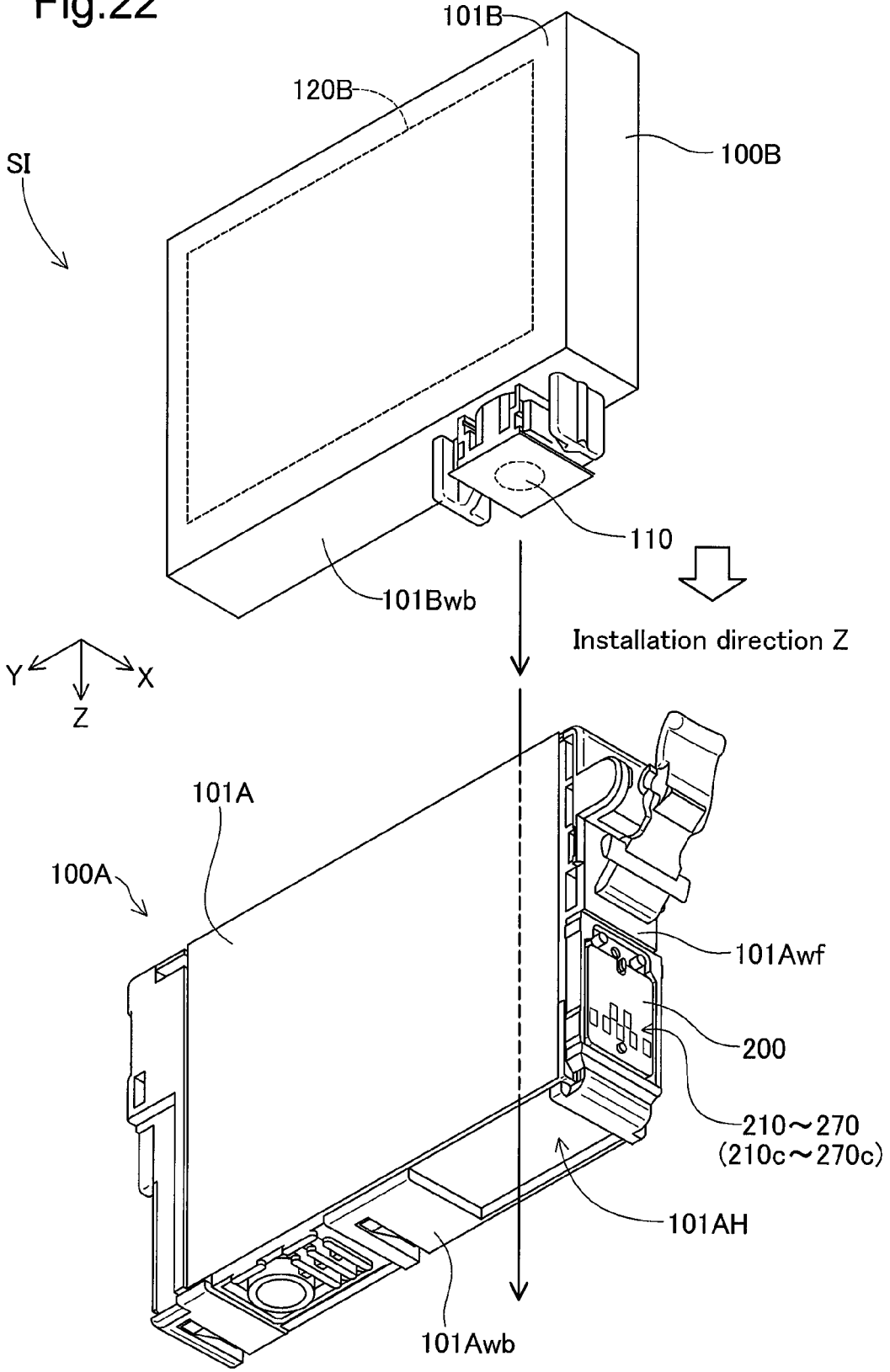
FIG. 22 is a perspective view of an ink delivery system.
Figure 23:
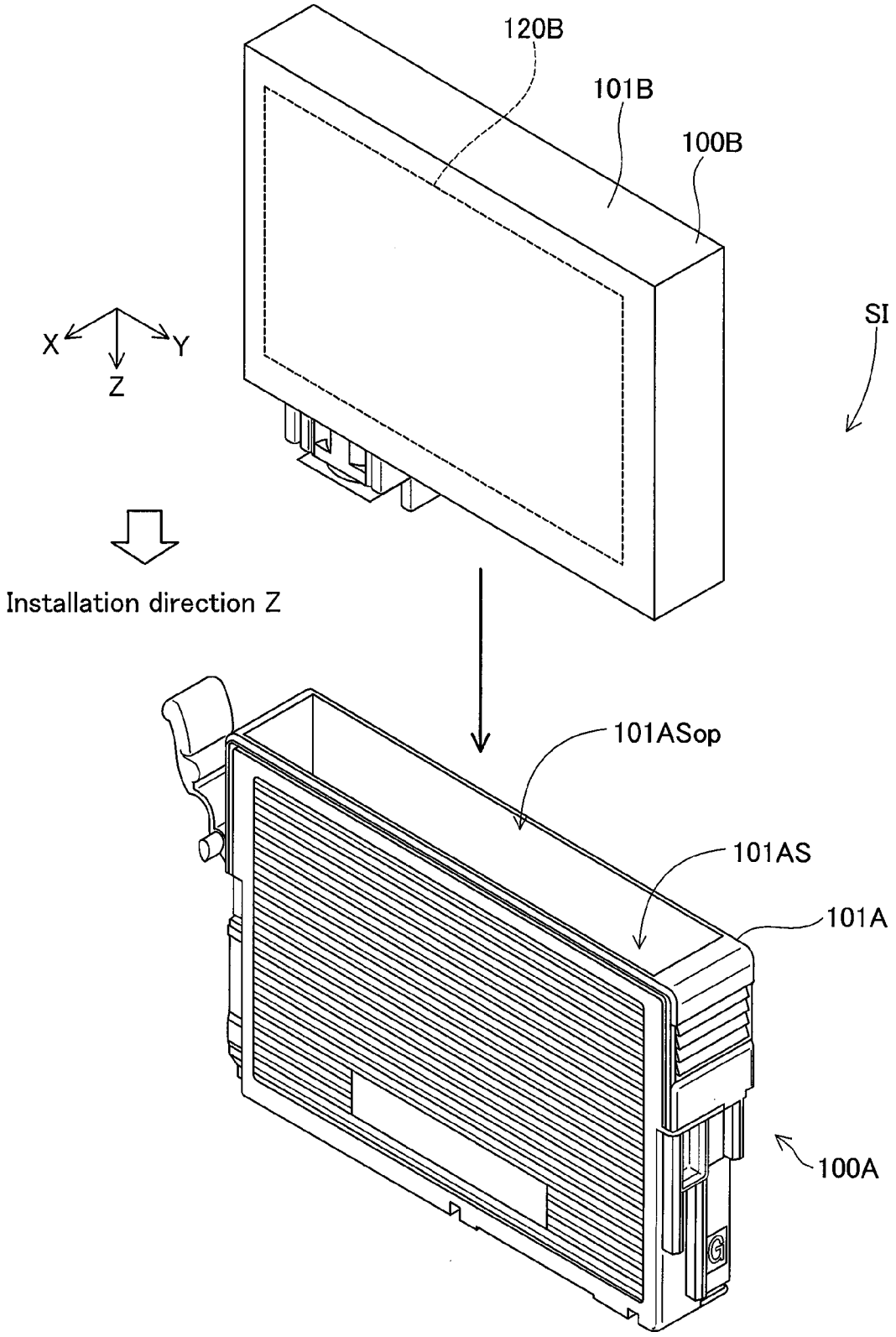
FIG. 23 is a perspective view of an ink delivery system.

FIGS. 22 and 23 are perspective views showing a second embodiment of the ink delivery system (recording material delivery system). It differs from the embodiment depicted in FIGS. 6A and 6B only in that, of the elements of the ink cartridge 100, the ink receptacle 130 (the ink delivery port 110 and the ink chamber 120 in their entirety) is separate from the other elements. The configuration of the printer 1000 is the same as the configuration of Embodiment 1 discussed previously.

This ink delivery system SI includes a structural body 100A (hereinafter also called "adaptor 100A") and an ink receptacle portion 100B. The ink receptacle portion 100B includes a housing 101B for holding ink, and an ink delivery port 110. An ink chamber 120B for holding the ink is formed in the interior of the housing 101B. The ink delivery port 110 is formed in the base wall 101Bwb (+Z direction wall) of the housing 101B. The ink delivery port 110 communicates with the ink chamber 120B. The arrangement of the ink delivery port 110 is the same as the arrangement of the ink delivery port 110 of the ink cartridges 100 discussed previously (FIGS. 6 to 9).

The adaptor 100A includes a main unit 101A and a circuit board 200. A space 101AS designed to accommodate the ink receptacle portion 100B is formed in the interior of the main unit 101A. In the upper part (−Z direction) of the main unit 101A there is disposed an opening 101ASop that communicates with the space 101AS. The main unit 101A further includes a front wall 101Awf and a base wall 101Awb. The front wall 101Awf is the −Y direction wall, and the base wall 101Awb is the +Z direction wall. The front wall 101Awf intersects (in the present embodiment, at a substantially right angle) the base wall 101Awb.

The arrangement of the front wall 101Awf is the same as that of the front wall 101*wf* of the ink cartridges 100 discussed previously (FIGS. 6 to 9). The circuit board 200 is secured to the front wall 101Awf. Apart from having an opening 101AH, the arrangement of the base wall 101Awb is the same as that of the base wall 101*wb* of the ink cartridges 100 discussed previously. With the ink receptacle portion 100B accommodated within the space 101AS, the ink delivery port 110 protrudes out from the adapter 100A through the opening 101AH. The opening 101AH is situated further towards the installation direction Z side than the plurality of contact portions 210*c* to 270*c* of the plurality of terminals 210 to 270 of the circuit board 200. The opening 101AH passes all the way through in the installation direction Z. The feature of the opening 101AH being situated further towards the installation direction Z side than the plurality of contact portions 210*c* to 270*c* (i.e. towards the direction of movement of the adapter 100A with respect to the printer 1000 during installation means that, in relation to locations in the direction parallel to the installation direction Z, the location of the opening 101AH lies further towards the installation direction Z side as compared with the respective locations of the contact portions 210*c* to 270*c*.

Figure 24:
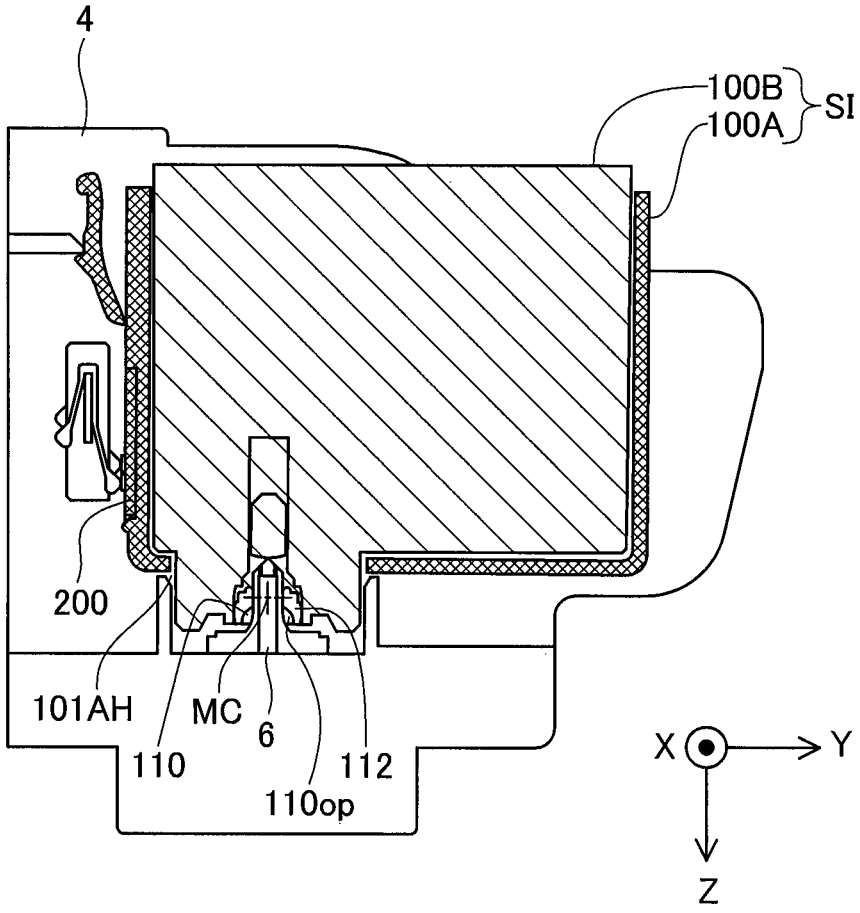
FIG. 24 is a sectional view depicting an adaptor and an ink receptacle portion installed in a holder.

FIG. 24 is a sectional view depicting the adaptor 100A and the ink receptacle portion 100B, installed in the holder 4. This sectional view is a simplification of a sectional view similar to FIG. 9. Like the ink cartridge 100, the adaptor 100A is installed in the holder 4 through movement in the installation direction Z. The ink receptacle portion 100B is likewise installed in the holder 4 through movement in the installation direction Z. The ink receptacle portion 100B is accommodated in the adaptor 100A and in this state is installed in the holder 4.

The opening 101AH of the adaptor 100A is designed to face the ink delivery needle 6 when the adaptor 100A is installed in the holder 4. This means that with the adaptor 100A installed in the holder 4, the ink delivery needle 6 projects out towards the opening 101AH. Here, the tip of the ink delivery needle 6 may be caused to pass all the way through the opening 101AH by installing the adaptor 100A in the holder 4. Alternatively, with the adaptor 100A installed on the holder 4, the tip of the ink delivery needle 6 may be positioned in front of the opening 101AH. In either case, the ink delivery needle 6 is inserted into the ink delivery port 110 which protrudes out towards the +Z direction from the opening 101AH.

In the present embodiment, the sensor 104 (FIG. 3) is dispensed with, and instead a capacitor which is provided to the circuit board is connected to the sensor terminals 210, 250. By the same procedure as in FIG. 14, the cartridge detection circuit 503*a*, using the capacitor, detects whether the adaptor 100A is installed.

In the present embodiment, as with the ink cartridges 100 discussed previously, the ink receptacle portion 100B may experience rocking motion about the ink delivery port 110. In this case, the adaptor 100A likewise comes into contact with the ink receptacle portion 100B and experience rocking motion about the ink delivery port 110. Consequently, in the ink delivery system SI of the present embodiment as well, various problems similar to those encountered with the ink cartridges 100 discussed previously may arise. Accordingly, in the present embodiment, the features of the adaptor 100A are the same as those of the ink cartridges 100 discussed previously (except that the ink chamber 120B and the ink delivery port 110 are dispensed with). That is, the adaptor 100A has the same features as the ink cartridges 100 discussed previously (e.g. Features 1 to 7). As a result, the ink delivery system SI of the present embodiment affords various advantages comparable to those of the ink cartridges 100 discussed previously.

When installed in the holder 4, the position of the adaptor 100A is determined (restricted) by the ink receptacle portion 100B. Specifically, it may be said that the adaptor 100A is supported by the ink receptacle portion 100B. Once installed in the holder 4, the adaptor 100A does not need to be replaced. If the ink in the ink receptacle portion is depleted, the ink receptacle portion may be replaced by removing the empty ink receptacle portion 100B without detaching the adaptor 100A, and installing a new ink receptacle portion filled with ink.

In relation to the present embodiment, Features 1 to 7 discussed previously are modified as follows. Specifically, the positional relationships between the terminals (contact portions) and the center axis (centerline CL) of the ink delivery needle 6 with the adaptor 100A having been installed without position gaps (correctly) in the printer 1000 are adopted in place of the positional relationships between the terminals (contact portions) on the circuit board 200 and the center axis (centerline CL) of the ink delivery port 110. The fact that the first line L1 lies close to the opening 101AH means that, with the adaptor 100A and the ink receptacle portion 100B having been installed in the printer 1000, the first line L1 is positioned close to the opening 110*op* of the ink delivery port 110. In the present embodiment, it can also be said that with the adaptor 100A having been installed correctly (without position gaps) in the printer 1000, the line that the plurality of lines (lines of contact portions) is that closest to the ink delivery needle 6 is the first line L1.

D. Embodiment 3

Figure 25:
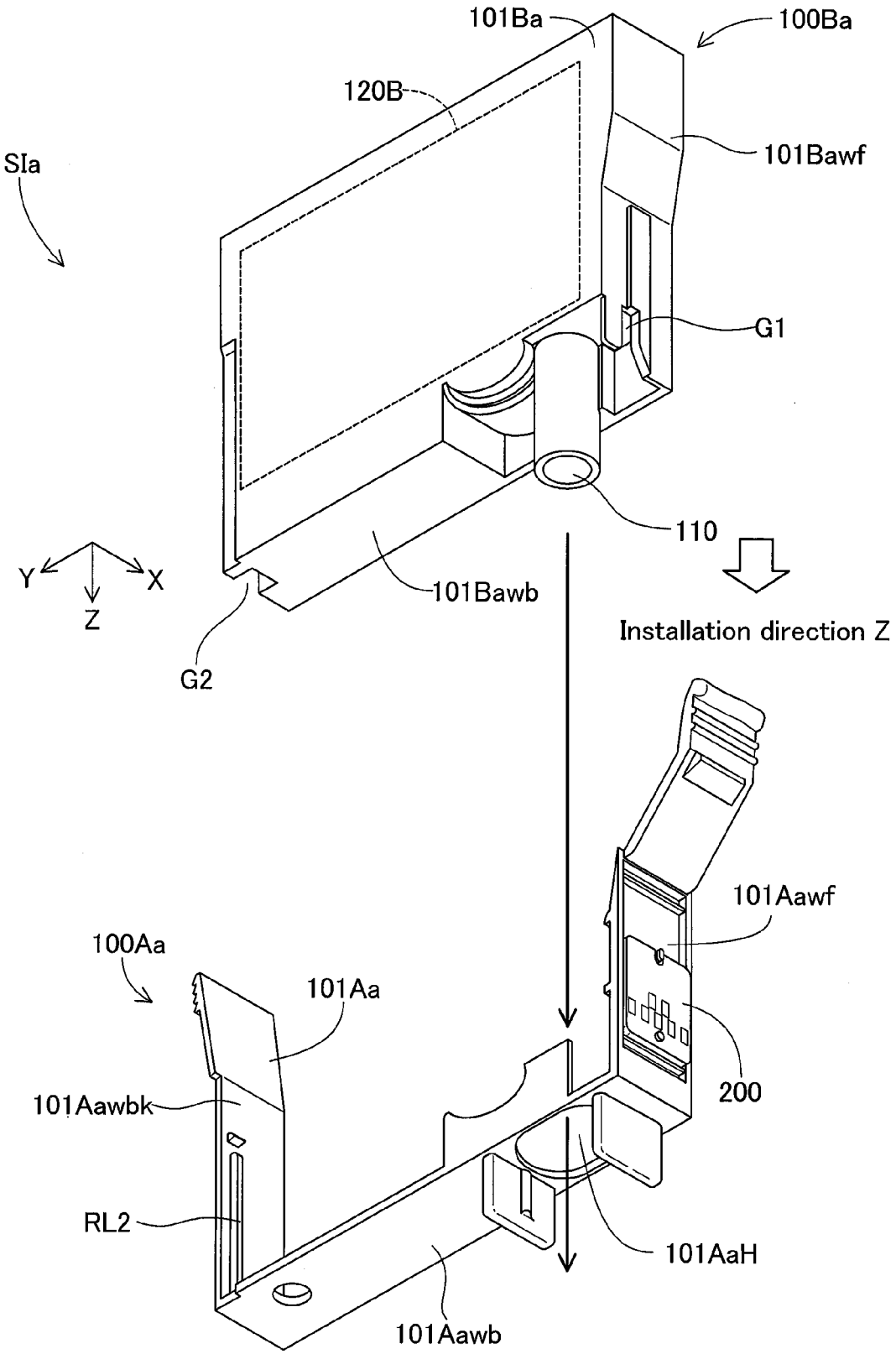
FIG. 25 is a perspective view depicting a third embodiment of an ink delivery system (recording material delivery system)
Figure 26:
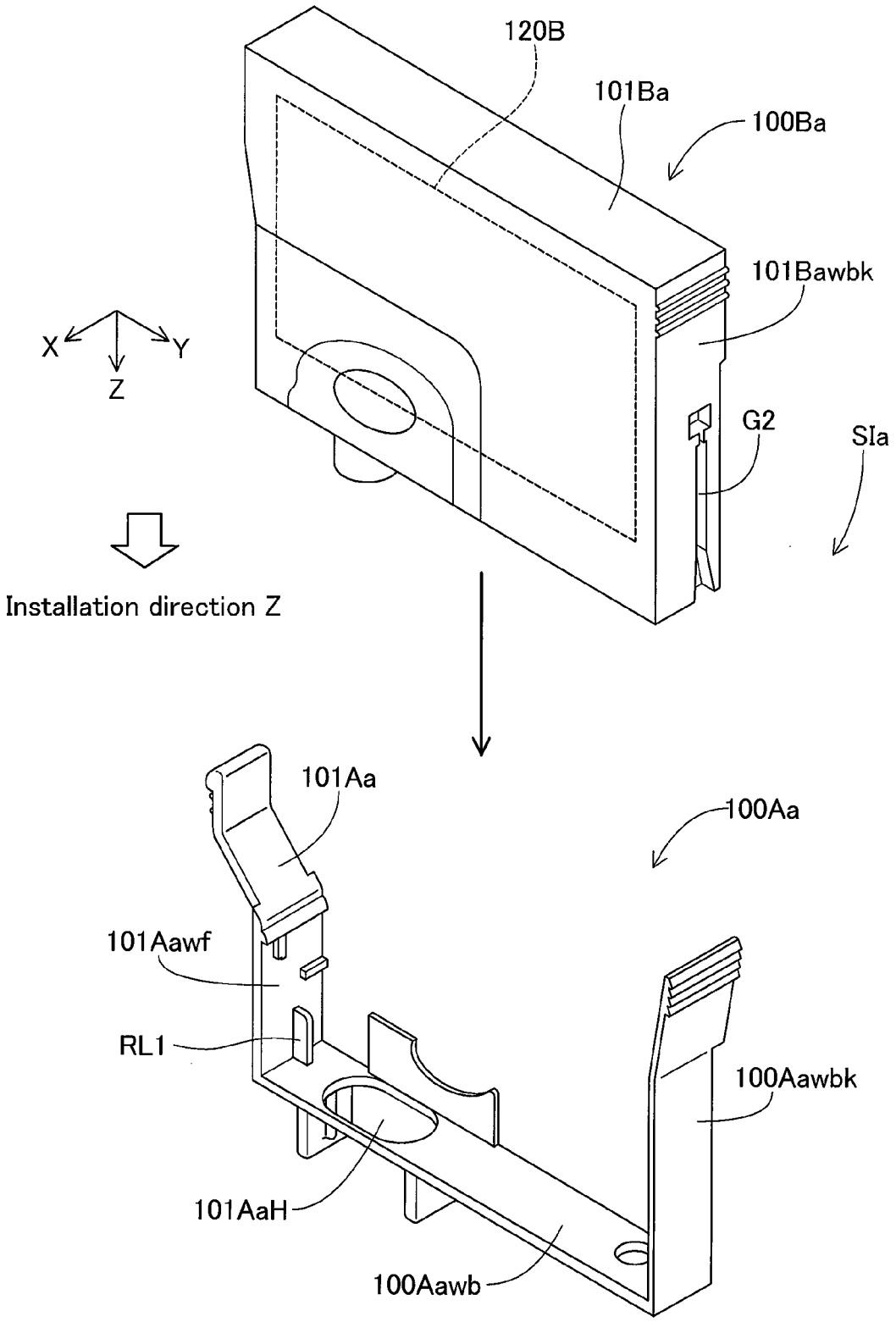
FIG. 26 is a perspective view depicting the third embodiment of an ink delivery system (recording material delivery system)

FIGS. 25 and 26 are perspective views showing a third embodiment of the ink delivery system (recording material delivery system). The principal difference from the embodiment depicted in FIGS. 22 and 23 is that the X direction wall (the wall perpendicular to the X direction) of the adaptor 100Aa (structural body 100Aa) is eliminated. The main unit 101Aa of the adaptor 100Aa has a front wall 101Aawf, a base wall 101Aawb, and a back wall 101Aawbk. The other features of the ink delivery system SIa are similar to the features of the ink delivery system SI depicted in FIGS. 22 and 23. In FIGS. 25 and 26, elements that are identical to elements in the ink delivery system SI (FIGS. 22, 23) are assigned like symbols. The circuit board 200 is secured to the front wall 101Aawf.

On the inside face of the front wall 101Aawf (the face lying towards the ink receptacle portion 100Ba) of the adaptor 100Aa there is disposed a first rail RL1 extending parallel to the installation direction Z. A first groove G1 that corresponds to the first rail RL1 is formed on the front wall 101Bawf of the ink receptacle portion 100Ba. On the inside face of the back wall 101Aawbk (the face lying towards the ink receptacle portion 100Ba) of the adaptor 100Aa there is disposed a second rail RL2 extending parallel to the installation direction Z. A second groove G2 that corresponds to the second rail RL2 is formed on the back wall 101Bawbk of the ink receptacle portion 100Ba. The ink receptacle portion 100Ba is installed in the adaptor 100Aa by sliding the first rail RL1 into the first groove G1 and sliding the second rail RL2 into the second groove G2. In this state, the ink delivery port 110 of the ink receptacle portion 100Ba passes all the way through the opening 101AaH of the base wall 101Aawb of the adaptor 100Aa so as to protrude out from the adaptor 100Aa (not shown).

The ink delivery system SIa is installed in the holder 4 in the same manner as the ink delivery system SI shown in FIG. 24. Likewise, in the present embodiment, the adaptor 100Aa may come into contact with the ink receptacle portion 100Ba and experience rocking motion about the ink delivery port 110. Consequently, in the ink delivery system SIa of the present embodiment as well, various problems similar to those encountered in the embodiments discussed previously may arise. On the other hand, the ink delivery system SIa of the present embodiment has features (e.g. Features 1 to 7) comparable to those of the ink delivery system SI discussed previously. As a result, the ink delivery system SIa of the present embodiment affords various advantages comparable to those of the ink delivery system SI discussed previously.

E. Embodiment 4

Figure 27:
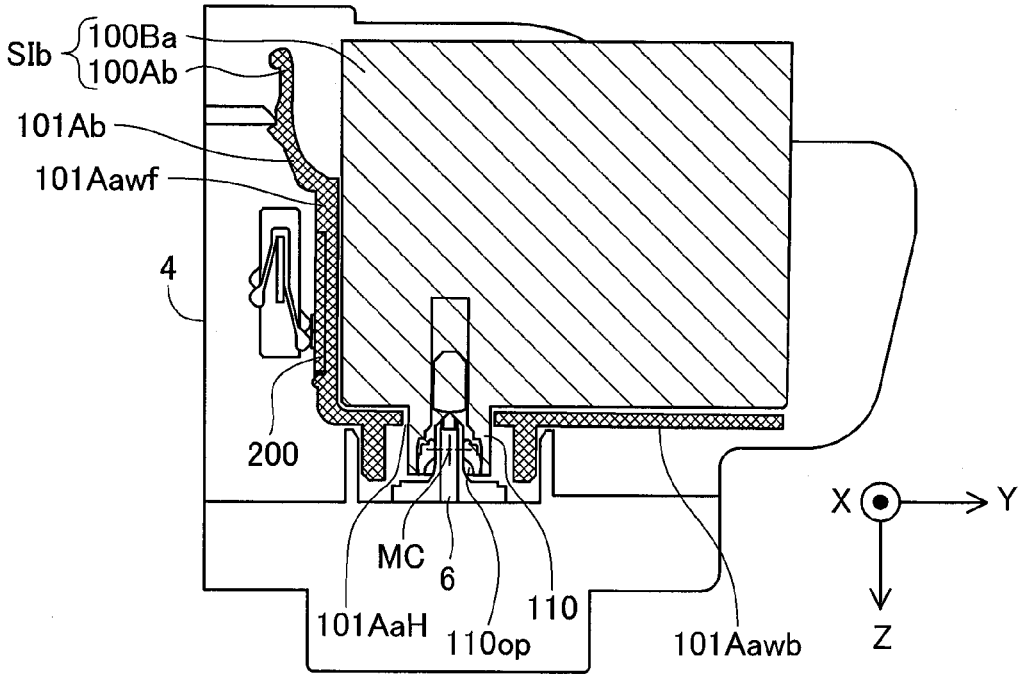
FIG. 27 is an illustration depicting a fourth embodiment of an ink delivery system (recording material delivery system)

FIG. 27 is an illustration depicting a fourth embodiment of the ink delivery system (recording material delivery system). A difference from the ink delivery system SIa of FIGS. 25 and 26 is that the back wall 101Bawbk is eliminated. The other features of the ink delivery system SIb are identical to the features of the ink delivery system SIa of FIGS. 25 and 26. FIG. 27 depicts a sectional view comparable to FIG. 24. The main unit 101Ab of the adaptor 100Ab (structural body 100Ab) has a front wall 101Aawf and a base wall 101Aawb. The adaptor 100Ab may come into contact with the ink receptacle portion 100Ba and experience rocking motion about the ink delivery port 110. This ink delivery system SIb has features (e.g. Features 1 to 7) comparable to those of the ink delivery system SI discussed previously. As a result, the ink delivery system SIb of the present embodiment affords various advantages comparable to those of the ink delivery system SI above.

F. Embodiment 5

Figure 28:
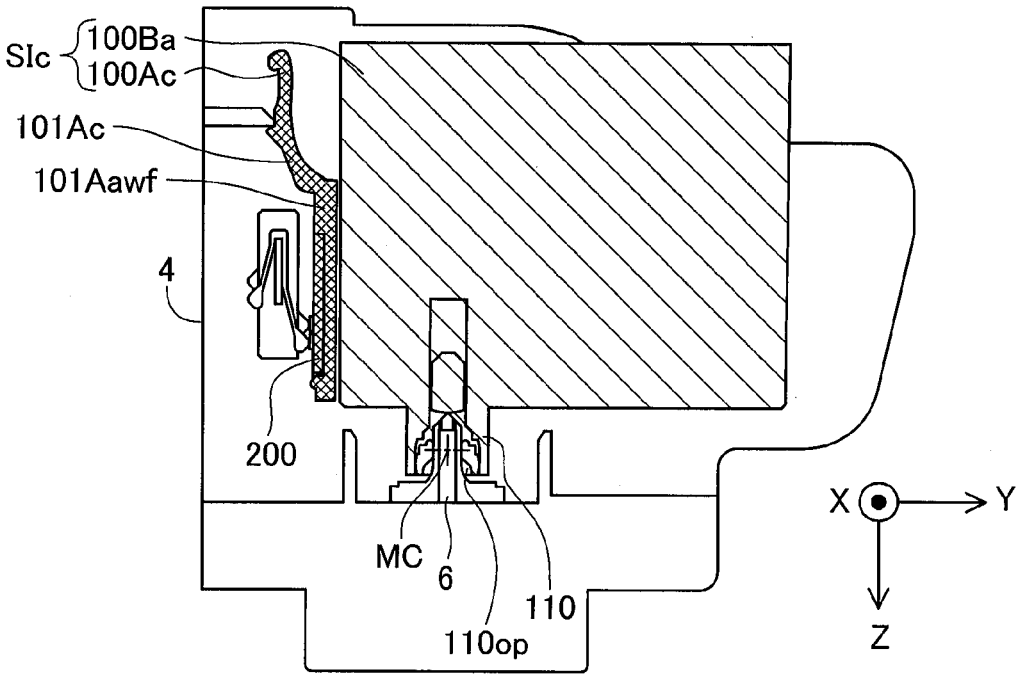
FIG. 28 is an illustration depicting a fifth embodiment of an ink delivery system (recording material delivery system)

FIG. 28 is an illustration depicting a fifth embodiment of the ink delivery system (recording material delivery system). A difference from the ink delivery system SIb shown in FIG. 27 is that the base wall 101Aawb is eliminated. The other features of the ink delivery system SIc are identical to the features of the ink delivery system SIb. FIG. 28 depicts a sectional view comparable to FIG. 27. The main unit 101Ac of the adaptor 100Ac (structural body 100Ac) has a front wall 101Aawf. The adaptor 100Ac may come into contact with the ink receptacle portion 100Ba and experience rocking motion about the ink delivery port 110. This ink delivery system SIc has features (e.g. Features 1 to 7) comparable to those of the ink delivery system SI discussed previously. As a result, the ink delivery system SIc of the present embodiment affords various advantages comparable to those of the ink delivery system SI above. In the present embodiment, the adaptor 100Ac is installed in the ink receptacle portion 100Ba for service. Any number of structures may be adopted as the configuration for realizing this installation. For example, the ink receptacle portion 100Ba could be provided with projections and the adaptor 100Ac could be provided with recesses so that the adaptor 100Ac may be installed in the ink receptacle portion 100Ba by inserting the projections into the recesses.

G. Embodiment 6

Figure 29:
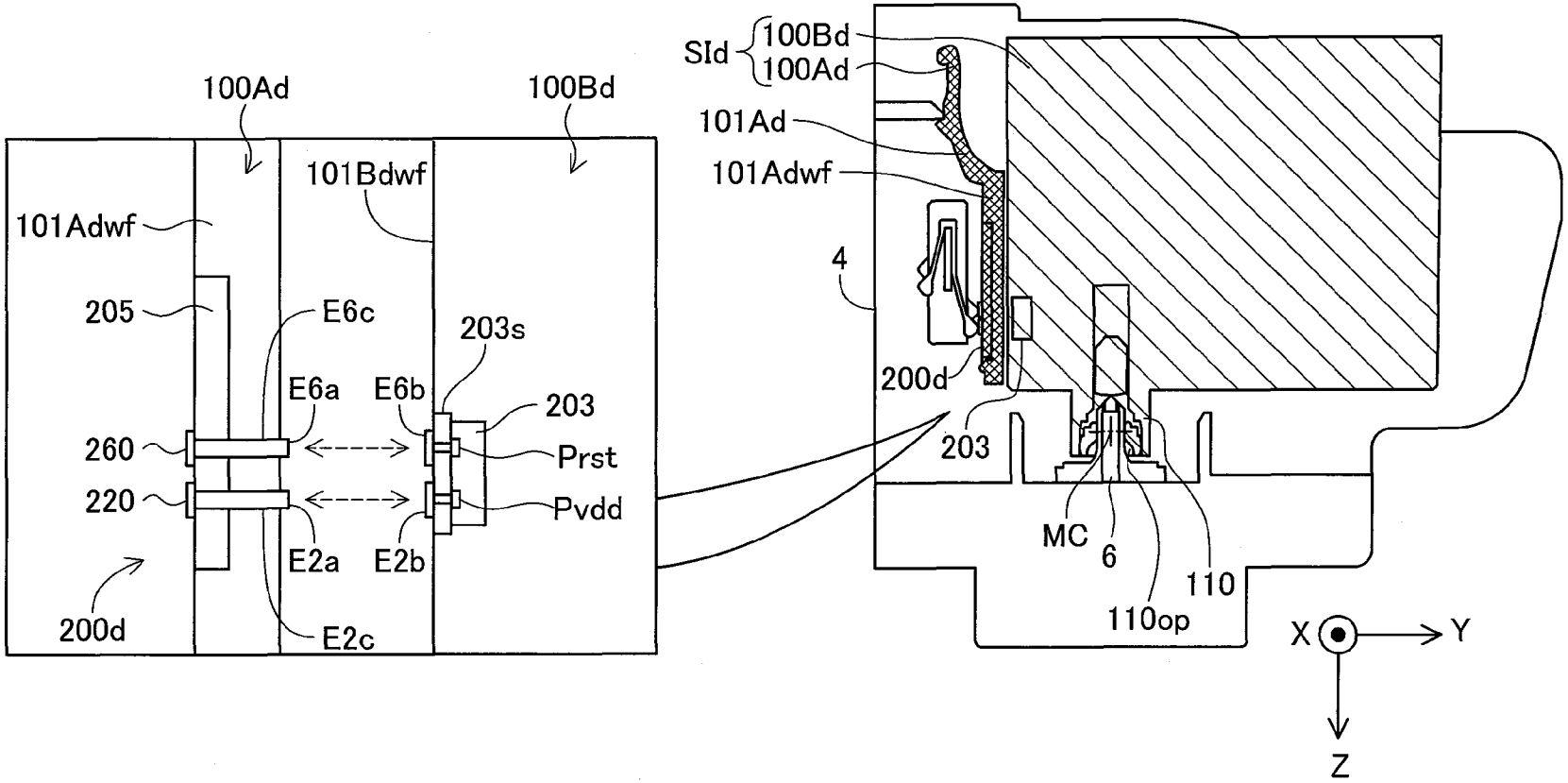
FIG. 29 is an illustration depicting a sixth embodiment of an ink delivery system (recording material delivery system)

FIG. 29 is an illustration depicting a sixth embodiment of the ink delivery system (recording material delivery system). A difference from the ink delivery system SIc shown in FIG. 28 is that in the memory device 203 is provided to the ink receptacle portion rather than to the circuit board; and conducting paths for connecting the memory device 203 and terminals provided on the circuit board are provided. The other features of the ink delivery system SId are identical to the features of the ink delivery system SIc. FIG. 29 depicts a sectional view comparable to FIG. 28, and an enlarged view of area surrounding the circuit board 200*d*. The main unit 101Ad of the adaptor 100Ad (structural body 100Ad) has a front wall 101Adwf. The circuit board 200*d* is secured to the front wall 101Adwf. The memory device 203 is secured to the ink receptacle portion 100Bd. In FIG. 29, elements that are identical to elements in the ink delivery system SIc of FIG. 28 are assigned like symbols.

The circuit board 200*d* has a board 205, and a plurality of terminals which are formed on the board 205. The plurality of terminals are the same as the terminals 210 to 270 shown in FIG. 10C. In the drawing, the power terminal 220 and the reset terminal 260 are depicted as representative. A conducting path E2*c* is connected to the power terminal 220. The conducting path E2*c* passes through the board 205 and the front wall 101Adwf of the adaptor 100Ad. The conducting path E2*c* extends towards the +Y direction from the power terminal 220 and leads to a terminal E2*a*. The terminal E2*a* lies exposed at the inside surface of the front wall 101Adwf (the face that faces towards the ink receptacle portion 100Bd). A conducting path E6*c* of similar design is connected to the reset terminal 260 as well. Similar conducting paths (not shown) are connected to the other terminals (terminals 230, 240, 270) for the memory device 203 as well. The structures of the front wall 101Adwf are the same as the structures of the front wall 101Aawf of FIG. 28, except that holes are formed to allow passage of the conducting paths E2*c*, E6*c*.

A board 203*s* is secured to the front wall 101Bdwf of the ink receptacle portion 100Bd. The memory device 203 is secured to the back face of the board 203*s* (the face that faces the front wall 101Bdwf). On the face lying on the opposite side of the board 203*s* (the face that faces the adaptor 100Ad) a plurality of terminals are disposed. In FIG. 29, two terminals E2*b*, E6*b* are shown as representative. The plurality of terminals which are provided to the board 203*s* are respectively connected to the plurality of pads (FIG. 3: Pvdd to Pvss) of the memory device 203. The power pad Pvdd is connected to the terminal E2*b*, and the reset pad Prst is connected to the terminal E6*b*. The terminal E2*b* is positioned facing the terminal E2*a*. The terminal E6*b* is positioned facing the terminal E6*a*.

With the ink delivery system SId having been installed correctly in the holder 4 in a condition in which the adaptor 100Ad is installed (or contacts) the ink receptacle portion 100Bd at the correct location, the terminal E6*a* contacts the terminal E6*b*, and the terminal E2*a* contacts the terminal E2*b*. The reset pad Prst thereby connects to the reset terminal 260, and the power pad Pvdd is connects to the power terminal 220. The other combinations of memory device 203 pads and board 205 terminals, which are omitted in the drawing, are similarly connected. As a result, the printer 1000 is able to access the memory device 203 via the terminals of the board 205.

The ink delivery system SId of the present embodiment has various features (e.g. Features 1 to 7) comparable to those of the ink delivery system SIc shown in FIG. 28. As a result, the ink delivery system SId affords various advantages comparable to those of the ink delivery system SIc.

The feature of the present embodiment (i.e. that the memory device 203 is secured to the ink receptacle portion 100Bd instead of to the circuit board 200*d*) is not limited to the ink delivery system SIc shown in FIG. 28 and may be implemented analogously in the respective ink delivery systems SI, SIa, Sib shown in FIGS. 22 to 27. In general, various arrangements furnished with a board and with a plurality of terminals arranged on the board are employable by way of the arrangement of the circuit board provided with the terminals for contacting the contact members 410 to 470 of the printer 1000 (FIG. 11). Here, the terminals include terminals for electrical connection to the memory device 203.

H. Embodiment 7

Figure 30:
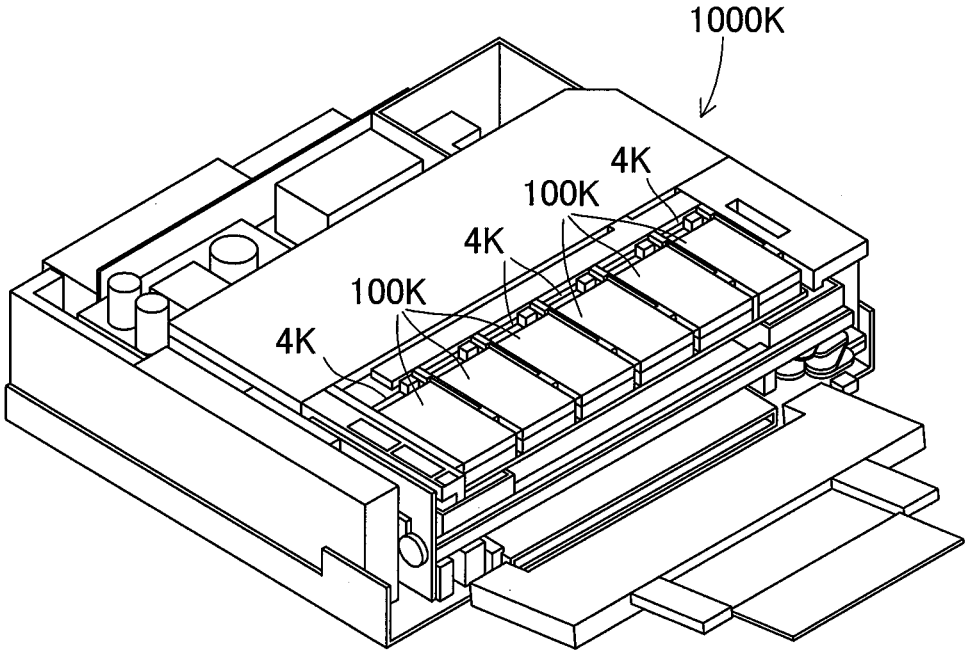
FIG. 30 is an illustration depicting a printer.

FIG. 30 is an illustration depicting a printer 1000K in a seventh embodiment. A difference from the printer 1000 shown in FIG. 1 is that the holders 4K which are adapted to receive the ink cartridges 100K are secured to the housing of the printer 1000K rather than to the carriage which includes the print head (not shown). The holders 4K and the print head are connected by tubes, not shown. The ink in each ink cartridge 100K is delivered to the print head through the tube.

Figure 31:
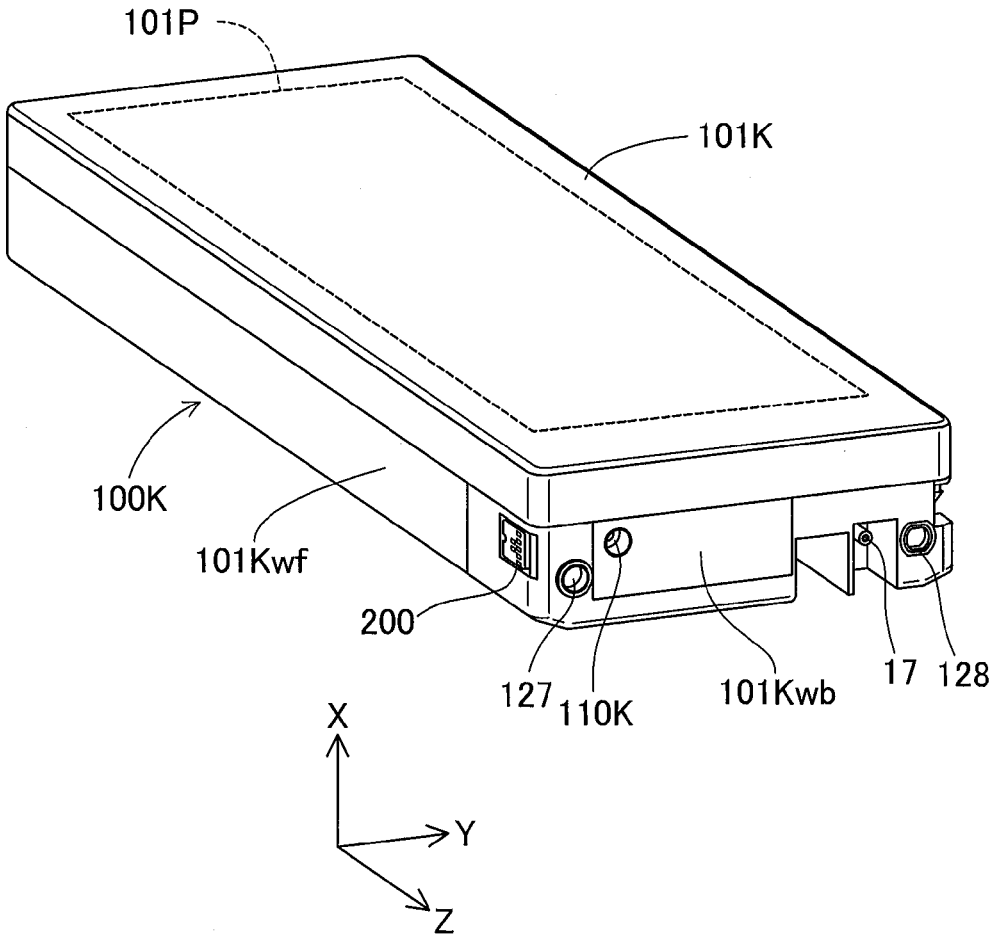
FIG. 31 is a perspective view of an ink cartridge.

FIG. 31 is a perspective view of an ink cartridge 100K. The ink cartridge 100K includes a housing 101K, a circuit board 200, and an ink delivery port 110K. The housing 101K includes a front wall 101Kwf and a base wall 101Kwb. The front wall 101Kwf intersects (in the present embodiment, at a substantially right angle) the base wall 101Kwb. An ink pack 101P is accommodated inside the housing 101K.

The circuit board 200 is identical to the circuit board 200 in each of the preceding embodiments. The circuit board 200 is secured to the front wall 101Kwf of the housing 101K. In the front wall 101Kwf, the contours of the sections that secure the circuit board 200 (e.g. the projections P1, P2) are identical to those of the front wall 101*wf* in a previous embodiment (FIG. 6A).

The features of the ink delivery port 110K are the same as the features of the ink delivery port 110 in each of the preceding embodiments. The ink delivery port 110K is disposed on the base wall 101Kwb of the housing 101K. The ink delivery port 110K communicates with the ink pack 101P.

Additionally, positioning holes 127, 128 and a pressurization hole 17 are formed in the base wall 101Kwb. Pressure can be applied to the ink pack 101P by supplying air through the pressurization hole 17. This pressurization is carried out in order to boost ink delivery.

Figure 32:
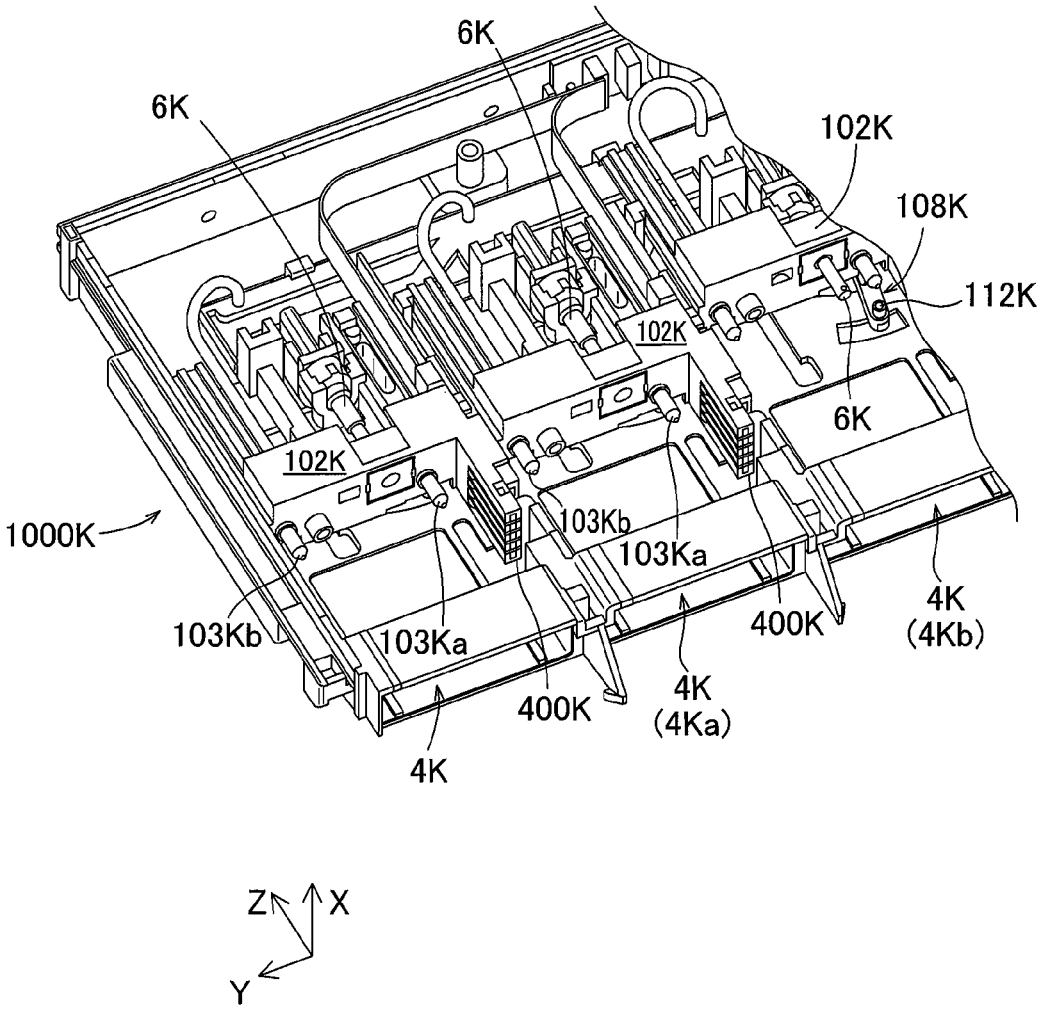
FIG. 32 is a perspective view of a holder.

FIG. 32 is a perspective view of the holders 4K. In the present embodiment, a holder 4 is provided for each ink cartridge 100K. Each holder 4K includes a moveable support portion 102K, a contact mechanism 400K, an ink delivery needle 6K, protruding positioning portions 103Ka, 103Kb, and a rotating lever 108K. The moveable support portion 102K is adapted to support the ink cartridge 100K through contact with the base wall 101Kwb (FIG. 31) of the ink cartridge 100K. The protruding positioning portions 103Ka, 103Kb are secured to the moveable support portion 102K. The protruding positioning portions 103Ka, 103Kb protrude out towards the −Z direction and respectively insert into the positioning holes 127, 128 of the ink cartridge 100K. The contact mechanism 400K is secured to the moveable support portion 102K in the forward direction (−Y direction). The features of this contact mechanism 400K are the same as the features of the contact mechanism 400 discussed earlier (FIG. 11). While not illustrated in the drawing, a circuit comparable to the carriage circuit 500 (FIG. 3) is connected to each of the contact mechanisms 400.

In the present embodiment, the ink cartridge 100K is installed in the holder 4K by moving the ink cartridge 100K in the installation direction Z. Here, pushing the ink cartridge 100K against the moveable support portion 102K causes the moveable support portion 102K to move in the +Z direction. The second holder 4K (4Ka) in FIG. 32 is depicted in its condition prior to installation of the ink cartridge 100K. The third holder 4K (4Kb) is depicted in its condition with the ink cartridge 100K installed (the ink cartridge 100K per se is omitted in the illustration). Herein, the position of the moveable support portion 102K shown by the holder 4Kb will also be termed the "installed position". Through movement of the moveable support portion 102K in the +Z direction, the ink delivery needle 6K appears in the −Z direction of the moveable support portion 102K. The ink delivery needle 6K then inserts into the ink delivery port 110K (FIG. 31) of the ink cartridge 100K.

During installation of the ink cartridge 100K, the ink cartridge 100K (the moveable support portion 102K) initially is pushed until reaching a position further in from the installed position (a location shifted to the +Z direction). By so doing, a pin 112K which is provided to the tip of the rotating lever 108K engages with an engaging portion (not shown) of the ink cartridge 100K. The ink cartridge 100K (the moveable support portion 102K) is then held at the installed position. If the cartridge 100K (the moveable support portion 102K) is again pushed to a position further in from the installed position, the pin 112K disengages. The ink cartridge 100K is then withdrawn from the holder 4K. Any of various known features may be employed as the features of the rotating lever 108K and the engaging portion.

The ink cartridge 100K of the present embodiment, like the ink cartridge 100 of Embodiment 1, may experience rocking motion about the ink delivery port 110K. Consequently, various problems similar to those encountered with the ink cartridges 100 of Embodiment 1 may arise in the present embodiment as well. Accordingly, in the present embodiment, the ink cartridge 100K is provided with a circuit board 200 and an ink delivery port 110K similar to those of the ink cartridge 100 described earlier. The features of the circuit board 200 and the ink delivery port 110K are respectively the same as the features of the circuit board 200 and the ink delivery port 110 of Embodiment 1. The first line L1 (FIG. 10C) of the circuit board 200 is closer to the opening of the ink delivery port 110K as compared with the other line. That is, the ink cartridge 100K has the same features as the ink cartridge 100 of Embodiment 1 (e.g. Features 1 to 7). As a result, the ink cartridge 100K of the present embodiment affords various advantages comparable to those of the ink cartridge 100 of Embodiment 1.

I. Modified Embodiments of Circuit Board

Figure 33:
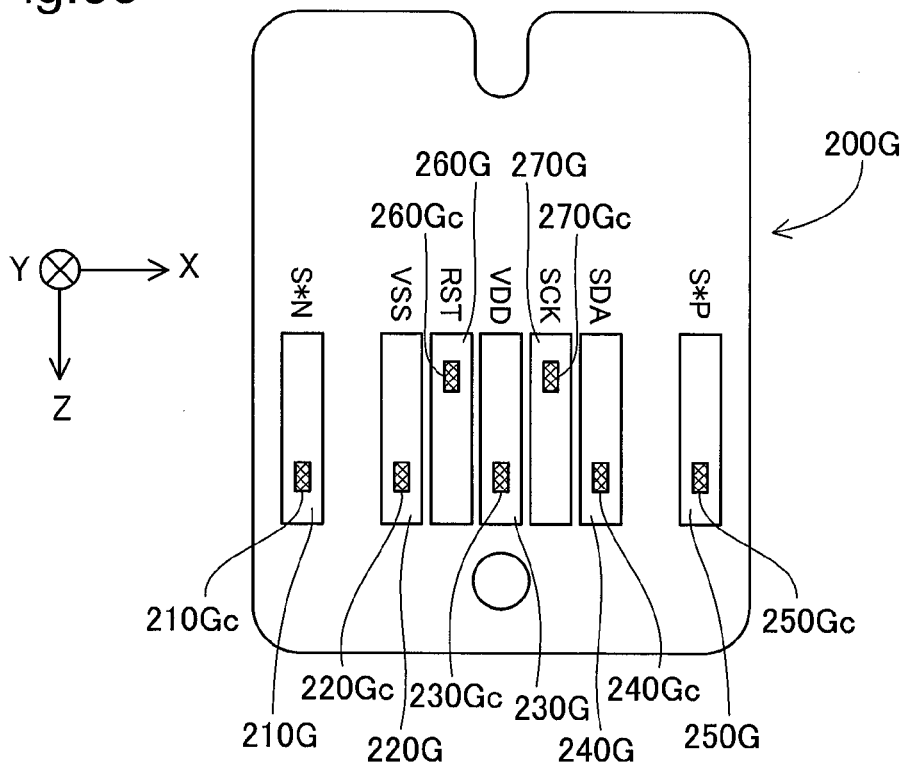
FIG. 33 is an illustration depicting another embodiment of a circuit board.

FIG. 33 is an illustration depicting another embodiment of the circuit board. The difference from the circuit board 200 shown in FIG. 10C is that the seven terminals 210G to 270G are arranged to form a single line extending in the X direction. As compared with the terminals 210 to 270 of Embodiment 1, the terminals 210G to 270G are formed with generally rectangular shape elongated in the Z direction. The placement of the contact portions 210Gc to 270Gc of the terminals 210G to 270G is identical to the placement of the contact portions 210*c* to 270*c* of Embodiment 1. Consequently, the various advantages mentioned earlier may be achieved even where the terminals 210G to 270G of this circuit board 200G are employed in place of the terminals 210 to 270 of the circuit boards 200, 200*d* in the preceding embodiments.

Figure 34:
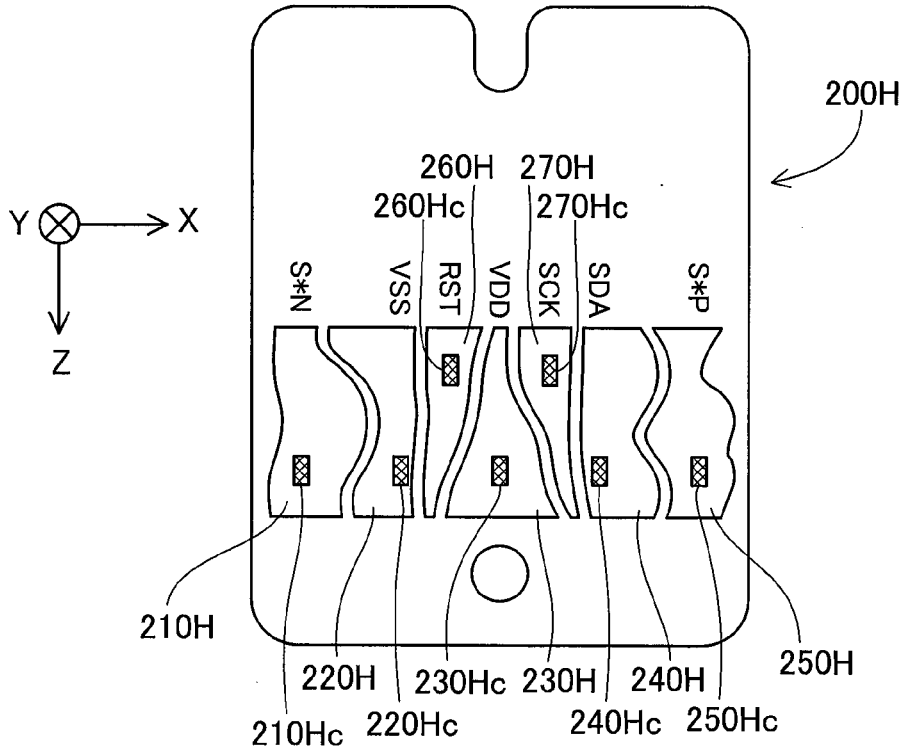
FIG. 34 is an illustration depicting another embodiment of a circuit board.

FIG. 34 is an illustration depicting another embodiment of the circuit board. The difference from the circuit board 200 shown in FIG. 10C is that the terminals 210H to 270H are irregular in shape. In this embodiment as well, placement of the contact portions 210Hc to 270Hc of the terminals 210H to 270H is identical to the placement of the contact portions 210*c* to 270*c* of Embodiment 1. Consequently, the various advantages mentioned earlier may be achieved even where the terminals 210H to 270H of this circuit board 200H are employed in place of the terminals 210 to 270 of the circuit boards 200, 200*d* in the preceding embodiments.

Figure 35:
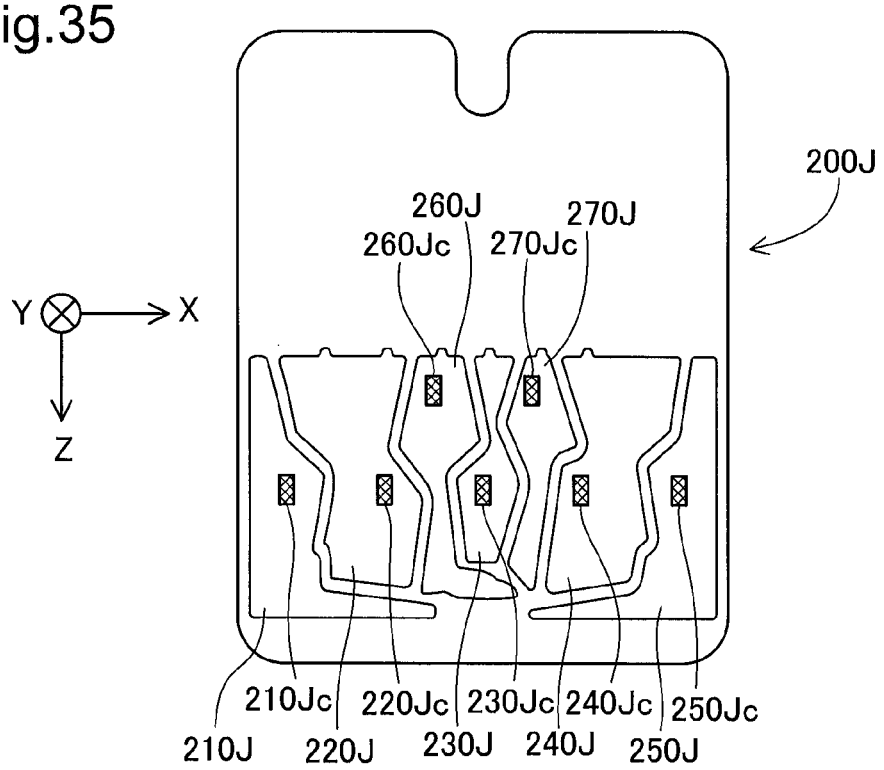
FIG. 35 is an illustration depicting another embodiment of a circuit board.

FIG. 35 is an illustration depicting another embodiment of the circuit board. The difference from the circuit board 200 shown in FIG. 10C is that the terminals 210J to 270J are irregular in shape. Also, this circuit board 200J differs from the circuit boards 200, 200G discussed earlier in that the shapes of the terminals 210J to 270J are determined such that the plurality of terminals overlap when viewed along the installation direction Z (from −Z towards +Z). In this embodiment as well, placement of the contact portions 210Jc to 270Jc of the terminals 210J to 270J is identical to the placement of the contact portions 210*c* to 270*c* of Embodiment 1. Consequently, the various advantages mentioned earlier may be achieved even where the terminals 210J to 270J of this circuit board 200J are employed in place of the terminals 210 to 270 of the circuit boards 200, 200*d* in the preceding embodiments.

Figure 36:
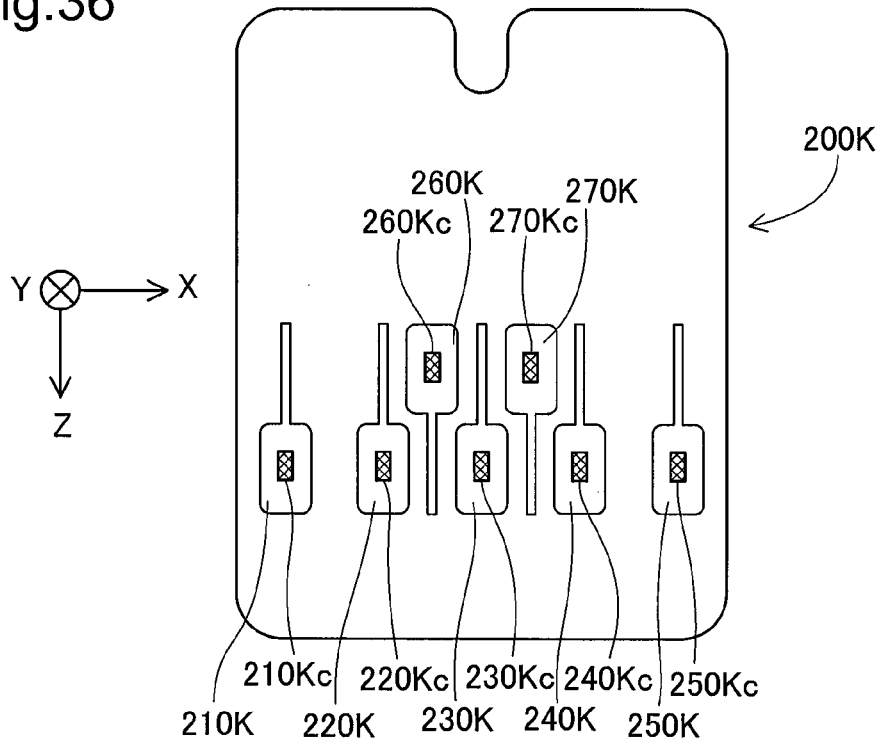
FIG. 36 is an illustration depicting another embodiment of a circuit board.

FIG. 36 is an illustration depicting another embodiment of the circuit board. Five terminals 210K to 250K include conducting sections of a line shape extending in the −Z direction, in addition to conduction sections identical to terminals 210 to 250 of FIG. 10C. Two terminals 260K, 270K include conducting sections of a line shape extending in the +Z direction, in addition to conduction sections identical to terminals 260 and 270 of FIG. 10C. In this embodiment as well, placement of the contact portions 210Kc to 270Kc of the terminals 210K to 270K is identical to the placement of the contact portions 210*c* to 270*c* of Embodiment 1. Consequently, the various advantages mentioned earlier may be achieved even where the terminals 210K to 270K of this circuit board 200K are employed in place of the terminals 210 to 270 of the circuit boards 200, 200*d* in the preceding embodiments.

J. Modified Embodiments

Of the constituent elements set forth in the preceding embodiments, elements other than those expressly claimed in independent claims are additional elements that may be dispensed with as appropriate. The invention is not limited to the particular embodiments hereinabove, and while residing within the scope and spirit thereof may be reduced to practice in various other modes, such as the following modifications for example.

Modified Embodiment 1

The contact portion 220*c* of the power terminal 220 in the embodiment depicted in FIG. 21 may be situated at a location overlapping the centerline CL. Also, the circuit board 200 as a whole may be situated at a location so as to not overlap the centerline CL. Some of the contact portions may be situated so as to overlap other contact portions when viewed along the installation direction Z (from −Z towards +Z).

In any event, it is preferable for the contact portion of the power terminal to be situated in the leading line (the first line L1). This reduces the likelihood of defective connection of the power terminal, thereby reducing the likelihood of problems encountered when utilizing an electrical connection that relies on a terminal.

Modified Embodiment 2

It is possible for various different devices to be employed as the devices mounted on the ink cartridges 100, 100K and the adapters 100A, 100Aa, 100Ab, 100Ac, 100Ad in the embodiments described above. For example, the sensor 104 could be one designed to apply voltage to the ink inside an ink cartridge 100 and measure the resistance. Ink properties and ink level can be detected from the resistance value. Also, the devices utilized to detect installation of the ink cartridges 100, 100K and the adapters 100A, 100Aa, 100Ab, 100Ac, 100Ad are not limited to piezoelectric elements, and various other devices may be employed. For example, capacitors could be employed in place of piezoelectric elements. A conductive pathway for connecting (shorting) two terminals could be employed as well. Where a conductive pathway is employed, installation can be detected by checking for electrical continuity between the two terminals. Moreover, a device for use in detecting installation could be provided separately from the sensor for detecting remaining ink level (in this case, additional terminals would be provided for the additional device). In the preceding embodiments, the sensor for detecting remaining ink level may be omitted.

The configurations of the memory device 203 are not limited to the those depicted in FIG. 15, and various other configurations may be adopted. For example, where the memory device 203 includes a parasitic diode, it is possible to omit the protective diode, which constitutes an equivalent circuit of the parasitic diode. As the memory device 203 there could instead be employed a serial memory adapted to receive commands and memory addresses over a data signal line from an external device (e.g. the control section (the main control circuit 40 and the carriage circuit 500 in their entirety) of the printer 1000 of FIG. 3), rather than generating memory addresses based on the clock signal. Alternatively, rather than having a plurality of memory devices connected to the control section of the printer by a bus connection, a plurality of memory devices could be connected individually to the control section of the printer. In this case, in place of the reset signal, the control section of the printer may transmit a chip select signal to a memory device targeted for access, in order to control the reset status and operational status through the level of this chip select signal. Operations of this type of memory (e.g. the memory's internal counter and register values) is reset according to changes of the chip select signal. Accordingly, the chip select signal is equivalent to a "reset signal". Also, the reset pad of the memory devices of the preceding embodiments could be omitted, and operations that in the memory devices of the preceding embodiments are executed by the memory device through changes in the level of the reset signal may instead be executed on the basis of changes in the level of the power supply potential supplied to the power pad. In this case, the memory device assumes an operational state in response to being supplied with power supply potential, and the memory device resets when the power supply potential is interrupted. Moreover, it is possible to employ various devices, not limited to memory devices 203, for sending and/or receiving data signals. For example, memory that does not permit updating of data (e.g. ROM) may be employed. Such memory may also store information representing types of ink. Embedded memory having a CPU and memory may be employed as well. This makes possible flexible control according to the algorithm of data processing by the CPU. In any event, it is possible to employ as devices herein any of various devices that are adapted to operate in response to power supply potential received from a recording material consuming apparatus (e.g. the printer 100 of FIG. 3). Where such a device that operates in response to power supply potential is employed, serious problems (e.g. malfunction) may arise if the power supply is interrupted. Thus, it is preferable for the contact portion which receives the power supply potential to be situated in the leading line.

Any of various placement schemes may be employed for placement of devices. For example, the memory device 203 (FIG. 3) may be secured directly to another member different from the board (e.g. the housing 101 of FIG. 6, the main unit 101A of FIG. 22, or the housing 101K of FIG. 31).

With regard to the total number of terminals, an arbitrary number may be selected according to the devices which are to be used. The plurality of contact portions may be arranged to form three or more straight lines. The lines other than the leading line may include a line or lines having a total number of contact portions exceeding that of the leading line. In any event, where the plurality of contact portions are distributed in several lines, the distance between the centerline CL and the contact portions can be short as depicted in FIG. 21. Position gaps of the contact portions are reduced as a result.

Modified Embodiment 3

The features of the ink delivery systems in the preceding embodiments are not limited to the features depicted in FIGS. 6 to 9, FIGS. 22 to 23, FIGS. 25 to 26, and FIGS. 27, 28, 29 and 31, and various other features may be adopted. For example, a single ink cartridge could be provided with multiple ink receptacle portions (sets composed of an ink chamber and an ink delivery port).

At least some of the plurality of terminals may be formed directly on another component different from the board (e.g. the front wall 101*wf* of FIG. 6, the front wall 101Awf of FIG. 22, or the front wall 101Kwf of FIG. 31). Moreover, the feature of "disposing the terminals on the front wall" is not limited to instances where terminals are directly formed on the front wall, and may refer also to instances where terminals are formed on a board which is installed on the front wall.

Further, various different features may be employed as the feature whereby a circuit board for electrical connection to a recording material-consuming apparatus (e.g. the printer 1000 of FIG. 3) is installed in (connected to) to the recording material-consuming apparatus. For example, the circuit board may be secured to the ink cartridge as in the embodiments depicted in FIG. 6A or FIG. 31. Alternatively, the circuit board may be secured to a structural body (adaptor) as in the embodiments depicted in FIGS. 22 to 29. In this case, various different features may be employed as features of the structural body (adaptor). For example, a feature that enables independent installation in the recording material-consuming apparatus as in the embodiments depicted in FIGS. 22 to 27 may be employed. Or, as in the embodiments depicted in FIGS. 28 and 29, with a structural body having been secured to a recording material receptacle portion (e.g. the ink receptacle portion 100Ba of FIG. 28), the structural body, together with the attached recording material receptacle portion, may be installed in the recording material-consuming apparatus. In either instance, where the position of the structural body is determined (restricted) by the recording material receptacle portion, i.e. where movement of the recording material receptacle portion causes the structural body to move as well, the structural body may be supported by the recording material receptacle portion.

Modified Embodiment 4

The total number of ink cartridges that can be used simultaneously by the printer is not limited to six, and some other number (e.g. one, four, or eight) could be employed. With regard to useable ink types as well, various different types may be employed. For example, a gray ink which is lighter than black ink could be used. Spot-color inks (e.g. red ink or blue ink) could be used as well. Inks containing no coloring matter may be used as well (e.g. a colorless transparent ink containing a component to protect ink dots).

The recording material in the preceding embodiments is not limited to ink, and other recording materials could be used. For example, toner could be used. Moreover, the recording material-consuming apparatus is not limited to a printer, and various other devices that consume recording material could be employed.

Modified Embodiment 5

Some of the structures that are implemented through hardware in the preceding embodiments could be replaced by software, and conversely some or all of the structures that are implemented through software in the preceding embodiments could instead be replaced by hardware. For example, the functions of the remaining ink level detection module M20 of FIG. 3 could be carried out by a hardware circuit having a logic circuit.

Additionally, where some or all of the functions of the inventions are implemented through software, the software (computer program) may be provided in a form stored on a computer-readable recording medium. In this invention, "computer-readable recording medium" is not limited to portable recording media such as flexible disks and CD-ROM, but includes also computer internal storage devices such as various types of RAM and ROM, as well as external storage devices such as a hard disk attached to a computer.

REFERENCE CHARACTERS

1 . . . drive belt
2 . . . carriage motor
3 . . . carriage
4 . . . holder
4K . . . holder
4*e* . . . mating projection
4Kb . . . holder
4*wb* . . . base wall
4*wf* . . . front wall
5 . . . print head

6 . . . ink delivery needle
6K . . . ink delivery needle
10 . . . roller
17 . . . pressurization hole
37 . . . flexible cable
40 . . . main control circuit
100, 100K . . . ink cartridge
100A, 100Aa, 100Ab, 100Ac, 100Ad . . . adaptor
100B, 100Ba, 100Bd . . . ink receptacle portion
101Kwb . . . base wall
101Bwb . . . base wall
101ASop . . . opening
101Awb . . . base wall
101Kwf . . . front wall
101Awf . . . front wall
101 . . . housing
101A . . . housing
101B . . . housing
101K . . . housing
101P . . . ink pack
101*e* . . . mating projection
101AH . . . opening
101AS . . . space
101*wb* . . . base wall
101*wf* . . . front wall
102K . . . moveable support portion
103K*a* . . . protruding positioning portion
104 . . . sensor
108K . . . rotating lever
110 . . . ink delivery port
110K . . . ink delivery port
110*f* . . . film
110*op* . . . opening
112 . . . seal member
112K . . . pin
120 . . . ink chamber
120B . . . ink chamber
127 . . . positioning hole
130 . . . ink receptacle section
200, 200G, 200H, 200J, 200K . . . circuit board
203 . . . memory device
205 . . . board
210~270, 210G~270G, 210H~270H, 210J~2170J, 210K~270K . . . terminal
210*b* . . . terminal
210*c*~270*c*, 210Gc~270Gc, 210Hc~270Hc, 210Jc~270Jc, 210Kc~270Kc . . . contact portion
400 . . . contact mechanism
400K . . . contact mechanism
400*b* . . . support member
401 . . . first slit
402 . . . second slit
402*a* . . . second slit
402*b* . . . second slit
410~470 . . . contact member
410*c*~470*c* . . . contact portion
500 . . . carriage circuit
501 . . . memory control circuit
503 . . . sensor drive circuit
503*a* . . . cartridge detection circuit
503*b* . . . remaining ink level detection circuit
510~570 . . . terminal
1000 . . . printer
1000K . . . printer
P . . . printer paper
P1 . . . projection
P2 . . . projection
H1 . . . hole
H2 . . . notch
D1~D6 . . . protection diode
LE . . . lower edge
SI . . . ink delivery system
BS . . . back side
FS . . . front side
M10 . . . cartridge detection module
M20 . . . remaining ink level detection module
M30 . . . memory control module

What is claimed is:

1. A recording material supply system installable in a recording material-consuming apparatus having a plurality of electrical contact members, the recording material supply system comprising:

a recording material receptacle for containing a recording material, the recording material receptacle having a recording material delivery port;

a memory device;

a plurality of first terminals used for connection to the memory device; and two second terminals used for detecting whether the recording material delivery system is installed in the recording material-consuming apparatus, wherein the plurality of first terminals includes a power supply terminal for receiving a power supply potential that differs from a ground potential of the recording material-consuming apparatus, the plurality of first terminals and the two second terminals each includes a contact portion that, when the recording material supply system is in an installed state wherein the recording material supply system is installed in the recording material-consuming apparatus, contacts a corresponding one of the electrical contact members of the recording material-consuming apparatus, the contact portions of the plurality of first terminals and the contact portions of the two second terminals are arranged in a plurality of lines, the two contact portions of the two second terminals being situated in a first line of the plurality of lines, and the contact portion of the power terminal is situated between the two contact portions of the two second terminals in the first line, the recording material delivery port includes an opening, and the first line is the closest of the plurality of lines to the opening.

2. The recording material supply system according to claim 1, wherein the contact portions of the two second terminals are situated at one end and the other end of the first line.

3. The recording material supply system according to claim 1, wherein the memory device is configured to carry out, in sync with a clock signal, transmission of data signals to an external circuit and/or reception of data signals from the external circuit, and the plurality of first terminals includes a data terminal for carrying out transmission and/or reception of the data signals, a clock terminal for receiving the clock signal, and a ground terminal for receiving the ground potential.

4. The recording material supply system according to claim 3, wherein the memory device operates upon receiving a reset signal of a level different from the ground potential, the plurality of first terminals includes a reset terminal for receiving the reset signal, and the reset terminal is situated in a different line from the first line.

5. The recording material supply system according to claim 1, further comprising:

a side wall; and a base wall, wherein the plurality of terminals are disposed on the side wall, the recording material delivery port is disposed on the base wall, the recording material delivery port on the base wall is situated at a location offset towards the side wall, and the recording material supply system is installed into the recording material-consuming apparatus in an installation direction that is downward in a direction of gravity.

6. The recording material supply system according to claim 1, wherein a total number of the contact portions of the first line exceeds a total number of the contact portions in another line of the plurality of lines.

7. A circuit board electrically connectable to a recording material-consuming apparatus having a recording material delivery member and a plurality of electrical contact members, the circuit board comprising:

a board;

a plurality of first terminals arranged on the board, the plurality of first terminals used for connection to a memory device, and two second terminals arranged on the board, the two second terminals used for detecting whether the circuit board is installed in the recording material-consuming apparatus, wherein the plurality of first terminals includes a power supply terminal for receiving a power supply potential that differs from a ground potential of the recording material-consuming apparatus, the plurality of first terminals and the two second terminals each includes a contact portion that, when the circuit board is in an installed state wherein the circuit board is installed in the recording material-consuming apparatus, contacts a corresponding one of the electrical contact members of the recording material-consuming apparatus, the contact portions of the plurality of first terminals and the contact portions of the two second terminals are arranged in a plurality of lines, the two contact portions of the two second terminals being situated in a first line of the plurality of lines, and the contact portion of the power terminal is situated between the two contact portions of the two second terminals in the first line, when the circuit board is in a condition of being connected to the recording material-consuming apparatus, the first line is the closest of the plurality of lines to the recording material delivery member.

8. The circuit board according to claim 7, wherein the contact portions of the two second terminals are situated at one end and the other end of the first line.

9. The circuit board according to claim 7, wherein the memory device is adapted to carry out, in sync with a clock signal, transmission of data signals to an external circuit and/or reception of data signals from the external circuit, the plurality of first terminals includes a data terminal for carrying out transmission and/or reception of the data signals, a clock terminal for receiving the clock signal, and a ground terminal for receiving the ground potential.

10. The circuit board according to claim 7, wherein the memory device operates upon receiving a reset signal of a level different from the ground potential, the plurality of first terminals includes a reset terminal for receiving the reset signal, and the reset terminal is situated in a different line from the first line.

11. The circuit board according to claim 7, wherein a total number of the contact portions of the first line exceeds a total number of the contact portions in another line of the plurality of lines.

12. A structural body installable in a recording material-consuming apparatus having a recording material delivery member and a plurality of electrical contact members, the structural body comprising:

a main unit; and a board positioned on the main unit, the board comprising a plurality of first terminals used for connection to a memory device, and two second terminals used for detecting whether the structural body is installed in the recording material-consuming apparatus, wherein the plurality of first terminals includes a power supply terminal for receiving a power supply potential that differs from a ground potential of the recording material-consuming apparatus, the plurality of first terminals and the two second terminals each includes a contact portion that, when the structural body is in an installed state wherein the structural body is installed in the recording material-consuming apparatus, contacts a corresponding one of the electrical contact members of the recording material-consuming apparatus, the contact portions of the plurality of first terminals and the two second terminals are arranged in a plurality of lines, the two contact portions of the two second terminals are situated in a first line of the plurality of lines, and the contact portion of the power terminal is situated between the two contact portions of the two second terminals in the first line, when the structural body is in a condition of being installed in the recording material-consuming apparatus, the first line is the closest of the plurality of lines to the recording material delivery member.

13. The structural body according to claim 12, wherein the contact portions of the two second terminals are situated at one end and the other end of the first line.

14. The structural body according to claim 12, wherein the memory device is adapted to carry out, in sync with a clock signal, transmission of data signals to an external circuit and/or reception of data signals from the external circuit, the plurality of first terminals include a data terminal for carrying out transmission and/or reception of the data signals; a clock terminal for receiving the clock signal, and a ground terminal for receiving the ground potential.

15. The structural body according to claim 12, wherein the memory device operates upon receiving a reset signal of a level different from the ground potential, the plurality of first terminals includes a reset terminal for receiving the reset signal, and the reset terminal is situated in a different line from the first line.

16. The structural body according to claim 12, wherein a total number of the contact portions of the first line exceeds a total number of the contact portions in another line of the plurality of lines.

17. An ink cartridge installable in a printer having a plurality of electrical contact members, the ink cartridge comprising:

an ink receptacle for containing ink, the recording material receptacle having an ink delivery port;

a memory device;

a plurality of first terminals used for connection to the memory device; and two second terminals used for detecting whether the ink cartridge is installed in the printer, wherein the plurality of first terminals includes a power supply terminal for receiving a power supply potential that differs from a ground potential of the printer, the plurality of first terminals and the two second terminals each includes a contact portion that, when the ink cartridge is in an installed state wherein the ink cartridge is installed in the printer, contacts a corresponding one of the electrical contact members of the printer, the contact portions of the plurality of first terminals and the two second terminals are arranged in a plurality of lines, the two contact portions of the two second terminals being situated in a first line of the plurality of lines, and the contact portion of the power terminal is situated between the two contact portions of the two second terminals in the first line, the ink delivery port includes an opening, and the first line is the closest of the plurality of lines to the opening.

18. The ink cartridge according to claim 17, wherein the contact portions of the two second terminals are situated at one end and the other end of the first line.

19. The ink cartridge according to claim 17, wherein the memory device is adapted to carry out, in sync with a clock signal, transmission of data signals to an external circuit and/or reception of data signals from the external circuit, the plurality of first terminals includes a data terminal for carrying out transmission and/or reception of the data signals, a clock terminal for receiving the clock signal, and a ground terminal for receiving the ground potential.

20. The ink cartridge according to claim 17, wherein the memory device operates upon receiving a reset signal of a level different from the ground potential, the plurality of first terminals includes a reset terminal for receiving the reset signal, and the reset terminal is situated in a different line from the first line.

21. The ink cartridge according to claim 17, further comprising:

a side wall; and a base wall;

wherein the plurality of terminals are disposed on the side wall, the ink delivery port is disposed on the base wall, the ink delivery port on the base wall is situated at a location offset towards the side wall, and the ink cartridge is installed into the printer in an installation direction that is downward in a direction of gravity.

22. The ink cartridge according to claim 17, wherein a total number of the contact portions of the first line exceeds a total number of the contact portions in another line of the plurality of lines.

* * * * *